US012366031B2

(12) United States Patent
Lee et al.

(10) Patent No.: US 12,366,031 B2
(45) Date of Patent: Jul. 22, 2025

(54) LAUNDRY TREATING APPARATUS

(71) Applicant: LG ELECTRONICS INC., Seoul (KR)

(72) Inventors: Yunhi Lee, Seoul (KR); Jaehyun Kim, Seoul (KR); Hyunsun Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 291 days.

(21) Appl. No.: 17/827,308

(22) Filed: May 27, 2022

(65) Prior Publication Data

US 2022/0380971 A1 Dec. 1, 2022

(30) Foreign Application Priority Data

| | | |
|---|---|---|
| May 28, 2021 | (KR) | 10-2021-0069528 |
| Jun. 1, 2021 | (KR) | 10-2021-0071149 |
| Sep. 9, 2021 | (KR) | 10-2021-0120155 |
| Sep. 9, 2021 | (KR) | 10-2021-0120161 |
| Sep. 29, 2021 | (KR) | 10-2021-0128828 |

(51) Int. Cl.
*D06F 73/02* (2006.01)
*D06F 29/00* (2006.01)
(Continued)

(52) U.S. Cl.
CPC ..... *D06F 73/02* (2013.01); *D06F 29/005* (2013.01); *D06F 37/20* (2013.01); *D06F 58/04* (2013.01); *D06F 58/10* (2013.01); *D06F 58/26* (2013.01); *D06F 33/32* (2020.02); *D06F 39/04* (2013.01); *D06F 58/206* (2013.01); *D06F 58/38* (2020.02);
(Continued)

(58) Field of Classification Search
CPC ..... D06F 29/005; D06F 39/04; D06F 58/04; D06F 58/10; D06F 58/206; D06F 58/26; D06F 73/02; D06F 2103/50; D06F 2105/26
See application file for complete search history.

(56) References Cited

U.S. PATENT DOCUMENTS 7,320,234 B2 1/2008 Hershey et al.
9,359,714 B2 * 6/2016 Contarini ..... D06F 58/203
(Continued)

FOREIGN PATENT DOCUMENTS

CN 103348053 A 10/2013
CN 104018328 A 9/2014
(Continued)

*Primary Examiner* — Joseph L. Perrin
(74) *Attorney, Agent, or Firm* — Birch, Stewart, Kolasch & Birch, LLP

(57) ABSTRACT

A laundry treating apparatus includes a dryer including a first cabinet and a first drum rotatably mounted in the first cabinet; a washing machine including a second cabinet vertically disposed with respect to the first cabinet, a tub disposed in the second cabinet, and a second drum rotatably mounted in the tub; a refresher including a third cabinet disposed on one side of the first cabinet and the second cabinet, and having an inner space for receiving laundry; a heating device disposed above the first drum and the second drum, and heating air supplied into the inner space of the refresher; and a supply air duct connecting the heating device and an upper portion of the refresher, thereby supplying hot air to the upper portion of the refresher.

12 Claims, 17 Drawing Sheets

(51) Int. Cl.

| | |
|---|---|
| ***D06F 37/20*** | (2006.01) |
| ***D06F 58/04*** | (2006.01) |
| ***D06F 58/10*** | (2006.01) |
| ***D06F 58/20*** | (2006.01) |
| ***D06F 58/26*** | (2006.01) |
| *D06F 33/32* | (2020.01) |
| *D06F 39/04* | (2006.01) |
| *D06F 58/38* | (2020.01) |
| *D06F 103/32* | (2020.01) |
| *D06F 103/50* | (2020.01) |
| *D06F 105/20* | (2020.01) |
| *D06F 105/26* | (2020.01) |

(52) U.S. Cl.
CPC ..... *D06F 2103/32* (2020.02); *D06F 2103/50* (2020.02); *D06F 2105/20* (2020.02); *D06F 2105/26* (2020.02)

(56) References Cited

U.S. PATENT DOCUMENTS

| | | | | |
|---|---|---|---|---|
| 9,372,031 | B2 * | 6/2016 | Contarini | F26B 21/086 |
| 9,435,069 | B2 * | 9/2016 | Contarini | D06F 58/206 |
| 2002/0017117 | A1 | 2/2002 | Sunshine et al. | |
| 2004/0194339 | A1 | 10/2004 | Johnson et al. | |
| 2005/0155393 | A1 | 7/2005 | Wright et al. | |
| 2006/0112585 | A1 | 6/2006 | Choi et al. | |
| 2006/0137210 | A1 | 6/2006 | Lee et al. | |
| 2006/0156765 | A1 * | 7/2006 | Sunshine | D06F 39/12 68/19 |
| 2007/0151300 | A1 | 7/2007 | Sunshine | |
| 2007/0151301 | A1 | 7/2007 | Kendall et al. | |
| 2007/0169519 | A1 | 7/2007 | Hershey et al. | |
| 2007/0256457 | A1 * | 11/2007 | Kendall | D06F 29/00 68/3 R |
| 2008/0229515 | A1 | 9/2008 | Hong et al. | |
| 2009/0126421 | A1 | 5/2009 | Kim et al. | |
| 2010/0299976 | A1 | 12/2010 | Roselle et al. | |
| 2011/0132043 | A1 | 6/2011 | Kim | |
| 2011/0185511 | A1 | 8/2011 | Ryoo et al. | |
| 2014/0026433 | A1 * | 1/2014 | Bison | D06F 39/12 34/73 |
| 2016/0186374 | A1 | 6/2016 | Ryoo et al. | |
| 2018/0340285 | A1 | 11/2018 | Choi et al. | |
| 2018/0340288 | A1 | 11/2018 | Kim et al. | |
| 2020/0240065 | A1 | 7/2020 | Underly et al. | |
| 2021/0148029 | A1 | 5/2021 | Lv et al. | |

FOREIGN PATENT DOCUMENTS

| | | | |
|---|---|---|---|
| CN | 105316890 | A | 2/2016 |
| CN | 106283486 | A | 1/2017 |
| CN | 108301166 | A | 7/2018 |
| CN | 106032612 | A | 10/2018 |
| CN | 109582306 | A | 4/2019 |
| CN | 209652609 | U | 11/2019 |
| CN | 209686107 | U | 11/2019 |
| CN | 111996767 | A | 11/2020 |
| DE | 10 2006 015 840 | A1 | 10/2007 |
| DE | 10 2008 006 111 | A1 | 7/2009 |
| DE | 10 2008 064 737 | B3 | 8/2016 |
| EP | 1 029 961 | A2 | 8/2000 |
| EP | 3 940 134 | A1 | 1/2022 |
| JP | 2004-159859 | A | 6/2004 |
| JP | 2008-307151 | A | 12/2008 |
| KR | 10-2005-0066534 | A | 6/2005 |
| KR | 10-2006-0042568 | A | 5/2006 |
| KR | 10-2006-0060211 | A | 6/2006 |
| KR | 10-0587360 | B1 | 6/2006 |
| KR | 10-2006-0046802 | A | 8/2006 |
| KR | 10-2008-0111128 | A | 10/2006 |
| KR | 10-0658842 | B1 | 12/2006 |
| KR | 10-0674718 | B1 | 1/2007 |
| KR | 10-0839519 | B1 | 6/2008 |
| KR | 10-2008-0100964 | A | 11/2008 |
| KR | 10-2010-0025981 | A | 3/2010 |
| KR | 10-2019-0131259 | A | 11/2019 |
| KR | 10-2120993 | B1 | 6/2020 |
| KR | 10-2020-0109194 | A | 9/2020 |
| KR | 10-2200698 | B1 | 1/2021 |
| KR | 10-2254903 | B1 | 5/2021 |
| WO | WO 2007/148894 | A2 | 12/2007 |
| WO | WO 2008/066539 | A1 | 6/2008 |
| WO | WO 2011/149320 | A2 | 12/2011 |
| WO | WO 2014/017004 | A1 | 1/2014 |
| WO | WO 2017/119673 | A1 | 7/2017 |
| WO | WO 2019/141063 | A1 | 7/2019 |
| WO | WO 2019/154266 | A1 | 8/2019 |
| WO | WO 2021/083006 | A1 | 5/2021 |

* cited by examiner

【FIG. 1】
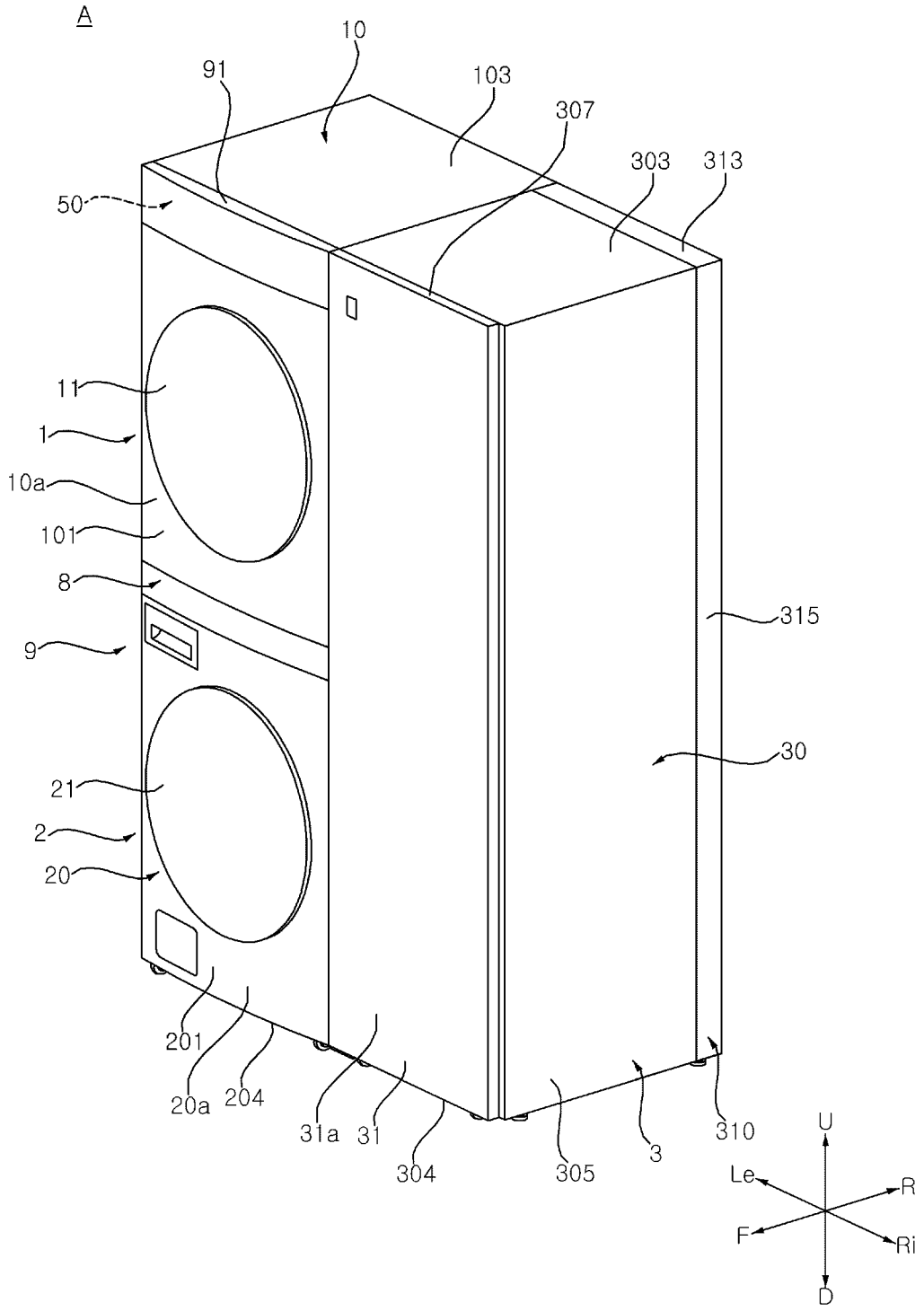

【FIG. 2】
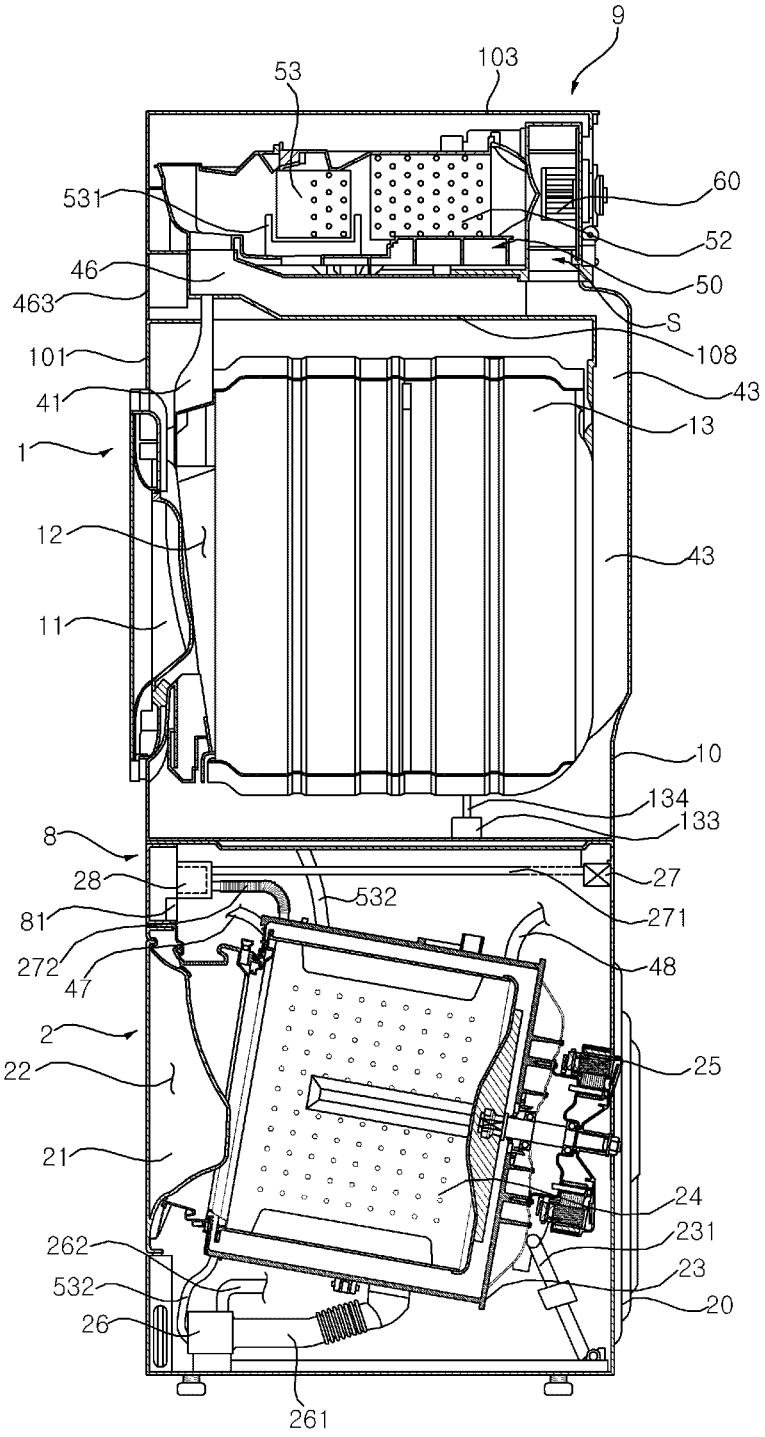

【FIG. 3】
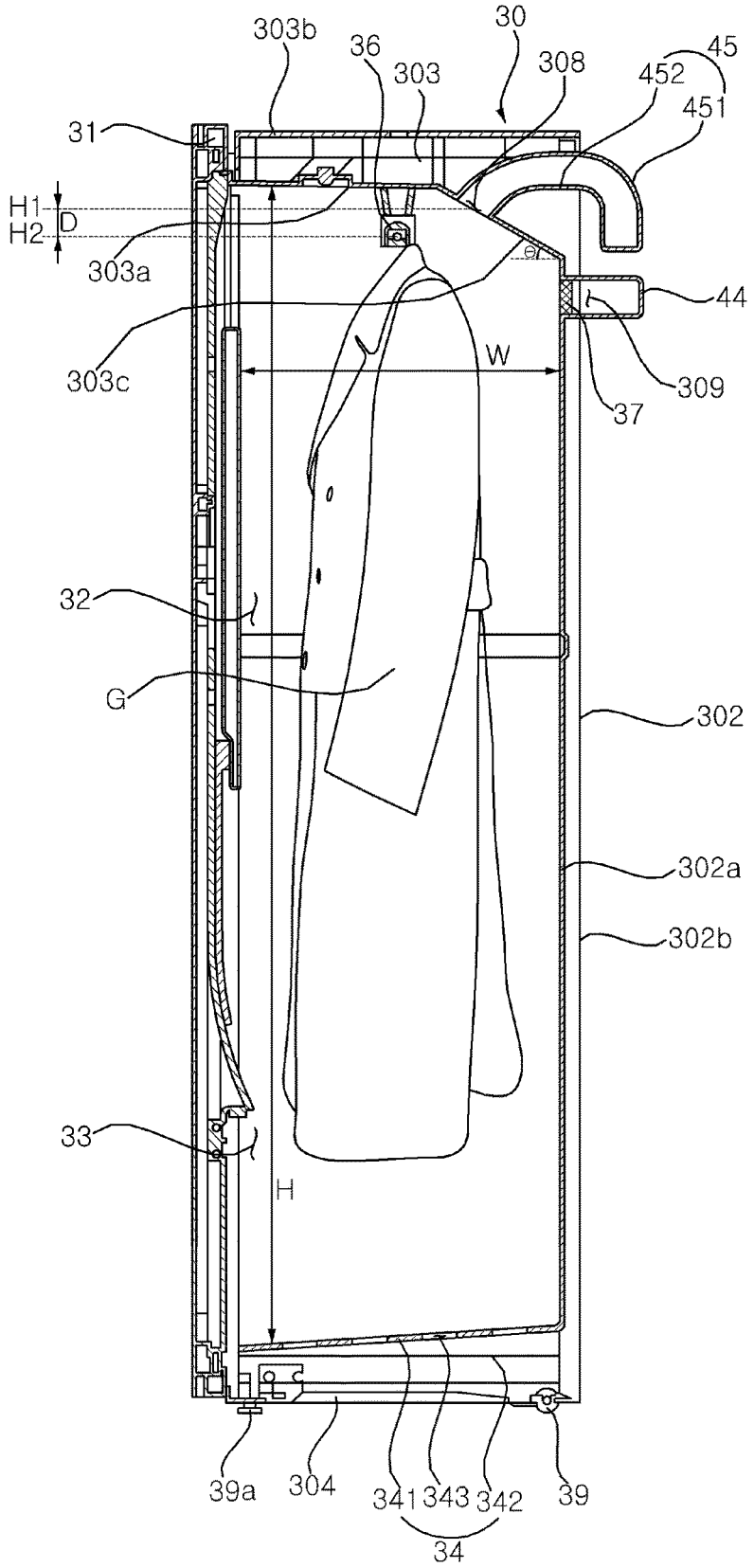

【FIG. 4】
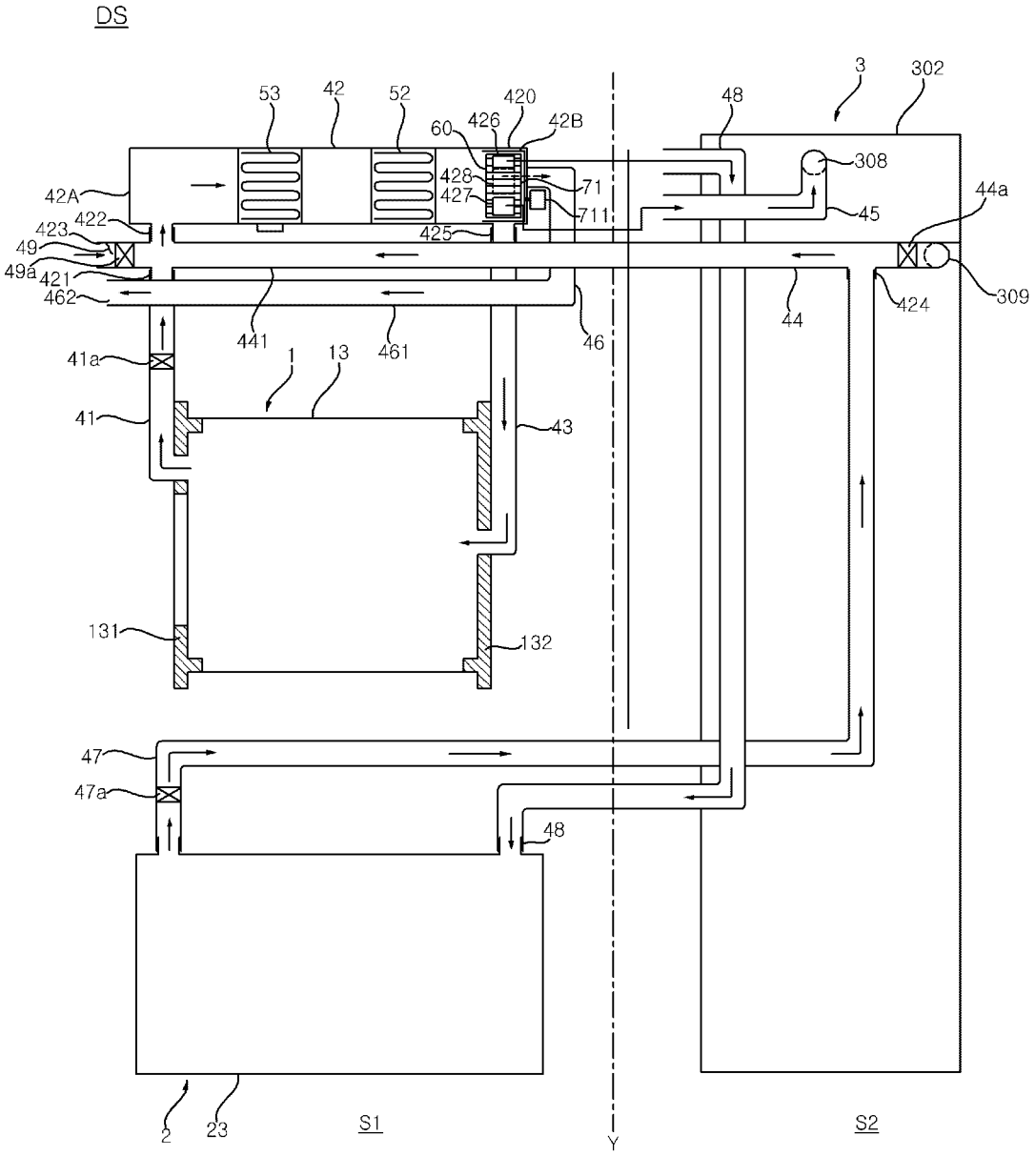

【FIG. 5】
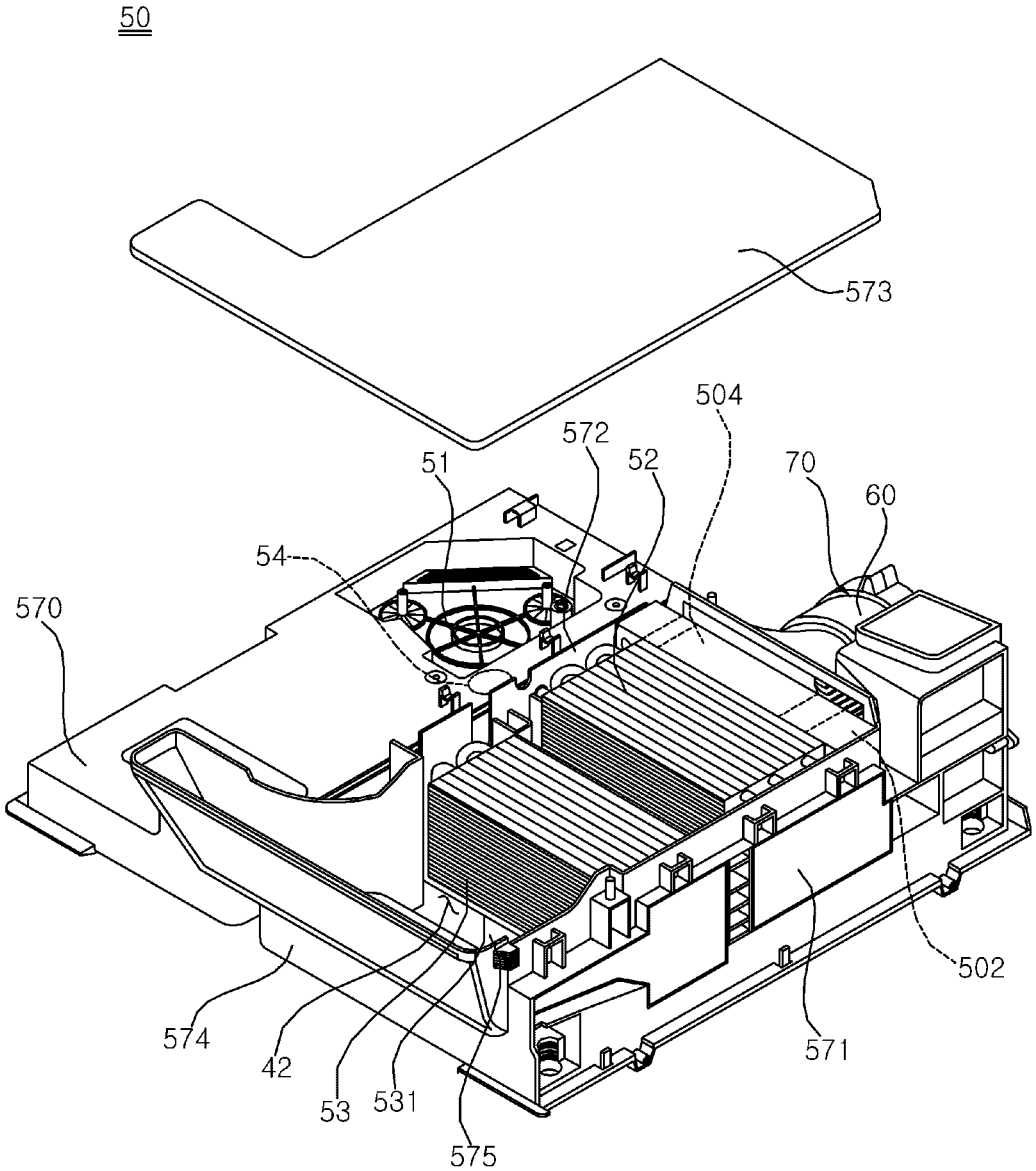

【FIG. 6】
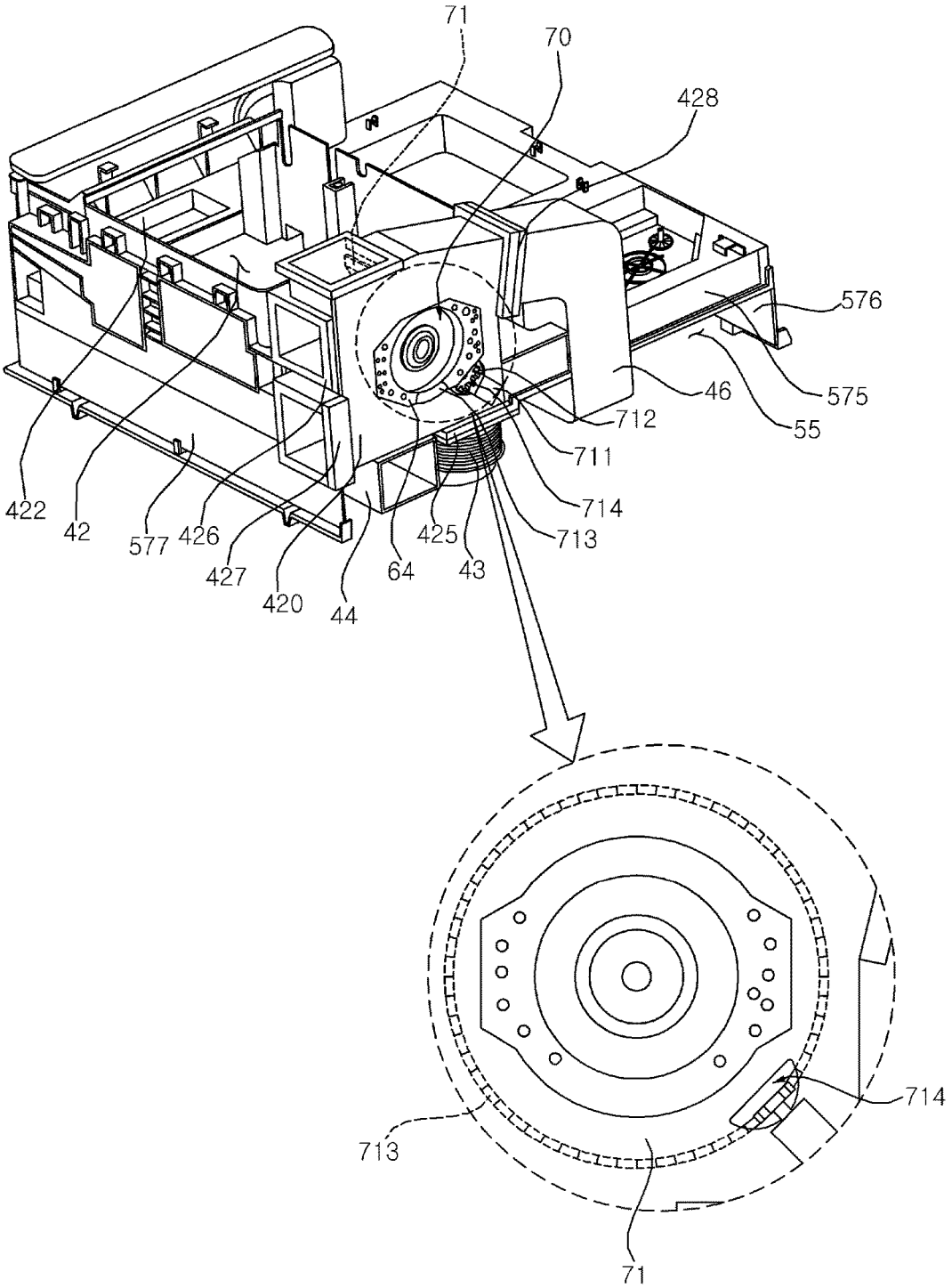

【FIG. 7】
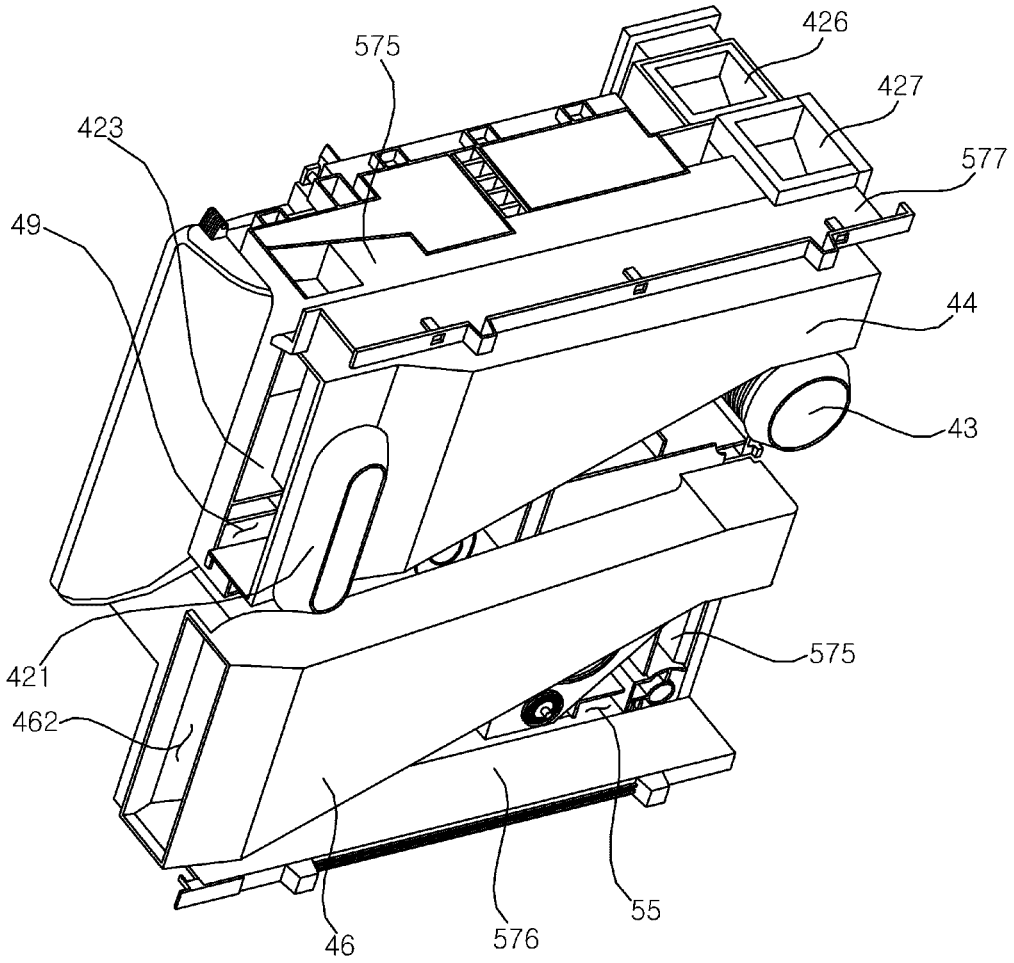

【FIG. 8】
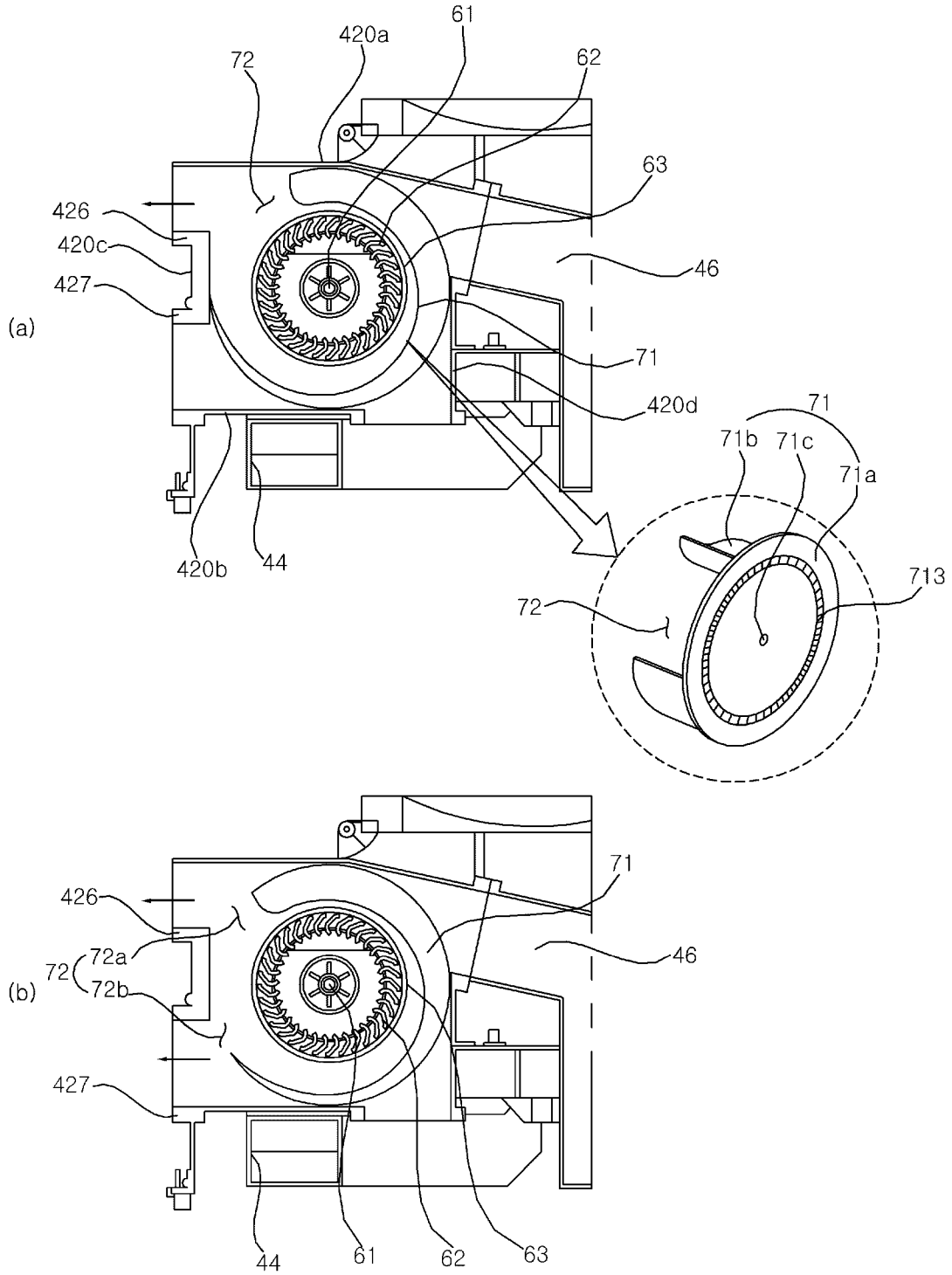

【FIG. 9】
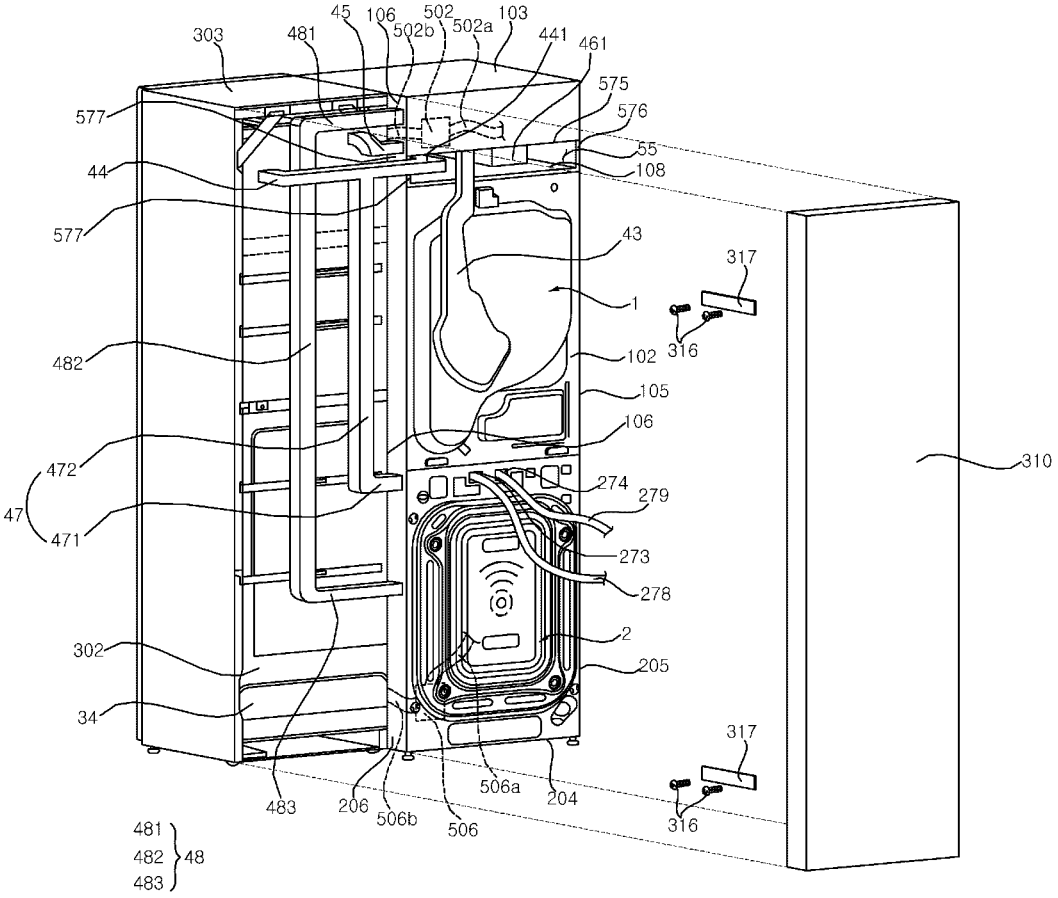

【FIG. 10】
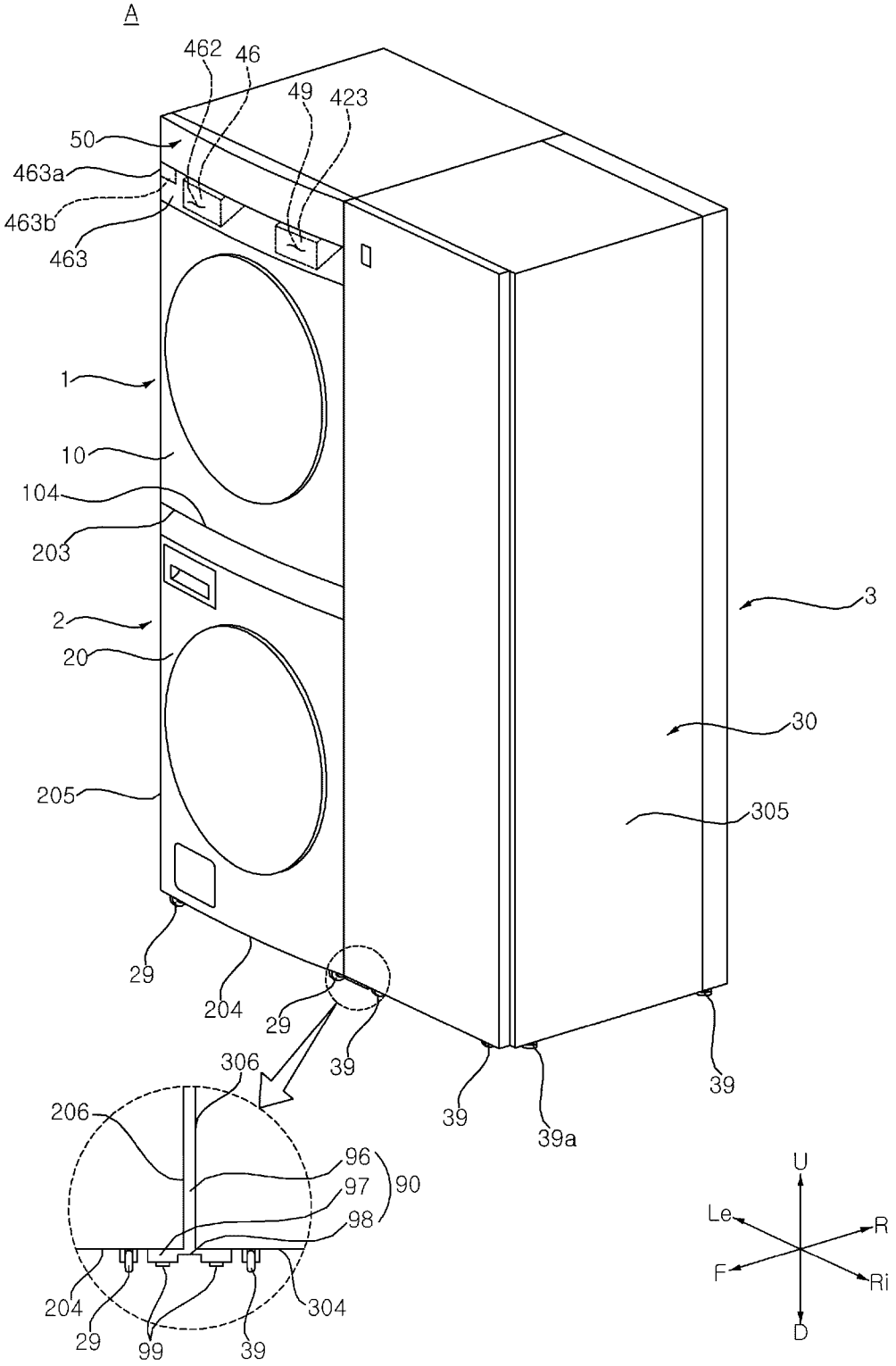

【FIG. 11】
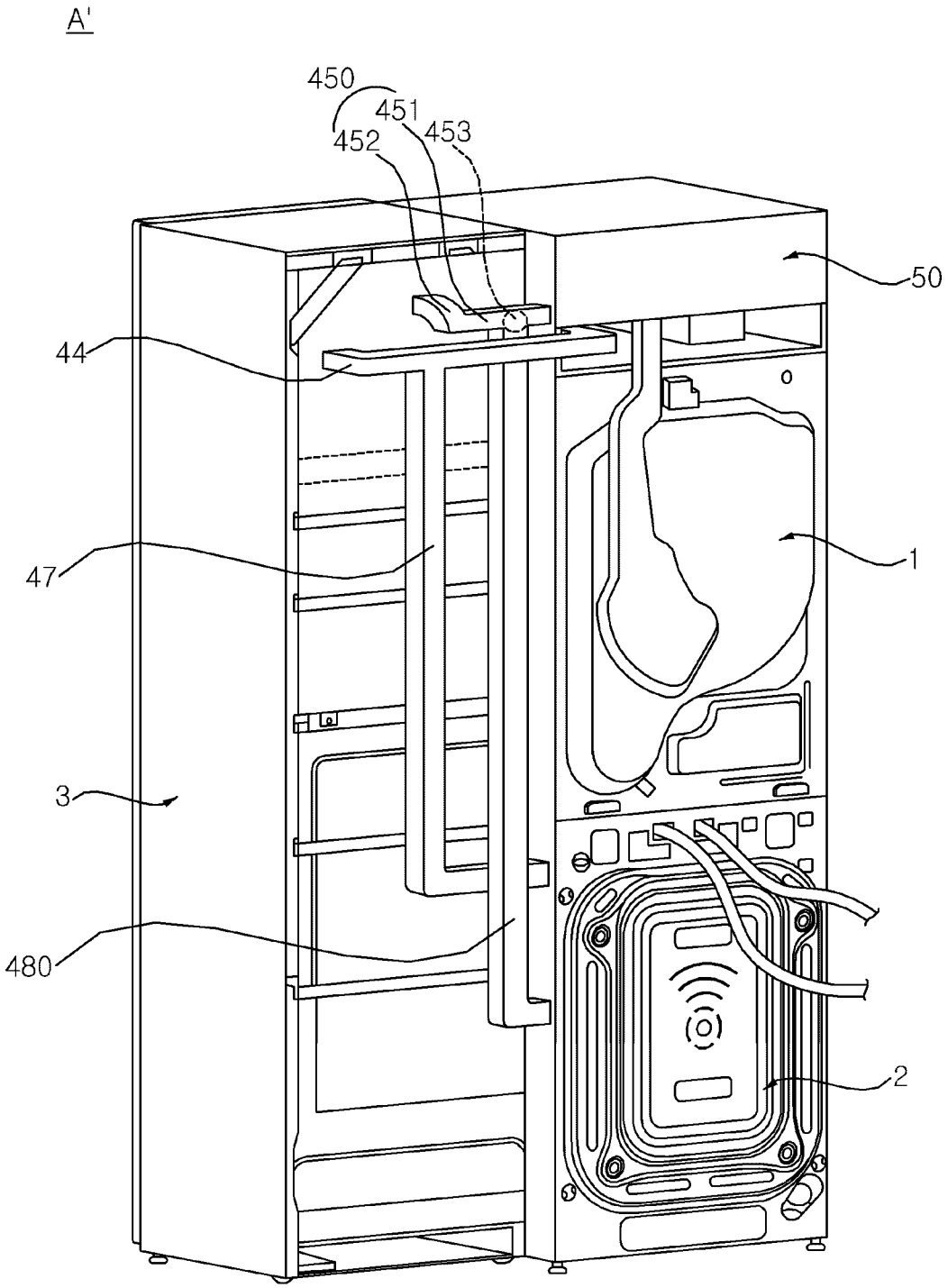

【FIG. 12】
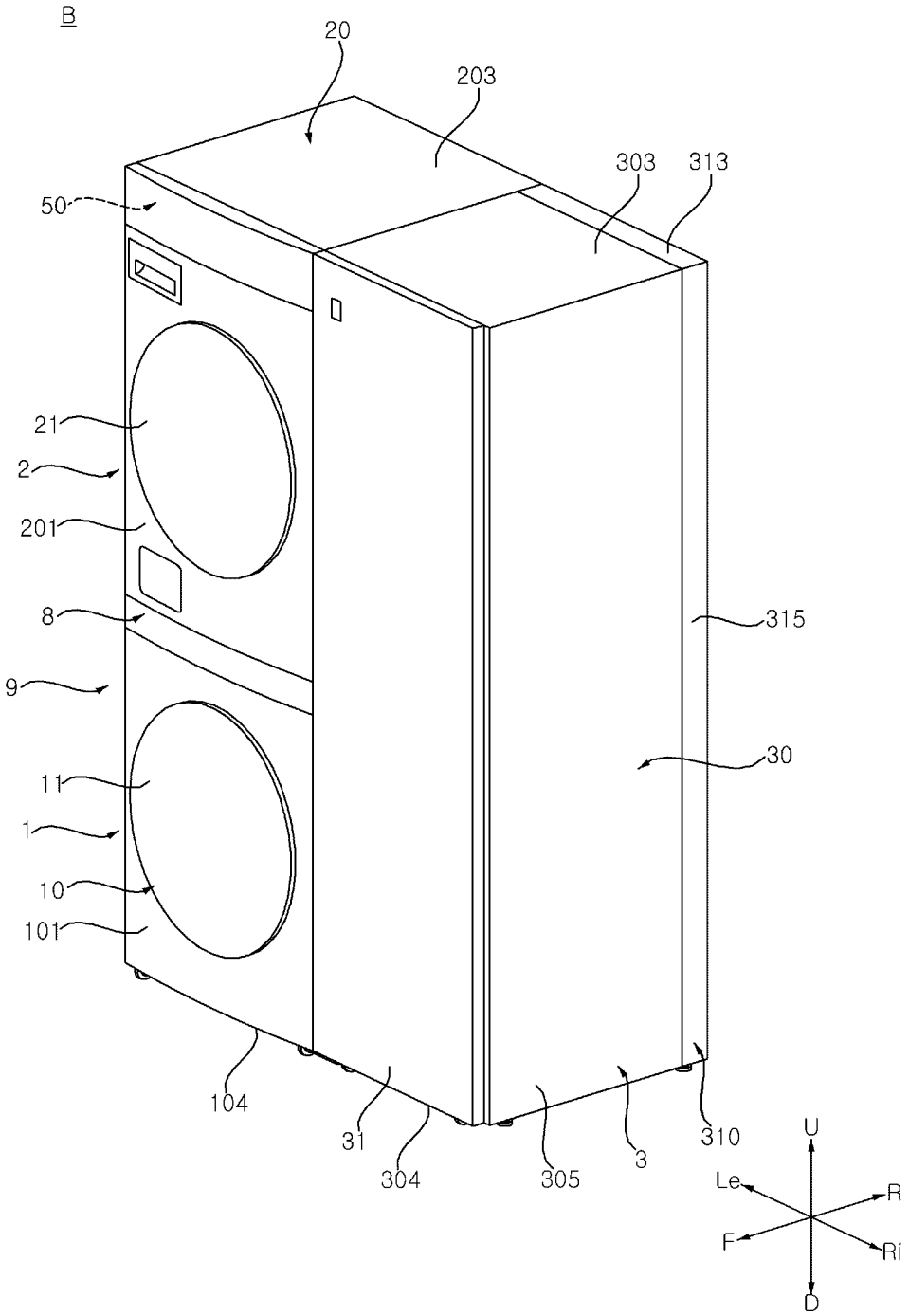

【FIG. 13】
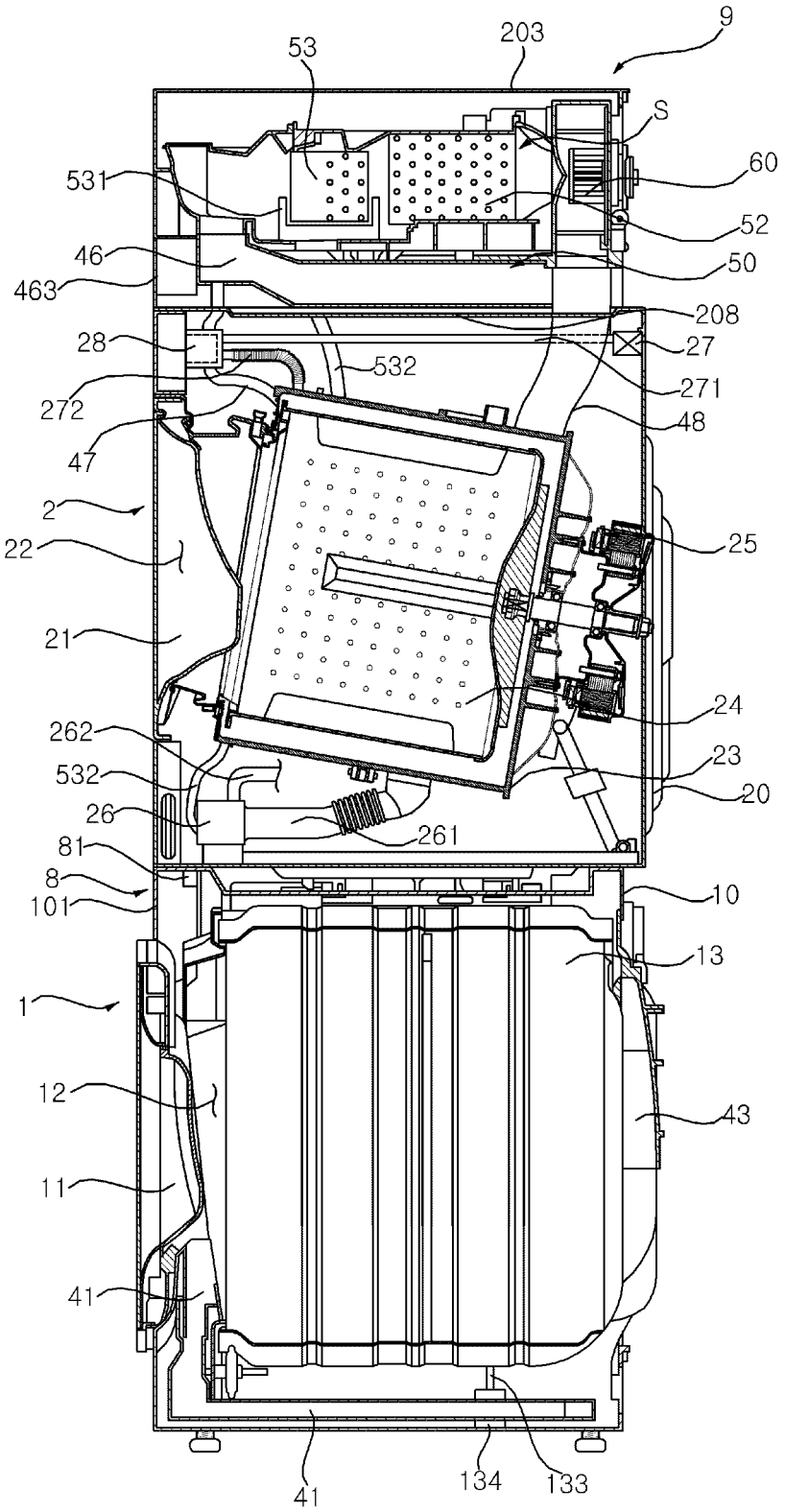

【FIG. 14】
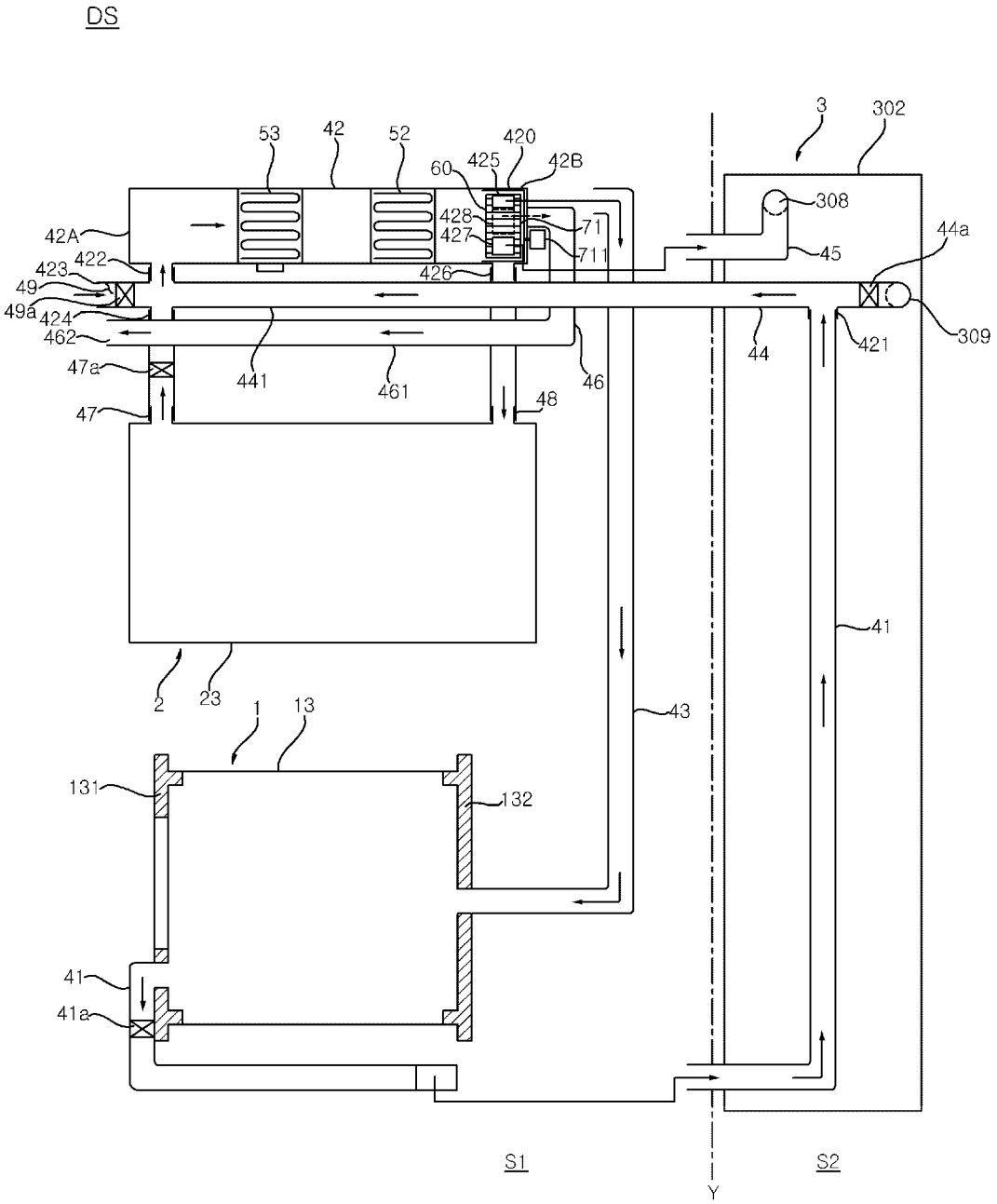

【FIG. 15】
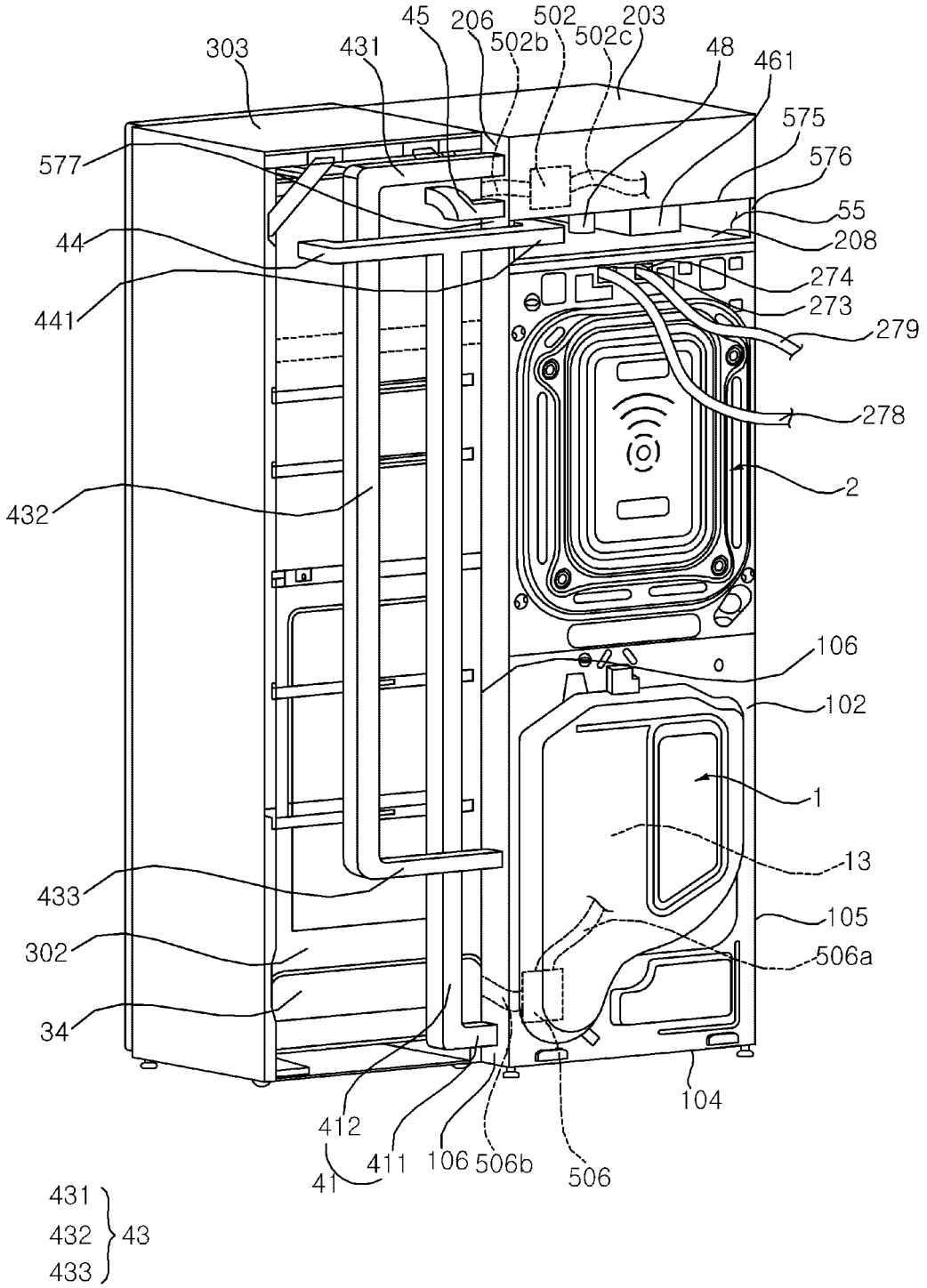

【FIG. 16】
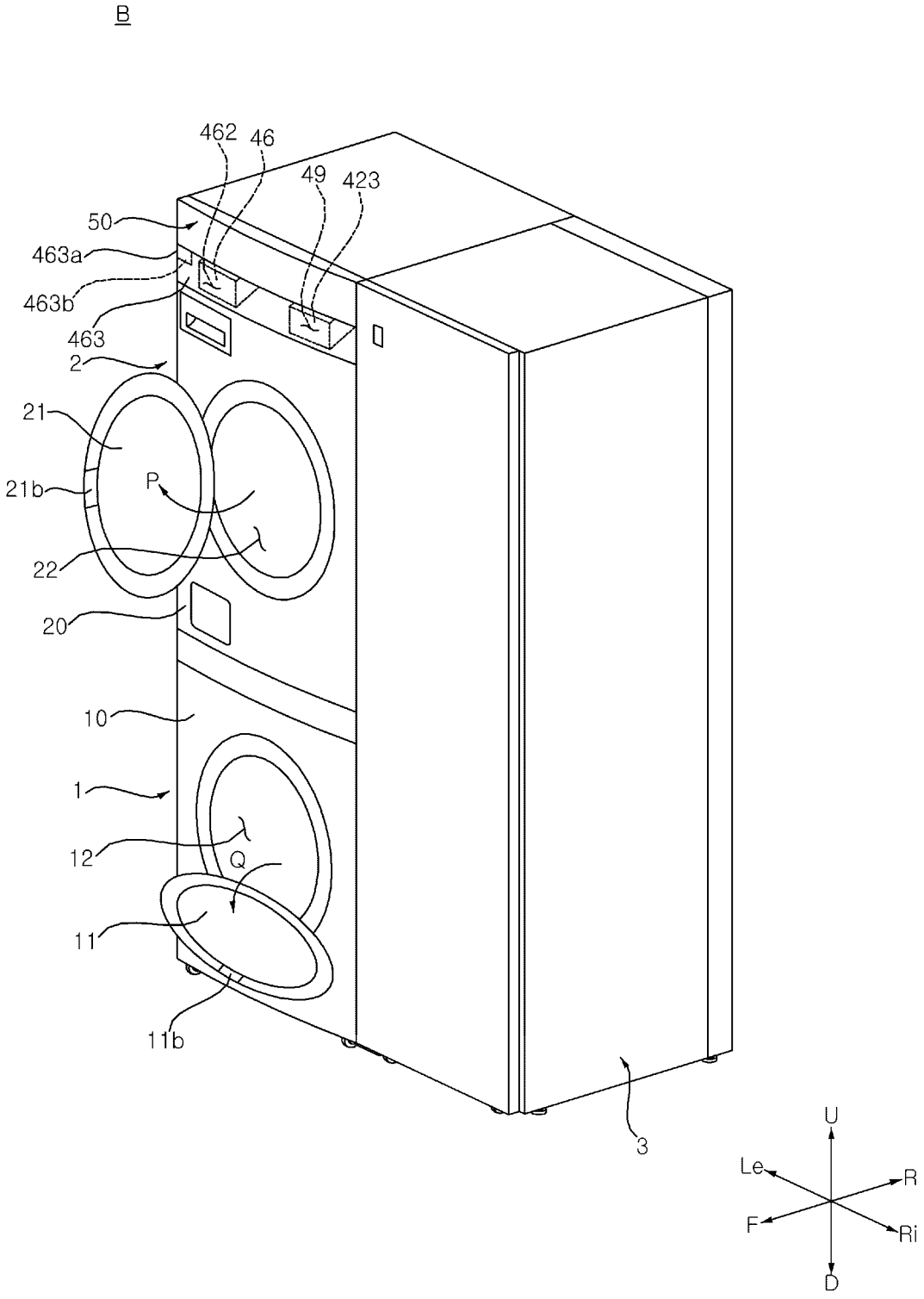

【FIG. 17】
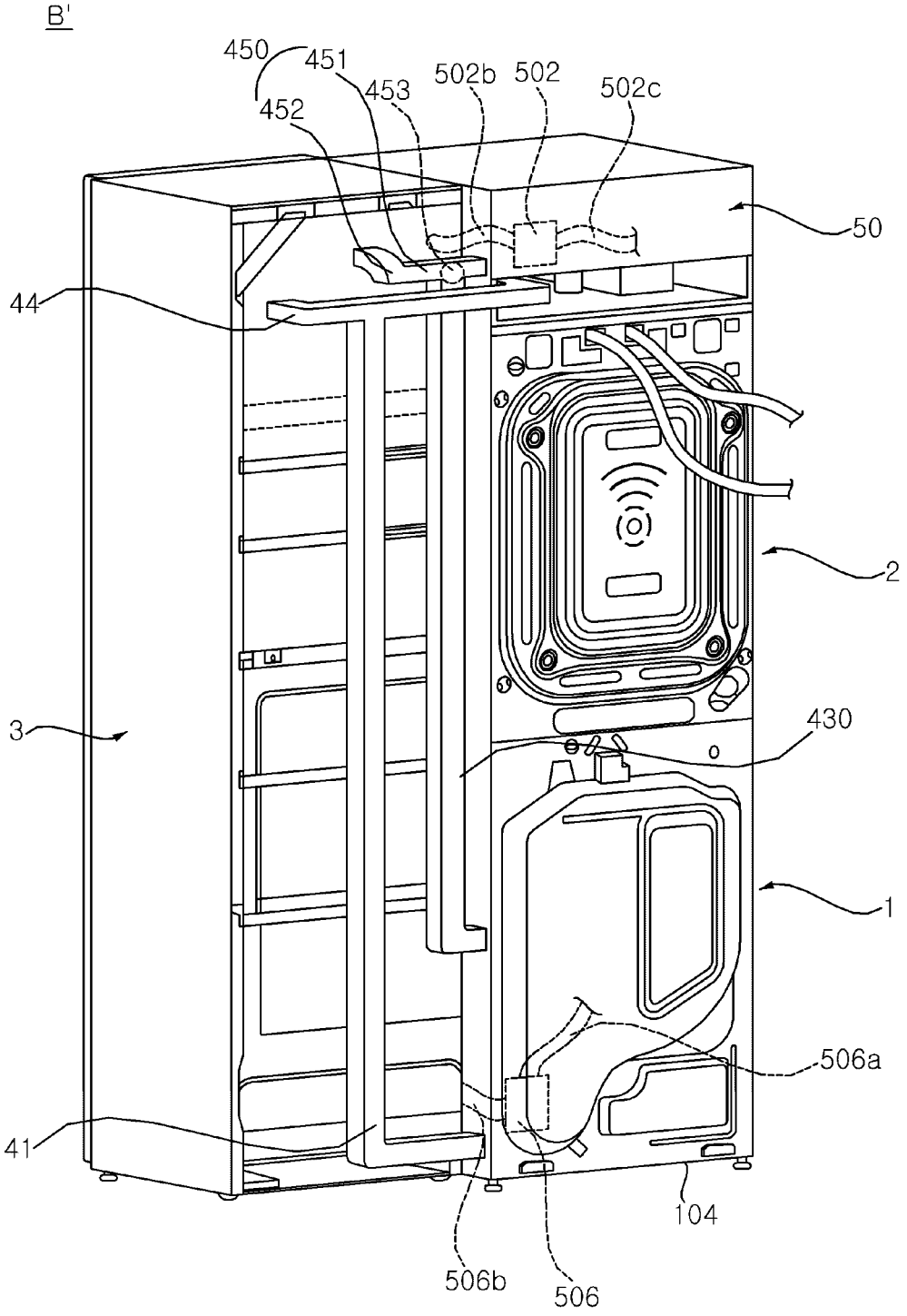

LAUNDRY TREATING APPARATUS

CROSS-REFERENCE TO RELATED APPLICATIONS

This application claims the priority benefit of the Korean Patent Application No. 10-2021-0069528, filed in the Republic of Korea on May 28, 2021, Korean Patent Application No. 10-2021-0071149, filed in the Republic of Korea on Jun. 1, 2021, Korean Patent Application No. 10-2021-0120155, filed in the Republic of Korea on Sep. 9, 2021, Korean Patent Application No. 10-2021-0120161, filed in the Republic of Korea on Sep. 9, 2021, and Korean Patent Application No. 10-2021-0128828, filed in the Republic of Korea on Sep. 29, 2021, which are hereby incorporated by reference in their entirety for all purposes as if fully set forth herein.

BACKGROUND OF THE INVENTION

1. Field of the Invention

The present disclosure relates to a laundry treating apparatus, and more particularly to a laundry treating apparatus including a plurality of laundry treating machines.

2. Description of the Background Art

A washing machine, a dryer, and refreshers, which are provided for treating clothes, are installed in different spaces, such as a kitchen, a utility room, and an outdoor space, according to usage in a residential space.

Korean Laid-Open Patent Publication No. 10-2020-0109194 discloses a washing machine. The washing machine washes laundry by supplying water and detergent into a tub and a drum and by rotating the drum in which the laundry is placed. In the washing machine, water from an external water source is supplied into the tub or the drum, and a pump is used to circulate the water in the tub to the drum or to discharge the water in the tub to the outside. The washing machine is generally installed in the kitchen or the utility room for the supply and discharge of water.

The washing machine separately includes a heater for heating air, a blower fan, and a steam generator, to dry or sterilize the laundry.

Korean Patent No. 10-2120993 discloses a dryer. The dryer may dry the laundry, placed in the drum, by heating air using a heating means and a blower fan and by supplying the heated air into the drum. The dryer is generally disposed adjacent to the washing machine, so as to dry the washed laundry and to allow a user to easily load the laundry containing moisture into the dryer.

By using the steam generator for generating steam and spraying the steam into the drum, the dryer may sterilize the laundry or may remove wrinkles of the laundry. Water may be supplied into the dryer for generating the steam, and water not changed into steam may be reused or may be discharged to the outside. Further, in order to deodorize the dried laundry, the dryer may further have a deodorization function for filtering the circulated air.

Korean Patent No. 10-2254903 discloses a refresher. The refresher may perform functions, such as drying, deodorizing, de-wrinkling, de-static and/or sterilization (hereinafter referred to as "refreshing").

The refresher is used for treating clothes, such as suits and coats, which are frequently used by a user after washing. Generally, the user hangs the clothes, such as suits and coats, in a wardrobe. Accordingly, the refresher may be installed adjacent to the wardrobe, or may be installed instead of the wardrobe, in a dressing room, a living room, or a bedroom. Further, not only for the clothes or garments, the refresher may be used for all washable items, such as shoes, socks, gloves, hats, scarves, etc., which are frequently worn by users, as well as dolls, towels, blankets, etc., which are frequently used by users.

However, the existing laundry treating machines, which are installed in different spaces, have a problem in that a user needs to move the laundry items, which are sorted by a user, to the respective laundry treating machines performing corresponding laundry treating processes, thereby requiring a longer workflow, and making the clothes treating processes uncomfortable.

In addition, as the refresher is installed in a different place from the washing machine and the dryer, it is cumbersome for the user to move the washed wet clothes or the dried clothes to the place where the refresher is installed.

Furthermore, each of the existing laundry treating machines for treating laundry using hot air and steam separately requires water supply equipment, drainage equipment, an air heater, a steam generator, a pump, a blower fan, an air passage, a steam passage, etc., thereby causing a problem in that a space for receiving clothes is reduced. In addition, as each of the machines includes the heater, the steam generator, etc., there is a problem in that costs and energy consumption of the entire system may increase.

In addition, the existing washing machine also has a problem in that vibrations generated by the rotation of the drum cause uncomfortable noise. Particularly, when the drum rotates at a high speed for the spin-drying cycle, the entire cabinet rocks and collides with a structure near the washing machine, thereby causing excessive noise.

Moreover, the existing laundry treating apparatus also has a drawback in that a user needs to move the wet heavy laundry to the dryer after washing, such that a user's workload may increase.

SUMMARY OF THE INVENTION

It is an object of the present disclosure to solve the above and other problems.

It is another object of the present disclosure to provide a laundry treating apparatus including a plurality of laundry treating machines.

It is yet another object of the present disclosure to provide a laundry treating apparatus including a washing machine, a dryer, and a refresher.

It is still another object of the present disclosure to provide a laundry treating apparatus capable of performing washing, drying, and refreshing of the laundry in the same space.

It is still another object of the present disclosure to provide a laundry treating apparatus capable of minimizing a user's workflow required for laundry treatment.

It is still another object of the present disclosure to provide a laundry treating apparatus capable of treating laundry which may not be subjected to high temperature drying in a space where washing and drying are performed.

It is still another object of the present disclosure to provide a laundry treating apparatus with improved workability in washing, drying, and refreshing processes of the laundry.

It is still another object of the present disclosure to provide a laundry treating apparatus with reduced vibrations generated in the entire system.

It is still another object of the present disclosure to provide a laundry treating apparatus capable of improving user convenience in manipulation by lowering the height of components, such as a door, a control panel, etc., which require manipulation by a user.

It is still another object of the present disclosure to provide a laundry treating apparatus having a hot air passage for supplying air to the washing machine, the dryer, and the refresher.

It is still another object of the present disclosure to provide a laundry treating apparatus capable of minimizing a length of a hot air passage for supplying air to the washing machine, the dryer, and the refresher.

It is still another object of the present disclosure to provide a refresher having an extended longitudinal width.

It is still another object of the present disclosure to provide a laundry treating apparatus having a refresher with an extended longitudinal width.

It is still another object of the present disclosure to provide a laundry treating apparatus having an extended vertical height of a laundry receiving space.

It is still another object of the present disclosure to provide a laundry treating apparatus having an extended vertical height of a laundry receiving space.

It is still another object of the present disclosure to provide a laundry treating apparatus having an extended vertical height of a laundry receiving space in the refresher.

It is still another object of the present disclosure to provide a laundry treating apparatus using a difference between a longitudinal width of the refresher and a longitudinal width of the washing machine/dryer.

It is still another object of the present disclosure to provide a laundry treating apparatus having a steam passage for supplying steam to the washing machine, the dryer, and the refresher.

It is still another object of the present disclosure to provide a laundry treating apparatus capable of minimizing a steam passage for supplying steam to the washing machine, the dryer, and the refresher.

It is still another object of the present disclosure to provide a laundry treating apparatus capable of supplying hot air to the plurality of laundry treating machines using a single heating device.

It is still another object of the present disclosure to provide a laundry treating apparatus capable of supplying steam to the plurality of laundry treating machines using a single heating device.

It is still another object of the present disclosure to provide a laundry treating apparatus capable of facilitating discharge of condensate generated by the heating device.

It is still another object of the present disclosure to provide a laundry treating apparatus capable of facilitating the supply of water for steam generation and discharge of the water.

It is still another object of the present disclosure to provide a laundry treating apparatus capable of minimizing a length of a hot air passage for supplying air to the dryer and the refresher.

It is still another object of the present disclosure to provide a laundry treating apparatus capable of optimizing the placement of a fan for supplying hot air to the dryer and the refresher.

It is still another object of the present disclosure to provide a laundry treating apparatus capable of minimizing heat loss of hot air supplied to the refresher.

It is still another object of the present disclosure to provide a laundry treating apparatus capable of minimizing a length of a supply air duct and an exhaust air duct which are connected to the refresher.

It is still another object of the present disclosure to provide a laundry treating apparatus capable of discharging condensate generated by the heating device, without using separate pump equipment.

It is still another object of the present disclosure to provide a laundry treating apparatus capable of managing condensate by using a drain pump of the washing machine.

It is still another object of the present disclosure to provide a laundry treating apparatus in which temperature of hot air supplied to the refresher is lower than that of the dryer.

It is still another object of the present disclosure to provide a laundry treating apparatus capable of minimizing vibrations generated in the washing machine.

It is still another object of the present disclosure to provide a laundry treating apparatus capable of reducing rocking of cabinets of the washing machine.

It is still another object of the present disclosure to provide a laundry treating apparatus in which the plurality of laundry treating machines are coupled to each other.

It is still another object of the present disclosure to provide a laundry treating apparatus capable of supplying hot air to an upper side of the refresher.

It is still another object of the present disclosure to provide a laundry treating apparatus capable of recovering hot air from the upper side of the refresher.

It is still another object of the present disclosure to provide a laundry treating apparatus capable of lowering the height of doors of the washing machine and the dryer.

It is still another object of the present disclosure to provide a laundry treating apparatus capable of lowering the height of a laundry loading opening, through which the laundry is loaded, and the height of a control panel.

It is still another object of the present disclosure to provide a laundry treating apparatus capable of allowing users to easily carry the washed laundry.

It is still another object of the present disclosure to provide a laundry treating apparatus capable of preventing air, heated and dehumidified by the heating device, from being directly discharged to users.

It is still another object of the present disclosure to provide a laundry treating apparatus having a passage formed at a high position for indoor dehumidification.

It is still another object of the present disclosure to provide a laundry treating apparatus having an aligned upper end.

It is still another object of the present disclosure to provide a laundry treating apparatus having an aligned front surface.

It is still another object of the present disclosure to provide a laundry treating apparatus having a height which is constant in the horizontal direction.

It is still another object of the present disclosure to provide a laundry treating apparatus having a constant longitudinal width.

It is still another object of the present disclosure to provide a laundry treating apparatus capable of preventing collision of the laundry treating apparatus with surrounding structures when the laundry treating apparatus is installed.

The objects of the present disclosure are not limited to the aforementioned objects and other objects not described herein will be clearly understood by those skilled in the art from the following description.

In accordance with an aspect of the present disclosure, the above and other objects can be accomplished by providing a laundry treating apparatus including a dryer including a first cabinet having a first laundry loading opening.

The dryer may have a first door for opening and closing the first laundry loading opening.

The dryer may include a first drum rotatably disposed in the first cabinet.

The laundry treating apparatus may include a washing machine including a second cabinet vertically disposed with respect to the first cabinet.

The second cabinet may include a second laundry loading opening.

The washing machine may include a second door for opening and closing the second laundry loading opening.

The washing machine may include a tub disposed in the second cabinet.

The washing machine may include a second drum rotatably disposed in the tub.

The laundry treating apparatus may include a refresher disposed on one side of the dryer.

The refresher may be disposed on one side of the washing machine.

The refresher may include a third cabinet having an opening.

The refresher may include a third door for opening and closing the opening.

A space for receiving laundry may be formed in the refresher.

The laundry treating apparatus may include a duct system connected to the dryer and the refresher.

The duct system may include a first supply air duct for supplying air into the first drum.

The duct system may include a second supply air duct for supplying air into an inner space of the refresher.

The duct system may include a heat exchange channel connected to the first supply air duct and the second supply air duct.

The laundry treating apparatus may include a heating device for heating air passing through the heat exchange channel.

The laundry treating apparatus may include a first laundry treating machine including a cabinet having a laundry loading opening, and a door for opening and closing the laundry treating opening.

The first laundry treating machine may include a drum rotatably disposed in the cabinet.

The laundry treating apparatus may include a second laundry treating machine including a cabinet having a laundry loading opening, and a door for opening and closing the laundry treating opening.

A space for receiving laundry may be formed in the second laundry treating machine.

The duct system may include a first supply air duct for supplying air into the drum of the first laundry treating machine.

The duct system may include a second supply air duct for supplying air into the inner space of the second laundry treating machine.

The duct system may include a heat exchange channel connected to the first supply air duct and the second supply air duct.

The heat exchange channel may include an inlet end through which air is introduced, and a discharge end through which the air is discharged.

The laundry treating apparatus may include an integrated frame, having a first laundry loading opening and a second laundry loading opening which are vertically spaced apart from each other, and having a horizontal partition wall disposed at a middle portion thereof.

A drying room may be formed between an upper panel and the horizontal partition wall of the integrated frame.

The first drum may be disposed in the drying room.

A washing room may be formed between a lower panel and the horizontal partition wall of the integrated frame.

The tub and the second drum may be disposed in the washing room.

The laundry treating apparatus may include a side frame disposed on one side of the integrated frame.

The second supply air duct may supply air into the side frame.

The laundry treating apparatus may include a single frame in which a vertical partition wall is disposed.

The horizontal partition wall may be disposed between the vertical partition wall and the one side panel of the single frame.

The washing room and the drying room may be vertically separated by the horizontal partition wall between the one side panel and the vertical partition wall.

A refreshing room for treating clothes may be formed between the vertical partition wall and the other panel of the single frame.

The dryer may be disposed on one side of the washing machine in a direction horizontal to the washing machine.

The refresher may be disposed over the dryer and the washing machine.

The laundry treating apparatus may include a supply air duct connecting the heating device and the refresher.

The supply air duct may supply the air, heated by the heating device, into the inner space of the refresher.

The washing machine may be disposed over the dryer.

The heating device may include a heat exchange unit for heating air supplied to the refresher.

The supply air duct may be connected to a supply air hole formed at a lower portion of the refresher.

The laundry treating apparatus may include an exhaust air duct extending upwardly form the heating device.

The exhaust air duct may be connected to an exhaust air hole formed at an upper portion of the refresher.

The heating device may be disposed over the dryer.

The supply air duct may extend upwardly from the heating device.

The supply air duct may be connected to a supply air hole formed at an upper portion of the refresher.

The laundry treating apparatus may include an exhaust air duct extending downwardly from the heating device.

The exhaust air duct may be connected to an exhaust air hole formed at a lower portion of the refresher.

The dryer may be disposed over the washing machine.

The washing may include a drain pump for discharging water in the tub.

The laundry treating apparatus may include a drain pan disposed under the heat exchange unit.

The laundry treating apparatus may include a drain pipe connecting the drain pan and the drain pump.

The washing machine may include an upper panel coupled to a lower portion of the dryer.

The washing machine may include a suspension connecting the cabinet and the tub of the washing machine.

The cabinet of the washing machine may include a side panel disposed between the tub and the cabinet of the refresher.

The side panel may face the cabinet of the refresher.

The side panel may be coupled to the cabinet of the refresher.

The heating device may be disposed over the first drum.

The heating device may be disposed above the first drum and the second drum.

The second drum may be open toward the second laundry loading opening, so that laundry placed therein may be unloaded through the second laundry loading opening.

The first drum may be disposed under the second drum.

The first drum may be open toward the first laundry loading opening, so that the laundry unloaded from the second drum, may be loaded through the first laundry loading opening.

The laundry treating apparatus may include a dehumidification duct for discharging the air, heated by the heating device, outside of the laundry treating apparatus.

The dehumidification duct may be disposed above the door of the dryer and the door of the washing machine.

An upper end of a front surface of the laundry treating apparatus may be aligned horizontally.

An upper end of a front surface of any one, which is located uppermost, among the dryer, the washing machine, and the heating device, may be aligned with an upper end of a front surface of the refresher.

Other detailed matters of the exemplary embodiments are included in the detailed description and the drawings.

Effects of the Invention

According to at least one of the embodiments of the present disclosure, there is provided a laundry treating apparatus including a plurality of laundry treating machines.

According to at least one of the embodiments of the present disclosure, there is provided a laundry treating apparatus including a washing machine, a dryer, and a refresher.

According to at least one of the embodiments of the present disclosure, there is provided a laundry treating apparatus, in which the washing machine, the dryer, and the refresher are disposed in the same space, thereby performing washing, drying, and refreshing in the same space.

According to at least one of the embodiments of the present disclosure, there is provided a laundry treating apparatus, in which laundry may be treated in the same space regardless of the type of laundry.

According to at least one of the embodiments of the present disclosure, there is provided a laundry treating apparatus, in which when washing, drying, and refreshing are performed, a user's load (e.g., amount of work, workflow, etc.) for moving the laundry may be reduced.

According to at least one of the embodiments of the present disclosure, there is provided a laundry treating apparatus capable of treating laundry, which may not be subjected to high temperature drying, in the same space where washing and drying are performed.

According to at least one of the embodiments of the present disclosure, there is provided a laundry treating apparatus, in which the washing machine and the refresher share one surface, thereby reducing vibrations generated in the washing machine.

According to at least one of the embodiments of the present disclosure, a hot air passage is provided in a rear space of the refresher, such that the entire system may have a uniform longitudinal width.

According to at least one of the embodiments of the present disclosure, hot air may be supplied to each of the washing machine, the dryer, and the refresher by using a single heating device.

According to at least one of the embodiments of the present disclosure, steam may be supplied to each of the washing machine, the dryer, and the refresher by using a single steam generator.

According to at least one of the embodiments of the present disclosure, condensate may be managed easily by discharging condensate, generated in an evaporator, through a drain pump of the washing machine.

According to at least one of the embodiments of the present disclosure, steam may be generated easily by supplying water, required for generating steam, through a water supply pipe of the washing machine.

According to at least one of the embodiments of the present disclosure, the heating device for supplying hot air to the refresher may be disposed on a lateral side, thereby increasing the height of an inner space of the refresher.

According to at least one of the embodiments of the present disclosure, hot air may be supplied to the refresher by using the heating device of the dryer, thereby increasing a volume of the inner space of the refresher.

According to at least one of the embodiments of the present disclosure, a supply air duct, connecting the heating device and the refresher, is reduced in length, thereby minimizing heat loss of the hot air supplied to the refresher.

According to at least one of the embodiments of the present disclosure, condensate generated in the evaporator may be discharged through the drain pump of the washing machine, thereby allowing easy management of the condensate.

According to at least one of the embodiments of the present disclosure, water in a tub and the condensate generated in the heating device are discharged through a single drain pump, thereby reducing the number of components required for drainage.

According to at least one of the embodiments of the present disclosure, a cabinet of the washing machine is coupled to a cabinet of the refresher, thereby reducing vibrations generated in the washing machine.

According to at least one of the embodiments of the present disclosure, the heating device is disposed over the washing machine and the dryer, such that hot air may be easily supplied to the upper side of the refresher.

According to at least one of the embodiments of the present disclosure, the heating device is disposed over the dryer and the washing machine, the height of doors of the dryer and the washing machine may be lowered.

According to at least one of the embodiments of the present disclosure, as the washing machine is disposed over the dryer, heavy laundry after washing may be dropped to a laundry loading opening of the dryer, thereby allowing a user to easily move the laundry.

According to at least one of the embodiments of the present disclosure, a dehumidification duct is disposed over the dryer and the washing machine, it is possible to prevent high temperature dry air, discharge through the dehumidification duct, from being directly discharged to a user.

According to at least one of the embodiments of the present disclosure, an upper end of the laundry treating apparatus is aligned, such that the plurality of laundry treating machines may be easily coupled to each other.

The effects of the present disclosure are not limited to the aforesaid, and other effects not described herein will be clearly understood by those skilled in the art from the following description of the appended claims.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

FIG. 1 is a perspective view of a laundry treating apparatus according to at least one embodiment of the present disclosure.

FIG. 2 is a longitudinal cross-sectional view of a laundry treating apparatus according to at least one embodiment of the present disclosure.

FIG. 3 is a longitudinal cross-sectional view of a laundry treating apparatus according to at least one embodiment of the present disclosure.

FIG. 4 is a conceptual diagram illustrating a duct system of a laundry treating apparatus according to at least one embodiment of the present disclosure.

FIG. 5 is a perspective view of a heating device according to at least one embodiment of the present disclosure.

FIG. 6 is another perspective view of a heating device according to at least one embodiment of the present disclosure.

FIG. 7 is yet another perspective view of a heating device according to at least one embodiment of the present disclosure.

FIG. 8 is a diagram explaining an operation of a heating device according to at least one embodiment of the present disclosure.

FIG. 9 is a rear perspective view of a laundry treating apparatus according to at least one embodiment of the present disclosure.

FIG. 10 is a perspective view of a laundry treating apparatus according to at least one embodiment of the present disclosure.

FIG. 11 is a rear perspective view of a laundry treating apparatus according to at least one embodiment of the present disclosure.

FIG. 12 is a perspective view of a laundry treating apparatus according to at least one embodiment of the present disclosure.

FIG. 13 is a longitudinal cross-sectional view of a laundry treating apparatus according to at least one embodiment of the present disclosure.

FIG. 14 is a conceptual diagram illustrating a duct system of a laundry treating apparatus according to at least one embodiment of the present disclosure.

FIG. 15 is a rear perspective view of a laundry treating apparatus according to at least one embodiment of the present disclosure.

FIG. 16 is a perspective view of a laundry treating apparatus according to at least one embodiment of the present disclosure.

FIG. 17 is a rear perspective view of a laundry treating apparatus according to at least one embodiment of the present disclosure.

DETAILED DESCRIPTION OF THE PREFERRED EMBODIMENTS

Hereinafter, the present disclosure will be described in detail with reference to the accompanying drawings, in which the same reference numerals are used throughout the drawings to designate the same or similar components, and a redundant description thereof will be omitted.

Terms "module" and "unit" for elements used in the following description are given simply in view of the ease of the description, and do not have a distinguishing meaning or role.

It will be noted that a detailed description of known arts will be omitted if it is determined that the detailed description of the known arts can obscure the embodiments of the invention. Further, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that, although the terms first, second, etc., may be used herein to describe various elements, these elements should not be limited by these terms. These terms are only used to distinguish one element from another.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, the singular forms are intended to include the plural forms as well, unless the context clearly indicates otherwise.

The laundry treating apparatus according to the embodiments of the present disclosure may include one or more laundry treating machines. The laundry treating machines refer to devices for washing, drying, and/or refreshing objects (e.g., clothes, towels, blankets, etc.).

The laundry treating apparatus may include a plurality of laundry treating machines of the same type. For example, the laundry treating apparatus may include two or more dryers 1. For example, the laundry treating apparatus may include two or more washing machines 2. For example, the laundry treating apparatus may include two or more refreshers 3.

The laundry treating apparatus may include different types of laundry treating machines. For example, the laundry treating apparatus may include the dryer 1, the washing machine 2, and the refresher 3.

The laundry treating apparatus may include laundry treating machines of the same type and laundry treating machines of types different from the type. For example, the laundry treating apparatus may include two or more washing machines, one dryer, and one refresher. For example, the laundry treating apparatus may include one washing machine, one dryer, and two or more refreshers.

The laundry treating apparatus of the present disclosure is not limited to the type and number of the laundry treating machines, and may include various combinations thereof. Hereinafter, the laundry treating apparatus including one dryer 1, one washing machine 2, and one refresher 3 will be described as an example, but the present disclosure is not limited thereto.

The dryer 1, the washing machine 2, and the refresher 3 may be referred to as any one of first to third laundry treating machines, respectively. For example, the dryer 1 may be referred to as the "first laundry treating machine," the washing machine 2 may be referred to as the "second laundry treating machine," and the refresher 3 may be referred to as the "third laundry treating machine."

Hereinafter, it will be understood that, although the terms first, second, third, etc., may be used herein to describe various elements, these elements should not be limited by these terms. These terms are only used to distinguish one element from another. These elements are not limited to the terms and may include other ordinal numbers. The elements may be used independently without including the ordinal numbers. For example, the elements of the dryer 1 may include the ordinal number "first," the elements of the washing machine 2 may include the ordinal number "second," and the elements of the refresher 3 may include the ordinal number "third." However, the elements of the dryer 1, the washing machine 2, and the refresher 3 are not limited to these terms, and may include other ordinal numbers or may be used independently without including the ordinal numbers.

A laundry treating apparatus may include a controller 81 for controlling operation of a dryer 1, a washing machine 2, a refresher 3, and a heating device 50. The controller 81 may be mounted in a Printed Circuit Board (PCB). The controller 81 may control the dryer 1, the washing machine 2, the refresher 3, and the heating device 50 based on an electric signal received from the control panel 8. The controller 81 may communicate with the control panel 8.

The dryer 1 and the washing machine 2 may be vertically disposed. The control panel 8 may be disposed between the dryer 1 and the washing machine 2. The control panel 8 and the refresher 3 may be vertically disposed.

A user may input a command to the laundry treating apparatus through the control panel 8. By manipulating the control panel 8, the user may control the operation of the dryer 1, the washing machine 2, and the refresher 3. By manipulating the control panel 8, the user may control the operation of the heating device 50. The control panel 8 may transmit an electrical signal, input by the user's manipulation, to the controller 81.

A space for providing the PCB may be formed in the control panel 8. A controller may be mounted in the PCB. The controller may be the controller 81.

Alternatively, the controller may be disposed on a rear surface of the control panel 8. The space for providing the PCB may be formed on the rear surface of the control panel 8. The controller 81 may be mounted in the PCB.

Alternatively, at least some of the dryer 1, the washing machine 2, the refresher 3, and a machine room S may include respective controllers for controlling each operation thereof. Even in this case, the respective controllers may be mounted in the PCB. The respective controllers may communicate with each other. In some cases, at least one controller may be an upper level controller that may control other controllers and devices.

The control panel 8 may display an operating state of the laundry treating apparatus. The user may check information on the operating state of the laundry treating apparatus through the control panel 8.

The laundry treating apparatus may include a heating device 50. The heating device 50 may supply hot air to the dryer 1. The heating device 50 may supply hot air to the refresher 3. The heating device 50 may supply hot air to the washing machine 2. The hot air, supplied to the respective laundry treating machines, may be drawn into the heating device 50 again for circulation.

However, without circulating the hot air supplied to each of the dryer 1, the washing machine 2, and the refresher 3, the laundry treating apparatus may discharge the hot air to the outside. That is, the laundry treating apparatus may discharge the hot air supplied to a tub 23 of the washing machine 2 to the outside of the washing machine 2, may discharge the hot air supplied to a first drum 13 of the dryer 1 to the outside of the dryer 1, and may discharge the hot air supplied to an inner space 33 of the refresher 3 to the outside of the refresher 3.

The laundry treating apparatus may include the machine room S (see FIG. 2). The machine room S may provide a space in which the heating device 50 is disposed. The machine room S may be a concept that refers to a space in which the heating device 50 and components other than the heating device 50 are disposed. In addition to the heating device 50, a pump, a blower fan, an air passage, a steam device, a stream passage, a dehumidification device, a controller, a motor, a fan housing, and the like may be disposed in the machine room S. The machine room S may provide the space in which the aforementioned movable elements (a pump, a blower fan, an air passage, a steam device, a stream passage, a dehumidification device, a controller, a motor, and a fan housing) are disposed.

In the present disclosure, the machine room S may refer to the space in which the heating device 50 is disposed, or may be an upper concept that encompasses the heating device 50.

The machine room S may include a separate case. When the machine room S includes the separate case, the machine room S may be separated from a first cabinet 10 and a second cabinet 20. Unlike the example, the machine room S may be disposed in any one of first to third cabinets 10, 20, and 30. In the case where the machine room S is disposed in any one of the first to third cabinets 10, 20, and 30, the machine room S may be a concept that refers to a space in which various components including the heating device 50 are disposed. That is, in the case where the machine room S is disposed in any one of the first to third cabinets 10, 20, and 30, the machine room S may refer to a portion of the inner space of the first to third cabinets 10, 20, and 30.

The machine room S, the dryer 1, and the washing machine 2 may be vertically disposed. The machine room S may be disposed on an upper side of the dryer 1 and the washing machine 2. The machine room S may be disposed between the dryer 1 and the washing machine 2. The machine room S may be disposed on a lower side of the dryer 1 and the washing machine 2. Unlike the example, the machine room S and the refresher 3 may be vertically disposed. The machine room S may be disposed on the upper side or the lower side of the refresher 3.

The heating device 50 may supply hot air to the dryer 1. The heating device 50 may recover the hot air supplied to the dryer 1.

The heating device 50 may supply hot air to the washing machine 2. The heating device 50 may recover the hot air supplied to the washing machine 2.

The heating device 50 may supply hot air to the refresher 3. The heating device 50 may recover the hot air supplied to the refresher 3.

The heating device 50 may supply steam to the dryer 1. The heating device 50 may supply steam to the washing machine 2. The heating device 50 may supply steam to the refresher 3.

The heating device 50 may include a heat pump device. The heat pump device may include a compressor 51, a condenser 52, an evaporator 53, and an expansion device 54 (see FIG. 5). The heating device 50 may include a fan 60 (see FIG. 5). The heat pump device may be referred to as a "heat exchange unit."

The heating device 50 may include a heat exchange unit for heating air flowing through a heat exchange channel 42 (see FIG. 5). The heat exchange unit may be a heat pump device connected by a refrigerant passage. The heat exchange unit may be a heater using electricity as power. The heat exchange unit may be a heating device. The heat exchange unit may include the heater and a cooler. The cooler may be disposed on an upstream side of the heater. The cooler may be disposed in the heat exchange channel 42. The cooler may dehumidify and cool air passing through the heat exchange channel 42.

The heating device 50, the dryer 1, and the washing machine 2 may be vertically disposed. The heating device 50 may be disposed on the upper side of the dryer 1 and the washing machine 2, may be disposed between the dryer 1 and the washing machine 2, or may be disposed under the dryer 1 and the washing machine 2.

The heating device 50 and the refresher 3 may be vertically disposed. The heating device 50 may be disposed in a rear space of the refresher 3.

The heating device 50 may be disposed in the first cabinet 10. The heating device 50 may also be disposed in the second cabinet 20. The heating device 50 may also be disposed in the third cabinet 30.

The dryer 1, the washing machine 2, and the heating device 50 (or the machine room S) may be vertically arranged, and the refresher 3 may be disposed on a lateral side of the washing machine 2. The heating device 50 may be disposed on a lateral side of the refresher 3.

Hereinafter, a laundry treating apparatus A according to an aspect of the present disclosure will be described below with reference to FIG. 1.

The laundry treating apparatus A illustrated in FIG. 1 may be an example in which the dryer 1 is disposed over the washing machine 2, and the heating device 50 is disposed over the washing machine 2 and the dryer 1. However, a vertical arrangement of the dryer 1, the washing machine 2, and the heating device 50 is not limited thereto.

The refresher 3 may be disposed on a lateral side of the dryer 1 and the washing machine 2. For example, the refresher 3 may be disposed on the right side of the dryer 1 and the washing machine 2. However, an arrangement position of the refresher 3 is not limited to the above example, and the refresher 3 may be disposed on the right side of the dryer 1 and the washing machine 2.

A longitudinal width of the refresher 3 may be smaller than a front-rear width of the dryer 1 and the washing machine 2.

A rear case 310, in which the hot air passage or the steam passage which will be described later is disposed, may be disposed behind the refresher 3.

The dryer 1 may include the first cabinet 10 having a first laundry loading opening 12 (see FIG. 2) formed on a front surface thereof, and a first door 11 rotatably coupled to the first cabinet 10.

By rotating the first door 1, a user may open the first laundry inlet 12, and may put the laundry into the first drum 13 through the first laundry inlet 12.

The washing machine 2 may include a second cabinet 20 having a second laundry loading opening 22 (see FIG. 2) formed on a front surface, and a second door 21 rotatably coupled to the second cabinet 20.

By rotating the second door 21, the user may open the second laundry loading opening 22, and may load the laundry into the second drum 24 through the second laundry loading opening 22.

The refresher 3 forms a space in which the laundry is received, and includes a third cabinet 30 having a third laundry loading opening 32 (see FIG. 3) and a third door 31 rotatably coupled to the cabinet 30. The third laundry loading opening 32 may be referred to as an "opening."

By rotating the third door 31, the user may open the third laundry loading opening 32 and may load the laundry into the third cabinet 30 through the third laundry loading opening 32.

Each of the first cabinet 10, the second cabinet 20, and the third cabinet 30 may include an upper panel, a lower panel, a front panel, a rear panel, and a side panel. The upper panel may be referred to as an "upper wall." The lower panel may be referred to as a "lower wall." The front panel may be referred to as a "front wall." The rear panel may be referred to as a "rear wall." The side panel may be referred to as a "side wall."

Each of the first cabinet 10, the second cabinet 20, and the third cabinet 30 may include a pair of side panels. The pair of side panels may be horizontally spaced apart from each other. The side panels may be referred to as "side walls." The first cabinet 10 may include a first inner wall 106 facing the refresher 3, and a first outer wall 105 spaced apart from the first inner wall 106. The second cabinet 20 may include a second inner wall 206 facing the refresher 3, and a second outer wall 205 spaced apart from the second inner wall 206. The third cabinet 30 may include a third inner wall 306 facing the dryer 1 and the washing machine 2, and a third outer wall 305 spaced apart from the third inner wall 306.

The first cabinet 10 may include a first upper panel 103, a first lower panel 104, a first front panel 101, a first rear panel 102, and first side panels 105 and 106.

The second cabinet 20 may include a second upper panel 203, a second lower panel 204, a second front panel 201, a second rear panel 202, and second side panels 205 and 206 (i.e., second outer wall and second inner wall, respectively).

The third cabinet 30 may include a third upper panel 303, a third lower panel 304, a third front panel 301, a third rear panel 302, and third side panels 305 and 306. The third cabinet 30 may include the third door 31 instead of the third front panel 301.

The above description of the first to third cabinets 10, 20, and 30 may also be applied to the laundry treating apparatus described with reference to FIGS. 1 to 17.

A plate (or plate assembly) 90 (see FIG. 10) may be disposed in a space between the dryer 1 and the refresher 3 and in a space between the washing machine 2 and the refresher 3. The plate 90 may include a damping material. The dryer 1, the washing machine 2, and the refresher 3 may be coupled to each other by the plate 90.

The first upper panel 103 of the dryer 1 and the third upper panel 303 of the refresher 3 may be disposed on the same horizontal plane. The third upper panel 303 of the refresher 3 and the upper wall 313 of the rear case 310 may be disposed on the same horizontal plane.

An upper surface of the dryer 1 and an upper surface of the refresher 3 may be aligned horizontally. The upper surface of the dryer 1 and the upper surface of the refresher 3 may be disposed on the same plane.

A front surface 10*a* of the dryer 1 may be aligned with a front surface 20*a* of the washing machine 2. The front surface 10*a* of the dryer 1 and the front surface 20*a* of the washing machine 2 may be disposed on the same plane.

The front surface 10*a* of the dryer 1 and a front surface 31*a* of the refresher 3 may be aligned horizontally. The front surface 20*a* of the washing machine 2 and the front surface 31*a* of the refresher 3 may be aligned horizontally. The respective front surfaces of the dryer 1, the washing machine 2, and the refresher 3 may be disposed on the same plane.

An upper end 91 of the dryer 1 may be aligned with an upper end 307 of the refresher 3. The upper end 91 of the dryer 1 may be disposed on the same plane as the upper end 307 of the refresher 3.

The laundry treating apparatus A may include a tower 9 including the dryer 1 and the washing machine 2. The tower 9 may include the heating device 50.

The tower 9 may be an assembly in which the dryer 1 and the washing machine 2 are arranged vertically. In the case where the heating device 50 is disposed on one side of the refresher 3, the tower 9 may be an assembly in which the dryer 1, the washing machine 2, and the heating device 50 are arranged vertically.

The dryer 1, the washing machine 2, and the heating device 50 may be vertically arranged, so as to form the tower 9. An arrangement order of the dryer 1, the washing machine 2, and the heating device 50 in the tower 9 may not be limited to FIG. 1. For example, the washing machine 2 may be disposed over the dryer 1.

The tower 9 may be disposed on a lateral side of the refresher 3.

A front surface of the tower 9 may be aligned with the front surface 31*a* of the refresher 3. The front surface of the tower 9 may be disposed on the same plane as the front surface 31*a* of the refresher 3.

An upper end 91 of the front surface of the tower 9 may be aligned with the upper end 307 of the front surface 31*a* of the refresher 3. The upper end 91 of the front surface of the tower 9 may be on the same horizontal plane as the upper end 307 of the front surface 31*a* of the refresher 3. The upper end 91 of the front surface of the tower 9 may be the upper end of the dryer 1.

However, in the case where the washing machine 2 is disposed over the dryer 1, the upper end 91 of the front surface of the tower 9 may refer to the upper end of the front surface of the washing machine 2. Further, in the case where the heating device 50 is disposed on the upper side of the dryer 1 and the washing machine 2, the upper end 91 of the front surface of the tower 9 may refer to the upper end of the front surface of the heating device 50.

A third side panel 305 of the refresher 3 and a side wall 315 of the rear case 310 may be disposed on the same plane.

The front panel 101 of the dryer 1, the front panel 201 of the washing machine 2, and the control panel 8 may be disposed on the same plane. The front surface 10*a* of the dryer 1, the front surface 20*a* of the washing machine 2, and the control panel 8 may be disposed on the same plane.

The third door 31 of the refresher 3 may be disposed on the same plane as the front panel 101 of the dryer 1, the front panel 201 of the washing machine 2, and the control panel 8. Alternatively, the third door 31 of the refresher 3 may also be disposed on the same plane as the first door 11 of the dryer 1 and the second door 21 of the washing machine 2.

The second lower panel 204 of the washing machine 2 may be disposed on the same horizontal plane as the third lower panel 304 of the refresher 3.

The heating device 50 may be disposed over the washing machine 2. The heating device 50 may be disposed at an upper portion of the heating device 50. The heating device 50 may be disposed in the first cabinet 10. However, the heating device 50 may be provided separately from the first cabinet 10 or may be disposed over the first cabinet 10.

Hereinafter, an internal structure of the dryer 1, the washing machine 2, and the heating device 50 will be described with reference to FIG. 2. FIG. 2 is a diagram illustrating an internal structure of the dryer 1, the washing machine 2, and the heating device 50 which are cut in a longitudinal direction.

The washing machine 2 includes the second cabinet 20, the second door 21 rotatably coupled to the second cabinet 20, the tub 23 disposed in the second cabinet 20, a second drum 24, which is rotatably disposed in the tub 23 and in which laundry is received, a motor 25 for transmitting power to the second drum 24, a drain pump 26 for discharging water, generated in the laundry treating apparatus A to the outside, a water supply valve 27 connected to an external water source, and a drawer 28 in which detergent is stored. The drawer 28 may be referred to as a "detergent box."

The washing machine 2 may include a suspension 231 connecting the tub 23 and the second cabinet 20. The suspension 231 may reduce vibrations generated in the tub 23.

The drain pump 26 may be connected to the tub 23 by a first pipe 261. The drain pump 26 may discharge water, introduced through the first pipe 261 and a drain pipe 532, to the outside of the laundry treating apparatus A through a second pipe 262. However, the drain pipe 532 may be directly connected to the second pipe 262, in which case condensate generated in the evaporator 53 may be discharged to the outside of the laundry treating apparatus A through the drain pipe 532 and the second pipe 262.

The water supply valve 27 may open and close water supply pipes 278 and 279 (see FIG. 9) connecting the external water source and the washing machine 2. The water supply valve 27 may control a flow rate of water flowing into the washing machine 2 from the external water source. The water supply valve 27 may be connected to a first water supply pipe 271. The first water supply pipe 271 may be connected to the drawer 28 in which the detergent is stored. The water flowing into the drawer 28 through the first water supply pipe 271 may flow into the tub 23 along with the detergent in the drawer 28 through a second water supply pipe 272.

The dryer 1 includes the first cabinet 10, the first door 11 rotatably coupled to the first cabinet 10, and the first drum 13 which is rotatably disposed in the first cabinet 10 and in which the laundry is received.

The dryer 1 may include a motor 133 for rotating the first drum 13. A pulley 134 may be fixed to a rotating shaft of the motor 133. A belt may connect the pully 134 with a circumferential surface of the drum 13, such that torque of the motor 133 may be transferred to the drum 13 via the pulley 134 and the belt.

The motor 133 may be disposed under the first drum 13. The motor 133 may be disposed in the first cabinet 10 and may be mounted on an upper side of the first lower panel 104.

The heating device 50 may be disposed in the first cabinet 10. The heating device 50 may be disposed at an upper portion of the first cabinet 10. The heating device 50 may be disposed above the first drum 13.

The machine room S may be a portion of the inner space of the first cabinet 10. The machine room S may refer to an upper space of the first cabinet 10. The heating space 50 may be disposed in the machine room S.

The laundry treating apparatus A may include a partition wall 108 disposed in the first cabinet 10. The heating device 50 may be disposed over the partition wall 108.

The partition wall 108 may separate a space, in which the first drum 13 is disposed, from the machine room S. The partition wall 108 may be disposed between the heating device 50 and the first drum 13.

The partition wall 108 may be integrally formed with the first cabinet 10 or may be separated from the first cabinet 10.

The heating device 50 may be disposed between the partition wall 108 and the first upper panel 103. The machine room S may be formed between the partition wall 108 and the first upper panel 103. However, in the laundry treating apparatus according to another embodiment of the present disclosure, the heating device 50 may be disposed on the upper side of the first cabinet 10, in which case the heating device 50 may also be disposed on the upper side of the first upper panel 103 or may include a separate case.

The heating device 50 includes: a condenser 52 for performing heat exchange between high-temperature refrigerant and air to heat the air; a fan 60 for blowing air heated by passing through the condenser 52; and an evaporator 53 for performing heat exchange between the air flowing into the heating device 50 and low-temperature refrigerant to cool and dehumidify the air. The condenser 52 and the evaporator 53 may be referred to as a "heat exchange unit."

The air heated by passing through the condenser 52 (hereinafter referred to as "hot air") may be blown by the fan 60, and may be supplied to at least one of the dryer 1, the washing machine 2, or the refresher 3.

The heating device 50 may be connected to the first drum 13 by a first supply air duct 43. The hot air generated by the heating device 50 may be blown by the fan 60 to be supplied into the first drum 13 through the first supply air duct 43. The first supply air duct 43 may extend downwardly from the heating device 50.

The heating device 50 may be connected to the tub 23 through a third supply air duct 48. The hot air generated by the heating device 50 may be blown by the fan 60 to be supplied into the tub 23 through the third supply air duct 48. The third supply air duct 48 may extend downwardly from the heating device 50.

The hot air generated by the heating device 50 may be blown by the fan 60 to be supplied to the outside of the laundry treating apparatus A through a dehumidification duct 46. The dehumidification duct 46 may be disposed between a base plate 575 to be described below and the partition wall 108. The air blown by the fan 60 may be supplied into an indoor space through the dehumidification duct 46. An opening member 463 may be disposed in front of the dehumidification duct 46. The opening member 463 may open and close the front side of the dehumidification duct 46. The opening member 463 may be rotatably coupled to the first cabinet 10.

The supply air ducts 43, 45, and 48 may be referred to as any one of first to third supply air ducts. For example, the supply air duct connected to the dryer 1 may be referred to as a first supply air duct 43; the supply air duct connected to the refresher 3 may be referred to as a second supply air duct 45, and the supply air duct connected to the washing machine 2 may be referred to as a third supply air duct 48. The supply air ducts 43, 45, and 48 may be referred to as "supply pipes." The respective first, second, and third supply air ducts 43, 45, and 48 may be referred to as any one of the "first to third supply pipes." For example, the first supply air duct 43 may be referred to as a first supply pipe; the second supply air duct 45 may be referred to as a second supply pipe; and the third supply air duct 48 may be referred to as a third supply pipe.

The air supplied to the dryer 1, the washing machine 2, or the refresher 3 may be recovered to the heating device 50.

The heating device 50 may be connected to the first drum 13 by a first exhaust air duct 41. The hot air flowing into the first drum 13 through the first supply air duct 43 may dry the laundry placed in the first drum 13, and then may return to the heating device 50 through the first exhaust air duct 41. The first exhaust air duct 41 may extend upwardly from the first drum 13.

The heating device 50 may be connected to the tub 23 by a third exhaust air duct 47. The hot air flowing into the tub 23 through the third supply air duct 48 may dry the laundry placed in the second drum 24, and then may return to the heating device 50 through the third exhaust air duct 41. The third exhaust air duct 47 may extend upwardly from the tub 23.

The exhaust air ducts 41, 44, and 47 may be referred to as any one of first to third exhaust air ducts. For example, the exhaust air duct connected to the dryer 1 may be referred to as a first exhaust air duct 41; the exhaust air duct connected to the refresher 3 may be referred to as a second exhaust air duct 44; and the exhaust air duct connected to the washing machine 2 may be referred to as a third exhaust air duct 47. The respective first, second, and third exhaust air ducts 41, 44, and 47 may be referred to as any one of "first to third return lines." For example, the first exhaust air duct 41 may be referred to as a first return line, the second exhaust air duct 47 may be referred to as a second return line, and a third exhaust air duct 44 may be referred to as a third return line.

The hot air generated by the heating device 50 may be supplied to the dryer 1, the washing machine 2, and the refresher 3, to dry the laundry placed in the respective laundry treating machines 1, 2, and 3, and then may return to the heating device 50. That is, the hot air generated by the heating device 50 may circulate within the laundry treating apparatus A. The hot air, recovered to the heating device 50 after drying the laundry received in each of the plurality of laundry treating machines 1, 2, and 3, may contain a greater amount of moisture than the air drying the laundry placed in one laundry treating machine.

By performing heat exchange between the air returning to the heating device 50 and a refrigerant, the evaporator 53 may reduce the temperature of the returning air and removes moisture contained in the air. The air returning to the heating device 50 may be heat exchanged with the evaporator 53 to generate condensate.

The heating device 50 may include a drain pan 531 disposed on a lower side of the evaporator 53. The drain pan 531 may receive the condensate generated in the evaporator 53.

The drain pan 531 may be connected to the drain pump 26 by the drain pipe 532. The drain pipe 532 may extend downwardly from the drain pan 531 to be connected to the drain pump 26.

The water collected in the drain pan 531 may flow to the drain pump 26 through the drain pipe 532, and may be discharged to the outside of the laundry treating apparatus A by the drain pump 26.

Hereinafter, an internal structure of the refresher 3 will be described with reference to FIG. 3. FIG. 3 is a diagram illustrating an internal structure of the refresher 3 of the laundry treating apparatus A which is cut in a longitudinal direction.

The refresher 3 may include the third cabinet 30 forming a space in which the laundry is received.

The refresher 3 may include a hanger 36, on which clothes are hung, and an inner panel 34 defining a lower portion of a space 33 in which clothes are received. The inner panel 34 may be referred to as an "inner plate."

The inner panel 34 may be disposed below the tub 23. The inner panel 34 may be disposed below the second drum 24. However, in the case where the dryer 1 is disposed under the washing machine 2, the inner panel 34 may be disposed below the first drum 13. Accordingly, as the height of the position of the inner panel 34 is reduced, a volume of the inner space of the refresher 3 may increase.

The hanger 36 may be disposed between the third upper panel 303 and the third lower panel 304, and may be disposed closer to the third upper panel 303 than the third lower panel 304.

The hanger 36 may be disposed above the first drum 13. The hanger 36 may be disposed at a height corresponding to an upper portion of the first drum 13. However, in the case where the dryer 1 is disposed under the washing machine 2, the hanger 36 may be disposed above the tub 23 or may be disposed on an upper side of the second drum 24, and may be disposed at a height corresponding to the tub 23 or the upper portion of the second drum 24. Accordingly, as the height of the position of the hanger 36 increases, a volume of the inner space of the refresher 3 may increase.

The inner panel 34 may be disposed between the third upper panel 303 and the third lower panel 304, and may be disposed closer to the third lower panel 304 than the third upper panel 303.

Garments G received in the inner space 33 of the third cabinet 30 may be located between the hanger 36 and the inner panel 34.

The height H of the inner space 33 may refer to a height between the hanger 36 and the inner panel 34. The height H of the inner space 33 may refer to a vertical gap between the upper panel 303 and the inner panel 34. The height H of the inner space 33 may be extended compared to a case where the heating device 50 is disposed between the inner panel 34 and the third lower panel 304. Accordingly, unlike an existing refresher, the refresher 3 according to the present disclosure may receive garments G, such as a long coat or a suit, which occupy a great height in the vertical direction.

In addition, compared to the existing refresher, the refresher 3 according to the present disclosure may have a longitudinal width which may be extended according to the longitudinal width of the dryer 1 and the washing machine 2. Accordingly, the refresher 3 according to the present disclosure may receive a larger number of garments in the front-rear direction than the existing refresher. The longitudinal width W of the inner space 33 of the refresher 3 may refer to a width between the third door 31 and the third panel 302.

The longitudinal width W of the inner space 33 of the refresher 3 may be smaller than the longitudinal widths of the dryer 1 and the washing machine 2. The longitudinal width W of the third cabinet 30 may be smaller than the longitudinal widths of the dryer 1 and the washing machine 2.

In the laundry treating apparatus A according to an aspect of the present disclosure, the supply air duct 45 and the exhaust air duct 44 are disposed behind the space 33 in which the laundry is placed, such that the front surface 31*a* of the refresher 3 and the front surface of the dryer 1 and the washing machine 2 may be aligned.

A supply air hole 308 and an exhaust air hole 309 of the refresher 3 may be formed at an upper portion of the third cabinet 30.

The second supply air duct 45 may be connected to the upper portion of the third cabinet 30. The second supply air duct 45 may be referred to as a "supply air duct." The third cabinet 30 may be referred to as a "cabinet."

The supply air hole 308 connected to the supply air duct 45 may be disposed at the upper portion of the cabinet 30. The supply air hole 308 may be disposed above the hanger 36. The supply air hole 308 may be disposed below an inner surface 303*a* of the third upper panel 303. The supply air hole 308 may be disposed between the third upper panel 303 and the hanger 36.

The third upper panel 303 may include the inner surface 303*a* directed toward the inner space 33 of the cabinet 30, an outer surface 303*b* directed toward the outside of the cabinet 30, and an inclined surface 303*c* extending obliquely downwardly from the inner surface 303*a*. The inner surface 303*a* may be referred to as a "first surface." The inclined surface 303*c* may be referred to as a "second surface." The third upper panel 303 may be referred to as an "upper wall."

The first surface 303*a* may be separated from an upper side of the hanger 36. A space may be formed between the first surface 303*a* and the hanger 36.

The second surface 303*c* may extend obliquely downwardly from a rear end of the first surface 303*a*. The second surface 303*c* may extend rearwardly from the first surface 303*a*. The second surface 303*c* may be disposed above the hanger 36. The second surface 303*c* may have an inclination angle θ with respect to a horizontal direction.

The supply air hole 308 may be formed on the second surface 303*c*. The supply air hole 308 may be open obliquely downwardly on the second surface 303*c*.

The supply air hole 308 may be formed above the hanger 36. A first virtual line diagram H1 extending in a horizontal direction from the supply air hole 308 and a second virtual line diagram H2 extending in the horizontal direction from the hanger 36 are defined as follows. The first line diagram H1 may be disposed above the second line diagram H2. The first line diagram H1 and the second line diagram H2 may have a height difference D. The supply air hole 308 may be spaced apart from the hanger 36 by the height difference D.

The supply air duct 45 may be connected to the supply air hole 308. The supply air duct 45 may be coupled to the upper wall 303. The supply air duct 45 may be connected to the second surface 303*c*. The supply air duct 45 may pass through the third rear panel 302. The third rear panel 302 may be referred to as a "rear panel."

The rear panel 302 may have an inner surface 302*a* directed toward the inner space 33 of the cabinet 30 and an outer surface 302*b* directed toward the outside of the cabinet 30. The supply air hole 308 may be disposed in front of the inner surface 302*a* of the rear panel 302.

The supply air duct 45 may include a first hot air duct 451 connected to the heating device 50, and a second hot air duct 452 connecting the first hot air duct 451 and the supply air hole 308.

The first hot air duct 451 may extend upwardly. The second hot air duct 452 may be integrally formed with the first hot air duct 451. The second hot air duct 452 may extend upwardly and convexly. The second hot air duct 452 may extend upwardly and convexly from the first hot air duct 451, to be connected to the supply air hole 308.

The first hot air duct 451 may be disposed behind the rear panel 302. The first hot air duct 451 may extend upwardly from the rear side of the rear panel 302. The second hot air duct 452 may pass through the rear panel 302 to be connected to the supply air hole 308.

The second exhaust air duct 44 may be connected to the upper portion of the third cabinet 30. The second exhaust air duct 44 may be referred to as an "exhaust air duct." The third cabinet 30 may be referred to as a "cabinet."

The exhaust air hole 309 connected to the exhaust air duct 44 may be disposed at the upper portion of the cabinet 30.

The exhaust air hole 309 may be disposed below the supply air hole 308. The exhaust air hole 309 may be disposed below the hanger 36.

The exhaust air hole 309 may be open in the rear panel 302. The exhaust air hole 309 may be open from the inner surface 302*a* of the rear panel 302 to the outer surface 302*b* of the rear panel 320. The exhaust air hole 309 may refer to an open portion at the top of the rear panel 302.

The exhaust air duct 44 may be connected to the exhaust air hole 309. The exhaust air duct 44 may be coupled to the rear panel 302. The exhaust air duct 44 may be connected to the outer surface 302*b* of the rear panel 302. The exhaust air duct 44 may pass through the rear panel 302.

The filter 37 may be disposed in the exhaust air hole 309. The filter 37 may be disposed on the rear panel 302. The filter 37 may be disposed between the inner surface 302*a* and the outer surface 302*b* of the rear panel 302. The filter 37 may be disposed at the upper portion of the cabinet 30.

An inner panel 34 may be disposed at a lower portion of the cabinet 30. The inner panel 34 may include a first inner panel 341 having a dust hole 343 formed therein which is vertically open; and a second inner panel 342 disposed under the first inner panel 341.

The first inner panel 341 may be disposed at the lower portion of the inner space 33. The first inner panel 341 may extend obliquely downwardly in a forward direction. The dust hole 343 may be vertically open in the first inner panel 341. Dust in the inner space 33 may pass through the dust hole 343 to be accumulated on the top of the second inner panel 342.

The second inner panel 342 may extend horizontally from the lower side of the first inner panel 341. The second inner panel 342 may be withdrawn to the outside of the cabinet 30. By opening the door 31, a user may take the second inner panel 342 out of the cabinet 30.

The refresher 3 may include rollers 39 and legs 39*a* protruding downwardly from the third lower panel 304. A plurality of rollers 39 may be disposed which are spaced apart from each other in the front-rear direction. A roller structure of the refresher 3 may also be applied to the second lower panel 204 of the washing machine 2. The rollers of the washing machine 2 and the refresher 3 may serve to support the weight of the laundry treating apparatus A when the laundry treating apparatus A is moved.

Hereinafter, a duct system of the laundry treating apparatus A according to the present disclosure will be described with reference to FIG. 4. In FIG. 4, a left side of a reference line Y shows a duct system DS of the dryer 1 and the washing machine 2, and a right side of the reference line Y shows a duct system DS of the refresher 3. The left side of the reference line Y in FIG. 4 is view conceptually illustrating a duct system DS of the dryer 1 and the washing machine 2 which are cut by a plane perpendicular to a left and right direction; and the right side of the reference line Y in FIG. 4 is a view conceptually illustrating a rear surface of the refresher 3 to show a duct system DS. The directions used in the description of FIG. 4 may be the same as those illustrated in FIG. 1.

The left side of the reference line Y in FIG. 4 may be referred to as a first conceptual diagram S1. The right side of the reference line Y in FIG. 4 may be referred to as a second conceptual diagram S2.

The "duct system DS" may be a concept that collectively refers to passages of hot air circulating in the laundry treating apparatus A. The "duct system DS" may be a concept that collectively refers to passages connecting the heating device 50, the dryer 1, the washing machine 2, and the refresher 3. The "duct system DS" may be a concept that collectively refers to passages of hot air heated by the heating device 50.

The heating device 50 heats air and supplies the heated air to each of the dryer 1, the washing machine 2, and the refresher 3.

The duct system DS may include the heat exchange channel 42 in which the air is heated. The duct system DS may include the first supply air duct 43 connecting the heating device 50 and the dryer 1. The duct system DS may include the second supply air duct 45 connecting the heating device 50 and the refresher 3. The duct system DS may include the third supply air duct 48 connecting the heating device 50 and the washing machine 2. The duct system DS may include the dehumidification duct 46 connected to the heating device 50. The air heated by passing through the heat exchange channel 42 is blown by the fan 60 to be supplied to at least any one of the first supply air duct 43, the second supply air duct 45, the third supply air duct 48, and the dehumidification duct 46.

The duct system DS may include the first exhaust air duct 41 connecting the heating device 50 and the dryer 1. The duct system DS may include the second exhaust air duct 44 connecting the heating device 50 and the refresher 3. The duct system DS may include the third exhaust air duct 47 connecting the heating device 50 and the washing machine 2. The heated air supplied to the dryer 1 may flow into the heat exchange channel 42 through the first exhaust air duct 41. The heated air supplied to the refresher 3 may flow into the heat exchange channel 42 through the second exhaust air duct 44. The heated air supplied to the washing machine 2 may flow into the heat exchange channel 42 through the third exhaust air duct 47.

The heat exchange channel 42, through the air flows, may be provided in the heating device 50. The heating device 50 may include a heat exchange unit disposed in the heat exchange channel 42. The heat exchange unit may heat the air flowing in the heat exchange channel 42. The heat exchange unit may include the condenser 52 and the evaporator 53.

The laundry treating apparatus A may include the fan 60. The fan 60 may blow the air in the heat exchange channel 42. The fan 60 may be disposed on a downstream side of the condenser 52. The air heated by heat exchange with the evaporator 53 and the condenser 52 may be blown by the fan 60. The fan 60 may be disposed in the heat exchange channel 42.

The air blown by the fan 60 may be supplied to at least any one of the dryer 1, the washing machine 2, the refresher 3, and the dehumidification duct 46.

The laundry treating apparatus A may include a blowing duct 420 surrounding the fan 60. The duct system may include the blowing duct 420. The fan 60 may be disposed in the blowing duct 420.

An inner space of the blowing duct 420 may be a portion of the heat exchange channel 42.

The fan 60 and the blowing duct 420 may be disposed at a discharge end 42B of the heat exchange channel 42. The discharge end 42B may be disposed at a downstream side of the condenser 52 and the evaporator 53.

The blowing duct 420 may include a first discharge port 425 connected to the first supply air duct 43. The blowing duct 420 may include a second discharge port 427 connected to the second supply air duct 45. The blowing duct 420 may include a third discharge port 426 connected to the third supply air duct 48. The blowing duct 420 may include a fourth discharge port 428 connected to the dehumidification duct 46.

The first discharge port 425 may protrude downwardly from the blowing duct 420. The first supply air duct 43 may connect the first drum 13 and the first discharge port 425.

The second discharge port 427 may protrude from the blowing duct 420 to a lateral side. The second supply air duct 45 may connect the third cabinet 30 and the second discharge port 427.

The third discharge port 426 may protrude from the blowing duct 420 to a later side. The third supply air duct 48 may connect the tub 23 and the third discharge port 426.

The fourth discharge port 428 may protrude from the blowing duct 420 to the lateral side. The fourth discharge port 428 may protrude in a direction opposite to the second discharge port 427. The dehumidification duct 46 may be connected to the fourth discharge port 428.

A rotating body 71 of a switching device 70 (see FIG. 6) which will be described later may be disposed in the blowing duct 420. The rotating body 71 may be connected to a driving motor 711 to be rotated in the blowing duct 420. The air blown by the fan 60 may flow into at least any one of the first supply air duct 43, the second supply air duct 45, the third supply air duct 48, and the dehumidification duct 46 by the operation of the switching device 70.

The laundry treating apparatus A according to the present disclosure may also include a separate distribution device in addition to the switching device 70 which will be described later. The distribution device may distribute the air blown by the fan 60 to each of the dryer 1, the washing machine 2, the refresher 3, and the dehumidification duct 46. That is, the air blown by the fan 60 may be supplied at the same time to each of the dryer 1, the washing machine 2, the refresher 3, and the dehumidification duct 46. The distribution device may be disposed in the blowing duct 420 or may be disposed on a distribution passage connected to the blowing duct 420. The distribution device may be a valve. The distribution device may include an actuator and a switching damper. The laundry treating apparatus A may include both the switching device 70 and the distribution device at the same time, may include only the switching device 70, or may include only the distribution device.

The hot air flowing into the first drum 13 through the first supply air duct 43 may dry the laundry placed in the first drum 13, and then may flow into the heat exchange channel 42 through the first exhaust air duct 41. The first drum 13 may include a front cover 131 disposed on a front side, and a rear cover 132 disposed on a rear side. The first supply air duct 43 may be connected to the rear cover 132, and the first exhaust air duct 41 may be connected to the front cover 131.

The first exhaust air duct 41 may connect the first drum 13 and the heat exchange channel 42. The first exhaust air duct 41 may extend upwardly from the first drum 13 to be connected to the heat exchange channel 42.

A first inlet port 421 connected to the first exhaust air duct 41 may be formed at an inlet end 42A of the heat exchange channel 42. The first inlet port 421 may extend downwardly from the heat exchange channel 42. The first inlet port 421 may extend downwardly from the second exhaust air duct 44. The first inlet port 421 may extend downwardly from a first duct section 441.

The laundry treating apparatus A may include a first opening and closing valve 41*a* disposed in the first exhaust air duct 41. The first opening and closing valve 41*a* may control a flow rate of air in the first exhaust air duct 41. The first opening and closing valve 41*a* may block an air flow in the first exhaust air duct 41. The first opening and closing valve 41*a* may block the air flow in the first exhaust air duct 41 when the hot air is not supplied into the first drum 13 through the first exhaust air duct 43.

The hot air flowing into third cabinet 30 through the second supply air duct 45 may dry the laundry placed in the third cabinet 30, and then may flow into the heat exchange channel 42 through the second exhaust air duct 44. The second supply air duct 45 and the second exhaust air duct 44 may be connected to the third rear panel 302 of the third cabinet 30.

The second exhaust air duct 44 may connect the third cabinet 30 and the heat exchange channel 42. The second exhaust air duct 44 may extend to the lateral side from the upper portion of the third cabinet 30 to be connected to the heat exchange channel 42.

The second exhaust air duct 44 may include the first duct section 441 disposed between the heating device 50 and the first drum 13. The first duct section 441 may be disposed between a base plate 575 (see FIG. 6) to be described later and the partition wall 108. The first duct section 441 may extend forwardly and rearwardly in a separation space 55 (see FIG. 6) which will be described later.

A second inlet port 422 connected to the second exhaust air duct 44 may be formed at the inlet end 42A of the heat exchange channel 42. The second inlet port 422 may extend downwardly from the heat exchange channel 42. The second inlet port 422 may extend downwardly from the case 570 of the heating device 50.

The laundry treating apparatus A may include a second opening and closing valve 44*a* disposed in the second exhaust air duct 44. The second opening and closing valve 44*a* may control a flow rate of air in the second exhaust air duct 44. The second opening and closing valve 44*a* may block an air flow in the second exhaust air duct 44. The second opening and closing valve 44*a* may block the air flow in the second exhaust air duct 44 when the hot air is not supplied into the third cabinet 30 through the second exhaust air duct 44. The second opening and closing valve 44*a* may be disposed on an upstream side above a position where the third exhaust air duct 47 and the second exhaust air duct 44 join.

The hot air flowing into the tub 23 through the third supply air duct 48 may dry the laundry placed in the tub 23, and then may flow into the heat exchange channel 42 through the third exhaust air duct 47.

The third exhaust air duct 47 may connect the tub 23 and the heat exchange channel 42. The third exhaust air duct 47 may extend upwardly from an upper portion of the tub 23 to be connected to the heat exchange channel 42.

The third exhaust air duct 47 may extend to the lateral side from the upper portion of the tub 23 and may extend upwardly in the rear case 310.

The third exhaust air duct 47 may be connected to the second exhaust air duct 44. The third exhaust air duct 47 may join the second exhaust air duct 44 in the rear case 310. The air flowing in the third exhaust air duct 47 may join the air flowing in the second exhaust air duct 44.

A third inlet port 424 connected to the third exhaust air duct 47 may be formed at the second exhaust air duct 44. The third inlet port 424 may extend downwardly from the second exhaust air duct 44.

The third inlet port 424 may protrude downwardly from a lower surface of the second exhaust air duct 44. The third exhaust air duct 47 may connect the tub 23 and the third inlet port 424. The air in the third exhaust air duct 47 may join the air in the second exhaust air duct 44 to flow into the heat exchange channel 42.

The laundry treating apparatus A may include a third opening and closing valve 47*a* disposed in the third exhaust air duct 47. The third opening and closing valve 47*a* may control a flow rate of air in the third exhaust air duct 47. The third opening and closing valve 47*a* may block an air flow in the third exhaust air duct 47. The third opening and closing valve 47*a* may block the air flow in the third exhaust air duct 47 when the hot air is not supplied into the tub 23 through the third supply air duct 48.

The hot air flowing through the dehumidification duct 46 may be supplied to the outside of the laundry treating apparatus A through an outlet 462 that is opened forward. The hot air flowing through the dehumidification duct 46 may be supplied to an indoor space through the outlet 462.

The dehumidification duct may include a second duct section 461 disposed between the heating device 50 and the first drum 13. The second duct section 461 may be disposed between the base plate 575 (see FIG. 6) to be described later and the partition wall 108. The second duct section 461 may extend forwardly and rearwardly in the separation space 55 (see FIG. 6) which will be described later.

An outside air inlet port 423 connected to the heat exchange channel 42 may be formed at the inlet end 42A of the heat exchange channel 42. The outside air inlet port 423 may extend forwardly from the heat exchange channel 42. The outside air inlet port 423 may extend forwardly from the second exhaust air duct 44.

The outside air inlet port 423 may protrude forwardly from one side of the second exhaust air duct 44. The outside air inlet port 423 may allow the indoor space and the second exhaust air duct 44 to communicate with each other. The air in the outside air inlet port 423 may join the air in the second exhaust air duct 44 to flow into the heat exchange channel 42. The outside air inlet port 423 may have an outside air inlet 49 that is opened forward. The air drawn in through the outside air inlet 49 may join the air in the second exhaust air duct 44 to flow into the heat exchange channel 42.

The laundry treating apparatus A may include a fourth opening and closing valve 49*a* disposed at the outside air inlet port 423. The fourth opening and closing valve 49*a* may control a flow rate of air in the outside air inlet port 423. The fourth opening and closing valve 49*a* may block an air flow in the outside air inlet port 423. The fourth opening and closing valve 49*a* may block the air flow in the outside air inlet port 423 when the hot air is not supplied to the dehumidification duct 46.

Hereinafter, the heating device 50 will be described with reference to FIGS. 5 to 7. The description of the heating device 50, which will be described below with reference to FIGS. 5 to 7, may be applied commonly to all embodiments of the laundry treating apparatus described with reference to FIGS. 1 to 17. Even in this case, however, depending on relative arrangement positions of the laundry treating machines included in the laundry treating apparatus, a shape of the case 570, a shape of the blowing duct 420, a placement of a drum motor 133, an opening direction of the discharge ports 425, 426, 427, and 428, an opening direction of the inlet ports 421, 422, 423, and 424, and the like may vary.

Referring to FIG. 5, the heating device 50 may include the case 570, the compressor 51, the condenser 52, the evaporator 53, and the expansion device 54.

The compressor 51, the condenser 52, the evaporator 53, and the expansion device 54 may be connected by a refrigerant passage. The heat pump device may include the compressor 51, the condenser 52, the evaporator 53, and the expansion device 54.

The drain pan 531 may be disposed under the evaporator 53.

The case 570 may provide a space in which the compressor 51, the condenser 52, the fan 60, and the evaporator 53 are disposed. The compressor 51, the condenser 52, the fan 60, the evaporator 53, and the switching device 70 may be disposed in the case 570.

The case 570 may include a cover 573, a base plate 575 spaced apart from a lower side of the cover 573, a front wall 574 disposed in front of the condenser 53, a first side wall 571 disposed on one side of the condenser 53, and a second side wall 572 disposed on the other side of the condenser 53.

The condenser 52, the fan 60, and the evaporator 53 may be disposed on an upper side of the base plate 575.

The heat exchange channel 42 may be a space surrounded by the base plate 575, the front wall 574, the first side wall 571, and the second side wall 572. The cover 573 may not be provided, in which case an upper portion of the heat exchange channel 42 may be open. The heat exchange channel 42 may communicate with the fan 60 disposed at a rear side of the heating device 50. Air in the heat exchange channel 42 may be blown by the fan 60. The heat exchange channel 42 may be referred to as a "heating passage." The condenser 52 and the evaporator 53 may be disposed in the heat exchange channel 42. The heat exchange channel 42 may refer to a partially open space.

The heat exchange channel 42 may be a space surrounded by the cover 573, the base plate 575, the front wall 574, the first side wall 571, and the second side wall 572. The cover 573 may cover the upper portion of the heat exchange channel 42. The heat exchange channel 42 may refer to a space between the cover 573 and the base plate 575. The cover 573, the base plate 575, the front wall 574, the first side wall 571, and the second side wall 572 may form a "heating duct" surrounding the heat exchange channel 42. The heating duct may communicate with the fan 60, and air in the heating duct may be blown by the fan 60. The condenser 52 and the evaporator 53 may be disposed in the heating duct. The heat exchange channel 42 may refer to a duct shielded in all directions.

The heat exchange channel 42 may be formed in the heating device 50. The heat exchange channel 42 may be a portion of the inner space of the heating device 50.

The heating device 50 may be disposed in the machine room S. The controller 81 may control the operation of components disposed in the machine room S. The machine room S may have a space in which the PCB is disposed, and the controller 81 may be mounted in the PCB.

The heating device 50 may include a steam generator 502 for generating steam and a dehumidifier 504 for removing moisture from air flowing through the heat exchange channel 42.

The steam generator 502 may generate steam by heating water. The steam generator 502 may be disposed between the condenser 52 and the fan 60. The steam generated by the steam generator 502 may be pressurized by the fan 60 to be supplied to each of the dryer 1, the washing machine 2, and the refresher 3. The steam generated by the steam generator 502 may be supplied to each of the first drum 13, the second drum 24, and the inner space 33 of the refresher 3.

The dehumidifier 504 may dehumidify air under room temperature conditions (about 25 degrees Celsius). The dehumidifier 504 may dehumidify air by using desiccant cooling. The dehumidifier 504 may be filled with zeolite. The zeolite filled in the dehumidifier 504 may be replaced periodically.

The dehumidifier 504 may be disposed between the condenser 52 and the fan 60. The dehumidifier 504 may dehumidify the air flowing through the heat exchange channel 42 even when the compressor 51 is not in operation.

The switching device 70 may control the direction of air blown by the fan 60. The switching device 70 may be disposed in the machine room S.

Referring to FIG. 6, the switching device 70 may control the supply of hot air to the dryer 1, the washing machine 21, the refresher 3, or the dehumidification duct 46.

The switching device 70 may include the rotating body 71 rotatably mounted in the blowing duct 70. The switching device 70 may include the driving motor 711 that rotates the rotating body 71. The rotating body 71 may be rotated by the driving motor 711 in the blowing duct 420. The fan 60 may be disposed in the rotating body 71.

The driving motor 711 may rotate the rotating body 711. A driving gear 712 may be fixed to the rotating shaft of the driving motor 711. The driving gear 712 may be a pinion gear or a spur gear.

A driven gear 713 may be rotated in engagement with the driving gear 712. The driven gear 713 may be fixed to the rotating body 71 or may be integrally formed with the rotating body 71. The driven gear 713 may be a ring gear. The driven gear 713 may be a ring-shaped rack.

The driving gear 712 and the driven gear 713 may be geared with each other. By the rotation of the driving gear 712, the driven gear 713 may be moved in a circumferential direction with respect to the rotational axis of the fan 60. When the driven gear 713 is moved in a circumferential direction, the rotating body 71 having the driven gear 713 fixed thereto may also be moved in the circumferential direction with respect to the rotational axis of the fan 60.

The driving motor 712 may be disposed outside of the blowing duct 420. One surface (e.g., rear surface) of the blowing duct 420 that faces the rotating body 71 may have a cut-out portion 714. The cut-out portion 714 may be formed at a position corresponding to the driven gear 713. A portion of the driving gear 712 may be inserted into the cut-out portion 714. The driving gear 712 and the driven gear 713 may be geared with each other in the cut-out portion 714.

A rotating shaft of the driving motor 711 may be disposed side by side with the rear surface of the blowing duct 420. Accordingly, a volume occupied by the driving motor 711 and the driving gear 712 in the front-rear direction may be reduced.

The driving motor 711 may be a motor capable of controlling the position, angle, and direction of rotation. For example, the driving motor may be a Brushless Direct Current (BLDC) motor. Alternatively, the driving motor 711 may be a step motor. The driving motor 711 may be electrically connected to the control panel 8 and/or the controller 81. Rotation of the driving motor 711 may be controlled by an electrical signal transmitted from the control panel 8 and/or the controller 81 to the driving motor 711. The control panel 8 and/or the controller 81 may control a hot air supplying direction by controlling the rotation angle of the driving motor 711.

Meanwhile, the driving motor 711 may rotate the rotating body 71 by various known methods used by the motor for rotating the rotating body. For example, the driving motor 711 may rotate the rotating body 71 by using a belt-pulley method, or by using a plurality of gears that are geared with each other, or the rotating shaft of the motor may be rotated together with the rotating body.

The blowing duct 420 may be connected to the first supply air duct 43, the second supply air duct 45, the third supply air duct 48, and the dehumidification duct 46.

The blowing duct 420 may be connected to a motor mount 564, to which a fan motor rotating the fan 60 is fixed. The motor mount 64 may be disposed on a rear surface of the blowing duct 420. The driving motor 711, the driving gear 712, and the driven gear 713 may be disposed radially outwardly from the motor mount 64.

The blowing duct 420 may include the first discharge port 425, the second discharge port 427, the third discharge port 426, and the fourth discharge port 428.

The first supply air duct 43 may be connected to the first discharge port 425. The first supply air duct 43 may be inserted into the first discharge port 425. The first discharge port 425 may be disposed facing downward in the blowing duct 420. The first discharge port 425 may provide a supply air hole that is vertically open.

The second supply air duct 45 may be connected to the second discharge port 427. The second supply air duct 45 may be inserted into the second discharge port 427. The second discharge port 427 may be disposed facing toward the lateral side in the blowing duct 420. The second discharge port 427 may provide a supply air hole that is horizontally open.

The third supply air duct 48 may be connected to the third discharge port 426. The third supply air duct 48 may be inserted into the third discharge port 426. The third discharge port 426 may be disposed facing the lateral side in the blowing duct 420. The third discharge port 426 may provide a supply air hole that is horizontally open. The third discharge port 426 may be disposed over the second discharge port 427. The second discharge port 427 and the third discharge port 426 may be vertically spaced apart from each other.

The dehumidification duct 46 may be connected to the fourth discharge port 428. The dehumidification duct 46 may be inserted into the fourth discharge port 428. The fourth discharge port 428 may be disposed facing a direction opposite to the second discharge port 427. The fourth discharge port 428 may be disposed facing toward the lateral side in the blowing duct 420. The fourth discharge port 428 may provide a supply air hole that is horizontally open.

The heating device 50 may be connected to each of the first exhaust air duct 41, the second exhaust air duct 44, the third exhaust air duct 47, and the outside air inlet port 423. The first exhaust air duct 41, the third exhaust air duct 47, and the outside air inlet port 423 may be connected to the heating device 50 via the second exhaust air duct 44.

The heating device 50 may include the second inlet port 422 connected to the second exhaust air duct 44. The second inlet port 422 may extend downwardly. The second inlet port 422 may protrude from the case 570 of the heating device 50.

Air drawn into the heating device 50 through the first exhaust air duct 41, the second exhaust air duct 44, the third exhaust air duct 47, and the outside air inlet port 423 may pass through the heat exchange channel 42 and flow into the fan 60 by the suction force of the fan 60.

Referring to FIG. 7, the air flowing through the first exhaust air duct 41, the second exhaust air duct 44, the third exhaust air duct 47, and the outside air inlet port 423 may meet in the heat exchange channel 42 to flow into the fan 60.

The first inlet port 421 connected to the first exhaust air duct 41 may protrude downwardly from the second exhaust air duct 44. The air in the first exhaust air duct 41 may join the air in the second exhaust air duct 44 to flow into the heat exchange channel 42.

The outside air inlet port 423 communicating with the indoor space may protrude forward from the second exhaust air duct 44. The air flowing into the outside air inlet port 423 through the outside air inlet 49 may join the air in the second exhaust air duct 44 to flow into the heat exchange channel 42.

The air flowing into the heat exchange channel 42 through the second exhaust air duct 44 may flow to the fan 60.

The heating device 50 may include a first support plate 576 extending downwardly from the base plate 575, and a second support plate 577 extending downwardly from the base plate 575 and spaced apart from the first support plate 576.

A separation space 55 may be formed between the first support plate 576 and the second support plate 577.

The second exhaust air duct 44, the first supply air duct 43, and the dehumidification duct 46 may be disposed in the separation space 55. The second exhaust air duct 44, the first supply air duct 43, and the dehumidification duct 46 may be formed between the first support plate 576 and the second support plate 577. The second exhaust air duct 44, the first supply air duct 43, and the dehumidification duct 46 may be disposed under the base plate 575.

The dehumidification duct 46 may be disposed under the base plate 575 and may extend forwardly to discharge the air forwardly through a hot air outlet 462. When an opening member 463 (see FIG. 10) opens a front portion of the separation space 55, the air discharged through the hot air outlet 462 may be discharged forwardly from the laundry treating apparatus A.

A portion of the second exhaust air duct 44 disposed under the base plate 575 may be defined as the first duct section 441.

A portion of the dehumidification duct 46 disposed under the base plate 575 may be defined as the second duct section 461.

Hereinafter, a method of controlling a blowing direction of air by the switching device 70 will be described with reference to FIG. 8. In FIG. 8, (a) is a diagram illustrating an example of operation when air is supplied to the third supply air duct 48 by the operation of the switching device 70, and (b) is a diagram illustrating an example of operation when air is supplied to the third supply air duct 48 and the second supply air duct 45 at the same time by the operation of the switching device 70. The description of the switching device 70, which will be described with reference to FIG. 8, may be applied commonly to all embodiments of the laundry treating apparatus described with reference to FIGS. 1 to 17. Even in this case, however, an opening direction of the discharge ports 425, 426, 427, and 428, an arrangement and connection structure of the exhaust air ducts 41, 44, and 47, and the like may vary depending on the relative arrangement of the laundry treating machines included in the laundry treating apparatus.

The fan 60 may be a Sirocco fan. The fan 60 may rotate to blow air in a direction perpendicular to the rotating shaft 61. The fan 60 may blow air in a direction coming into contact with the rotation direction. The air blown by the fan 60 may be concentrated in a predetermined range of angles relative to the rotating shaft 61.

The fan 60 may include the rotating shaft 61 coupled to the fan motor and rotated thereby, a plurality of blades 62 spaced apart in a radially outward direction of the rotating shaft 61, and an outer body 63 coupled to the blades 62 and extending in a rotation direction of the fan 60. The outer body 63 may have an annular shape. The rotating shaft 61 and the blades 62 may be connected by the outer body 63. When the rotating shaft 61 rotates, the outer body 63 and the blades 62 may also be rotated together with the rotating shaft 61.

The rotating body 71 may include a rotating plate 71*a* having the driven gear 713, a scroll 71*b* coupled to the rotating plate 71*a*, and a shaft through hole 71*c* formed in the rotating plate 71*a*.

The rotating plate 71*a* may have a disk shape and may be disposed behind the fan 60. The driven gear 713 may be formed in an annular shape on one side surface of the rotating plate 71*a*. The driven gear 713 may be formed integrally with the rotating plate 71*a*. When the driven gear 713 is rotated in engagement with the driving gear 711, the rotating plate 71*a* may be rotated in the same direction as the rotation direction of the fan 60. The rotating plate 71*a* may have the shaft through hole 71*c*, through which the rotating shaft 61 passes. The rotating shaft 61 may pass through the shaft through hole 71*c* to be coupled to the fan motor.

The fan 60 may be disposed between the heat exchange channel 24 and the rotating plate 71*a*. That is, the rotating plate 71*a* may be disposed behind the heat exchange channel 42 and the fan 60. The rotating plate 71*a* may be disposed behind the fan 60 in the blowing duct 420.

The scroll 71*b* may be integrally formed with the rotating plate 71*a*. When the rotating plate 71*a* is rotated, the scroll 71*b* may also be rotated together. The scroll 71*b* may extend in the rotation direction of the fan 60. The scroll 71*b* may be disposed to surround the fan 60. The fan 60 may be disposed in the scroll 71*b*.

The scroll 71*b* may include a blowing channel 72. The blowing channel 72 may be a cut-out portion of an outer circumferential surface of the scroll 71*b*. The scroll 71*b* may cover the outside of the fan 60, and the blowing channel 72 may be an outer region of the fan 60 which is not covered by the scroll 71*b*. The air blown by the fan 60 may be discharged to the outside of the blowing duct 420 through the blowing channel 72.

When the scroll 71*b* is rotated by the rotation of the rotating plate 71*a*, the blowing channel 72 may be changed in position. That is, by the rotation of the scroll 71*b*, the position of the blowing channel 72 may be changed relative to the rotating shaft 61. By rotating the scroll 71*b* to change the position of the blowing channel 72, the driving motor 711 may control the direction of air discharged from the blowing duct 420.

A longitudinal section of the blowing duct 420 may have a square shape. Accordingly, by the rotation of the scroll 71*b*, interference between the scroll 71*b* and the blowing duct 420 may be avoided.

The blowing duct 420 may include a first wall 420*a* disposed on an upper side of the fan 60, a second wall 420*b* disposed on a lower side of the fan 60, a third wall 420*c* disposed on one side of the fan 60, and a fourth wall 420*d* disposed on the other side of the fan 60.

The first discharge port 425 may protrude upwardly from the first wall 420*a*. The second discharge port 427 may protrude toward the lateral side from the third wall 240*c*. The third discharge port 426 may protrude downwardly from the second wall 420*b*. The fourth discharge port 428 may protrude toward the lateral side from the fourth wall 420*d*.

Referring to (a) of FIG. 8, the driving motor 711 may rotate the rotating body 71 by a first angle, and when the rotating body 71 is rotated by the first angle, the air blown by the fan 60 may be supplied to the third supply air duct 48.

In this case, the blowing channel 72 may communicate with only an inner space of the third discharge port 426. Accordingly, the air blown by the fan 60 may be supplied to only the washing machine 2.

Referring to (b) of FIG. 8, the driving motor 711 may rotate the rotating body 71 by a second angle, and when the rotating body 71 is rotated by the second angle, the air blown by the fan 60 may be supplied to the third supply air duct 48 and the second supply air duct 45 at the same time. In this case, the blowing channel 72 may communicate with an inner space of the first discharge port 425 and an inner space of the second discharge port 427. Accordingly, the air blown by the fan 60 may be supplied to both the washing machine 2 and the refresher 3 at the same time. The blowing channel 72 may include a first blowing channel 72*a* communicating with the inner space of the third discharge port 426, and a second blowing channel 72*b* communicating with the inner space of the second discharge port 427. The air blown by the fan 60 may be supplied to the washing machine 2 through the first blowing channel 72*a*. The air blown by the fan 60 may be supplied to the refresher 3 through the second blowing channel 72*b*.

A user may control the switching device 70 by inputting a signal to the control panel 8. Once the signal is input to the control panel 8, the signal may be transmitted to the driving motor 711, to control a rotation angle of the driving motor 711. For example, when the user inputs, to the control panel 8, a signal for supplying hot air to washing machine 2, the driving motor 711 may rotate the rotating body 71 so that the blowing channel 72 may be moved to a position as illustrated in (a) of FIG. 8. For example, when the user inputs, to the control panel 8, a signal for supplying hot air to the washing machine 2 and the refresher 3 at the same time, the driving motor 711 may rotate the rotating body 71 so that the blowing channel 72 may be moved to a position as illustrated in (b) of FIG. 8.

Hereinafter, a structure for supplying hot air and steam by the heating device 50 to each of laundry treating machines 1, 2, and 3 will be described with reference to FIG. 9.

The heating device 50 may be disposed over the partition wall 108. The heating device 50 may be disposed in the first cabinet 10 of the dryer 1.

The switching device 70 may be disposed over the partition wall 108. The switching device 70 may be disposed in the first cabinet 10 of the dryer 1.

The blowing duct 420 may be connected to the first supply air duct 43, the second supply air duct 45, and the third supply air duct 48.

The first supply air duct 43 may extend downwardly from the blowing duct 420. The first supply air duct 43 may be connected to the first drum 13. The first supply air duct 43 may pass through the separation space 55 to penetrate the first rear panel 102. The first supply air duct 43 may pass through the first rear panel 102 to be connected to the first drum 13.

The second supply air duct 45 may extend from the blowing duct 420 to a lateral side. The second supply air duct 45 may be connected to the refresher 3.

The second supply air duct 45 may extend from the blowing duct 420 to the lateral side to pass through the first inner wall 106. The second supply air duct 45 may be bent upwardly in the rear case 310. The second supply air duct 45 may be connected to the upper portion of the refresher 3.

The third supply air duct 48 may extend from the blowing duct 420 to the lateral side. The third supply air duct 48 may be connected to the tub 23.

The third supply air duct 48 may include a first supply air portion 481 extending from the blowing duct 420 to the lateral side, a second supply air portion 482 extending downwardly from the first supply air portion 481, and a third supply air portion 483 extending from the second supply air portion 482 to the lateral side.

The first supply air portion 481 may be connected to the blowing duct 420 and may extend from the flowing duct 420 to the lateral side. The first supply air portion 481 may pass through the first inner wall 106 to extend into the rear case 310. The first supply air portion 481 may be disposed on the rear side of the third rear panel 302.

The second supply air portion 482 may extend downwardly from the end of the first supply air portion 481. The second supply air portion 482 may extend downwardly in the rear case 310. The second supply air portion 482 may face the first inner wall 106 and the second inner wall 206.

The third supply air portion 483 may extend from a lower end of the second supply air portion 482 to the lateral side. The third supply air portion 483 may extend in the rear case 310 to the lateral side, to pass through the second inner wall 206. The third supply air portion 483 may pass through the second inner wall 206 to be connected to the tub 23 in the second cabinet 20.

The third exhaust air duct 47 may join the second exhaust air duct 44. The third exhaust air duct 47 may extend upwardly to join the second exhaust air duct 44.

The third exhaust air duct 47 may include the first exhaust air portion 471 connected to the tub 23, and the second exhaust air portion 472 extending upwardly from the first exhaust air portion 471.

The first exhaust air portion 471 may be connected to the tub 23 and may pass through the second inner wall 206. The first exhaust air portion 471 may pass through the second inner wall 206 to extend to the lateral side in the rear case 310.

The second exhaust air portion 472 may extend upwardly from the end of the first exhaust air portion 471. The second exhaust air portion 472 may face the first inner wall 106 and the second inner wall 206.

The second exhaust air portion 472 may be connected to the second exhaust air duct 44. An upper end of the second exhaust air portion 472 may be connected to a lower portion of the second exhaust air duct 44. The second exhaust air duct 44 may include the third inlet port 424 protruding downwardly from the second exhaust air duct 44, and the second exhaust air portion 472 may be coupled to the third inlet port 424.

The second exhaust air duct 44 may be connected to the upper portion of the refresher 3. The second exhaust air duct 44 may extend to the lateral side in the rear case 310. The second exhaust air duct 44 may extend forwardly in the separation space 55, to be connected to the heat exchange channel 42.

The separation space 55 may be formed between the base plate 575 and the partition wall 208. The first duct section 441, the second duct section 461, and the first supply air duct 43 may be disposed in the separation space 55.

The steam generator 502 may be disposed in the heating device 50. The steam generated by the steam generator 502 may be sprayed into the first drum 13 through the first steam supply pipe 502*a*. The steam generated by the steam generator 502 may be sprayed into the inner space 33 of the refresher 3 through the second steam supply pipe 502*b*.

The first steam supply pipe 502*a* may extend downwardly from the steam generator 502 to be connected to the first drum 13.

The second steam supply pipe 502*b* may extend from the steam generator 502 to the lateral side to be connected to the refresher 3.

The steam generated by the steam generator 502 may flow to each of the first drum 13 and the inner space 33 of the refresher 3 by the blowing force of the fan 60. That is, by pressurizing the steam generated by the steam generator 502, the fan 60 may cause the steam to flow to the first drum 13 and the inner space 33 of the refresher 3.

A valve for controlling an amount of steam flow may be provided for each of the first steam supply pipe 502*a* and the second steam supply pipe 502*b*. By adjusting an opening degree of the valve, the controller 81 may adjust the amount of steam supplied to each of the first drum 13 and the inner space 33 of the refresher 3.

The laundry treating apparatus A may include a second steam generator 506 disposed in the washing machine 2. The laundry treating apparatus A may include a plurality of steam generators 502 and 506. The steam generator 502 disposed in the heating device 50 may be referred to as a "first steam generator," and the steam generator 506 disposed in the washing machine 2 may be referred to as a "second steam generator."

The laundry treating apparatus A may include a third steam supply pipe 506*a* connecting the second steam generator 506 and the tub 23, and a fourth steam supply pipe 506*b* extending from the second steam generator 506 toward the inner space 33 of the refresher 3.

The second steam generator 506 may be disposed in the second cabinet 20. The steam generated by the second steam generator 506 may be sprayed into the second drum 24 through the third steam supply pipe 506*a*. The steam generated by the second steam generator 506 may be sprayed into the inner space 33 of the refresher 3 through the fourth steam supply pipe 506*b*.

The fourth steam supply pipe 506*b* may extend from the second steam generator 506 in a lateral direction, to be connected to the refresher 3.

A valve for controlling an amount of steam flow may be provided for each of the third steam supply pipe 506*a* and the fourth steam supply pipe 506*b*. By adjusting an opening degree of the valve, the controller 81 may adjust the amount of steam supplied to each of the second drum 24 and the inner space 33 of the refresher 3.

The washing machine 2 may be connected to a cold water supply pipe 278 for supplying cold water to the tub 23, and a hot water supply pipe 279 for supplying hot water to the tub 23.

The steam generator 502 may be connected to the cold water supply pipe 278 or the hot water supply pipe 279. The steam generators 502 and 506 may be supplied with water through the cold water supply pipe 278 or the hot water supply pipe 279. The steam generators 502 and 506 may be supplied with water through a third water supply pipe branching off from the water supply pipes 278 and 279 connected to the tub 23.

The steam generators 502 and 506 may be supplied with hot water through the hot water supply pipe 279. The steam generators 502 and 506 may generate steam by heating the water supplied through the hot water supply pipe 279.

The rear case 310 may be fixed to the refresher 3 by a fastening member 316 passing through a fastening plate 317 extending in the front-rear direction. There may be a plurality of fastening plates 317 which are vertically spaced apart from each other. The fastening plates 317 may extend in the front-rear direction to be connected to respective side walls of the rear case 310 and the third cabinet 30. The fastening member 316 may pass through the respective side walls of the rear case 310 and the third cabinet 30 and the fastening plate 317.

The second supply air duct 45 and the second exhaust air duct 44 may be disposed in the rear case 310. The rear case 310 may be disposed at the rear side of the third cabinet 30. A rear surface of the rear case 310 may be horizontally aligned with rear surfaces of the dryer 1 and the washing machine 2.

Hereinafter, a coupling relationship among the cabinets 10, 20, and 30 will be described with reference to FIG. 10.

The second cabinet 20 may be disposed under the first cabinet 10. The second cabinet 20 may be disposed on a lateral side of the third cabinet 30.

The second upper panel 203 of the washing machine 2 may be coupled to the first lower panel 104 of the dryer 1. The first lower panel 104 may be disposed over the second upper panel 203. The first lower panel 104 and the second upper panel 203 may be coupled to each other by a separate fastening member. Further, a protrusion may be formed on any one of the first lower panel 104 and the second upper panel 203, and a recess may be formed in the other one, such that the first panel 104 and the second upper panel 203 may be coupled to each other by a coupling method in which the protrusion is inserted into the recess.

The dryer 1 may reduce vertical vibrations in the washing machine 2. The first cabinet 10, disposed over the second cabinet 20, is coupled to the second cabinet 20, thereby reducing vibrations in the second cabinet 20.

The laundry treating apparatus A may include rollers 29 protruding downwardly from the second cabinet 20. The rollers 29 may protrude downwardly from the second lower panel 204.

The rollers 29 protruding downwardly from the second cabinet 20 may be referred to as "first rollers." Rollers 38 protruding downwardly from the third cabinet 30 may be referred to as "second rollers." The first rollers 29 and the second rollers 38 may be horizontally spaced apart from each other.

The rollers 29 and 38 may support the weight of the laundry treating apparatus A, and at least some of the rollers 29 and 38 may be rotated when the laundry treating apparatus A is moved.

The laundry treating apparatus A may include legs 39*a* protruding downwardly from the third cabinet 30. The legs 39*a* may protrude downwardly from the third outer wall 305.

The legs 39*a* may support the weight of the laundry treating apparatus A. A plurality of legs 39*a* may be spaced apart from each other in the front-rear direction.

The legs 39*a* protruding downwardly from the third cabinet 30 may also be provided for the washing machine 2. That is, the washing machine 2 may include legs protruding downwardly from the second cabinet 20.

The legs of the washing machine 2 may have the same structure as the legs 38 of the refresher 3. The legs of the washing machine 2 may protrude downwardly from the second outer wall 205. A plurality of legs of the washing machine 2 may be spaced apart from each other in the front-rear direction.

The above rollers and legs may support the weight of the laundry treating apparatus A. Further, the rollers and legs may reduce the vibrations generated in the washing machine 2. The vibrations generated in the washing machine 2 may be absorbed into the ground by the rollers and the legs. The rollers and the legs may reduce rocking of the second cabinet 20.

The laundry treating apparatus A may include a plate 90 disposed between the second cabinet 20 and the third cabinet 30. The plate 90 may connect the second cabinet 20 and the third cabinet 30.

The plate 90 may include a first plate 96 disposed between the second inner wall 206 and the third inner wall 306, a second plate 97 connecting the second lower panel 204 and the third lower panel 304, and a grip 98 recessed upwardly from a lower surface of the second plate 92.

The first plate 96 may extend vertically between the second cabinet 20 and the third cabinet 30. The first plate 96 may come into contact with the second cabinet 20 and the third cabinet 30. The first plate 96 may be made of a material having high elasticity. The first plate 96 may include a damping material.

The first plate 96 may reduce vibrations generated in the washing machine 2. The first plate 96 may absorb vibrations generated in the washing machine 2. The first plate 96 may prevent the second cabinet 20 from rocking. Particularly, when the second drum 24 rotates at a high speed, vibrations generated in the second drum 24 may cause the second inner wall 206 to rock from side to side. The first plate 96, disposed between the second inner wall 206 and the third inner wall 306, may prevent noise caused when the second inner wall 206 rocks and collides with the third inner wall 306.

The second plate 97 may extend horizontally from the lower side of the second lower panel 204 and the third lower panel 304. The second plate 97 may be coupled to the second lower panel 204 and the third lower panel 304 by a fastening member 99 passing through the second plate 97.

The plate 90 and the third cabinet 30 may reduce the vibrations in the washing machine 2. The third cabinet 30 is disposed on a lateral side of the second cabinet 20 to attenuate horizontal vibrations generated in the washing machine 2. The plate 90 is disposed between the second cabinet 20 and the third cabinet 30, thereby amplifying the effect of reducing vibrations caused by the third cabinet 30. Particularly, the plate 90 may include a material having high elasticity or a damping material, thereby effectively reducing the vibrations generated in the washing machine 2. Further, the plate 90 may connect the second cabinet 20 and the third cabinet 30, thereby reducing vibrations generated in the second cabinet 20. The third cabinet 30 may support the second cabinet 20 on one side of the second cabinet 20.

The grip 98 may be recessed into the plate 90. The grip 98 may provide a space for a user to hold. The user may move the laundry treating apparatus A by holding the grip 98.

The opening member 463 may shield the front side of the separation space 55. The opening member 463 may be disposed at the front side of the dehumidification duct 46 and the outside air inlet port 423. The opening member 463 may shield the front side of the hot air outlet 462 and the outside air inlet 49.

The laundry treating apparatus E may include the hinge 463*a* connected to the opening member 463, and the motor 463*b* rotating the hinge 463*a*.

The hinge 463*a* may be rotatably coupled to the first front panel 101. The hinge 46*a* may extend in the left-right direction. The opening member 463 may be rotated in the front-rear direction with the hinge 463*a* serving as a rotational axis. The opening member 463 may be integrally formed with the hinge 463*a*. When the motor 463*b* rotates the hinge 463*a*, the opening member 463 may be rotated together with the hinge 463*a*. The opening member 463 may be rotated forward to open the front side of the separation space 55. Once the opening member 463 opens the front side of the separation space 55, outside air of the laundry treating apparatus A may flow into the heat exchange channel 42 through the outside air inlet port 423, and the air passing through the dehumidification duct 46 may be discharged to the outside of the laundry treating apparatus A.

The controller 81 may be electrically connected to the motor 463*b*. The controller 81 may control the operation of the motor 463*b*. The user may open the separation space 55 by manipulating the control panel 8.

The dehumidification duct 46 and the outside air inlet port 423 may be disposed above the first door 11 and the second door 21. As the dehumidification duct 46 and the outside air inlet port 423 are disposed at a higher position, it is possible to prevent high temperature and dry air, flowing through the dehumidification duct 46, from being directly exposed to the user. The dehumidification duct 46 and the outside air inlet port 423 may be disposed at a height corresponding to the upper portion of the refresher 3.

Hereinafter, a structure of a third supply air duct 480 of a laundry treating apparatus A' according to another embodiment of the present disclosure will be described with reference to FIG. 11.

A description of FIG. 11 regarding structures other than the supply air ducts 450 and 480 may be the same as the above description of FIGS. 1 to 10.

The third supply air duct 480 may branch off from the second supply air duct 450. Without being directly connected to the heating device 50, the third supply air duct 480 may branch off from the second supply air duct 450. When the third supply air duct 480 branches off from the second supply air duct 450, the third discharge port 426 may not be formed. The third supply air duct 480 may extend downwardly from the first hot air duct 451.

The second supply air duct 450 may extend from the blowing duct 420 to the lateral side. The second supply air duct 450 may extend horizontally at the rear side of the third rear panel 302.

The third supply air duct 480 may branch off from the second supply air duct 450 at the rear side of the third rear panel 302. The third supply air duct 480 may extend downwardly from the second supply air duct 450. The third supply air duct 480 may extend into the second cabinet 20 to be connected to the tub 23.

The laundry treating apparatus A' may include the control valve 453 disposed at a position where the third supply air duct 480 branches off from the second supply air duct 450.

The control valve 453 may control a flow direction of air flowing in the second supply air duct 450. The control valve 453 may control a flow direction of air flowing in the first hot air duct 451. The control valve 453 may open and close the second hot air duct 452 and the third supply air duct 480. The control valve 453 may open only either the second hot air duct 452 or the third supply air duct 480. The control valve 453 may open both the second hot air duct 452 and the third supply air duct 480. The control valve 453 may control an amount of air supplied to the second hot air duct 452 or the third supply air duct 480. The control valve 453 may distribute the air, blown by the fan 60 to the second supply air duct 450, to the second hot air duct 452 and the third supply air duct 480.

The controller 81 may control the control valve 453. By controlling the control valve 453, the controller 81 may supply the hot air, supplied to the second supply air duct 450, into the inner space 33 of the refresher 3. By controlling the control valve 453, the controller 81 may supply the hot air, supplied to the second supply air duct 450, into the second drum 24.

However, a structure of the supply air duct connected to the washing machine 2 and the refresher 3 may selectively employ the structure of the supply air duct described above with reference to FIG. 9 or FIG. 11. That is, the supply air duct connected to the washing machine 2 and the refresher 3 may be installed as illustrated in FIG. 9 or in FIG. 11.

The description of the dryer 1, the washing machine 2, the refresher 3, and the heating device 50, which are described above with reference to FIGS. 1 to 11, may also be applied to laundry treating apparatuses according to the embodiments of the present disclosure described with reference to FIGS. 12 to 17.

Further, the description of components illustrated in FIGS. 1 to 11 may also be applied to FIGS. 12 to 17, even when the corresponding components are not illustrated in the description of the laundry treating apparatuses with reference to FIGS. 12 to 17. For example, even when the rear case 310 is not illustrated in FIGS. 12 to 17, the description of the rear case 310 described with reference to FIGS. 1 to 11 may also be applied to the description of the rear case 310 given with reference to FIGS. 12 to 17.

Referring to FIG. 12, in the laundry treating apparatus B, the dryer 1 may be disposed under the washing machine 2, and the heating device 50 may be disposed over the dryer 1 and the washing machine 2. The heating device 50 may be disposed in the second cabinet 10 and may be disposed over the tub 23.

The heating device 50 may be provided separately from the washing machine 2. The heating device 50 may be disposed on the upper side of the second cabinet 20.

Referring to FIG. 13, the heating device 50 may be disposed over the tub 23. The heating device 50 may be disposed in the second cabinet 20, and may be disposed at the upper portion of the second cabinet 20.

The motor 133 may be disposed in the first cabinet 10. The motor 133 may be disposed at the lower portion of the first cabinet 10. The motor 133 may be mounted on the upper side of the first lower panel 104. The second exhaust air duct 41 may be disposed under the first drum 13 and may be horizontally spaced apart from the motor 133. The second exhaust air duct 41 and the motor 133 may be disposed side by side in the horizontal direction under the first drum 13.

The machine room S may be a portion of the inner space of the second cabinet 20. The machine room S may refer to an upper space of the second cabinet 20. The heating space 50 may be disposed in the machine room S.

The laundry treating apparatus B may include the partition wall 208 disposed in the second cabinet 20. The heating device 50 may be disposed over the partition wall 208.

The partition wall 208 may separate a space, in which the tub 23 is disposed, from the machine room S. The partition wall 208 may be disposed between the heating device 50 and the tub 23.

The partition wall 208 may be integrally formed with the second cabinet 20 or may be separated from the second cabinet 20.

The heating device 50 may be disposed between the partition wall 208 and the second upper panel 203. The machine room S may be formed between the partition wall 208 and the second upper panel 203. However, in the laundry treating apparatus according to another embodiment of the present disclosure, the heating device 50 may be disposed on the upper side of the second cabinet 20, in which case the heating device 50 may also be disposed on the upper side of the second upper panel 203 or may include a separate case.

Referring to FIG. 14, the laundry treating apparatus B may include a duct system DS connected to the dyer 1, the washing machine 2, and the refresher 3.

The blowing duct 420 may include the first discharge port 425 connected to the first supply air duct 43. The blowing duct 420 may include the second discharge port 427 connected to the second supply air duct 45. The blowing duct 420 may include the third discharge port 426 connected to the third supply air duct 48. The blowing duct 420 may include the fourth discharge port 428 connected to the dehumidification duct 46.

The first discharge port 425 may protrude from the blowing duct 420 to the lateral side. The first supply air duct 43 may connect the first drum 13 and the first discharge port 425.

The second discharge port 427 may protrude from the blowing duct 420 to the lateral side. The second supply air duct 45 may connect the supply air hole 308 and the second discharge port 427.

The third discharge port 426 may protrude downwardly from the blowing duct 420. The third supply air duct 48 may connect the tub 23 and the third discharge port 426.

The fourth discharge port 428 may protrude from the blowing duct 420 to the lateral side. The fourth discharge port 428 may protrude in a direction opposite to the second discharge port 427. The dehumidification duct 46 may be connected to the fourth discharge port 428.

The hot air flowing into the first drum 13 through the first supply air duct 43 may dry the laundry placed in the first drum 13, and then may flow into the heat exchange channel 42 through the first exhaust air duct 41. The first drum 13 may include the front cover 131 disposed on the front side, and the rear cover 132 disposed on the rear side. The first supply air duct 43 may be connected to the rear cover 132, and the first exhaust air duct 41 may be connected to the front cover 131.

The first exhaust air duct 41 may connect the first drum 13 and the heat exchange channel 42. The first exhaust air duct 41 may extend from the first drum 13 to be connected to the heat exchange channel 42.

The first exhaust air duct 41 may extend rearwardly under the first drum 13 and may extend upwardly in the rear case 310.

The first exhaust air duct 41 may be connected to the second exhaust air duct 44. The first exhaust air duct 41 may join the second exhaust air duct 44 in the rear case 310. The air flowing in the first exhaust air duct 41 may join the air flowing in the second exhaust air duct 44.

The first inlet port 421 connected to the first exhaust air duct 41 may be formed in the second exhaust air duct 44. The first inlet port 421 may extend downwardly from the second exhaust air duct 44.

The laundry treating apparatus B may include the first opening and closing valve 41*a* disposed in the first exhaust air duct 41. The first opening and closing valve 41*a* may control a flow rate of air in the first exhaust air duct 41. The first opening and closing valve 41*a* may block an air flow in the first exhaust air duct 41. The first opening and closing valve 41*a* may block the air flow in the first exhaust air duct 41 when the hot air is not supplied into the first drum 13 through the first supply air duct 43.

The hot air flowing into third cabinet 30 through the second supply air duct 45 may dry the laundry placed in the third cabinet 30, and then may flow into the heat exchange channel 42 through the second exhaust air duct 44. The second supply air duct 45 and the second exhaust air duct 44 may be connected to the third rear panel 302 of the third cabinet 30.

The second supply air duct 45 may be connected to the upper portion of the refresher 3. The second supply air duct 45 may be connected to the supply air hole 308 formed at the upper portion of the refresher 3.

The upper panel 303 of the third cabinet 30 may be inclined downwardly toward the rear side. The upper panel 303 of the third cabinet 30 may extend obliquely downwardly toward the third rear panel 302.

The supply air hole 308 may be formed at the inclined portion of the upper panel 303. The supply air hole 308 may be opened so as to be inclined downwardly toward the inner space 33 of the refresher 3. The air supply hole 308 may be opened so as to be inclined relative to the horizontal direction.

The second exhaust air duct 44 may connect the refresher 3 and the heat exchange channel 42. The second exhaust air duct 44 may extend from the upper portion of the third cabinet 30 to the lateral side to be connected to the heat exchange channel 42.

The second exhaust air duct 44 may include the first duct section 441 disposed between the heating device 50 and the tub 23. The first duct section 441 may be disposed between the base plate 575 and the partition wall 208. The first duct section 441 may extend forwardly and rearwardly in the separation space 55.

The second inlet port 422 connected to the second exhaust air duct 44 may be formed at the inlet end 42A of the heat exchange channel 42. The second inlet port 422 may extend downwardly from the heat exchange channel 42. The second inlet port 422 may extend downwardly from the case 570 of the heating device 50.

The laundry treating apparatus B may include the second opening and closing valve 44*a* disposed in the second exhaust air duct 44. The second opening and closing valve 44*a* may control a flow rate of air in the second exhaust air duct 44. The second opening and closing valve 44*a* may block an air flow in the second exhaust air duct 44. The second opening and closing valve 44*a* may block the air flow in the second exhaust air duct 44 when the hot air is not supplied into the third cabinet 30 through the second supply air duct 45. The second opening and closing valve 44*a* may be disposed on the upstream side of a position where the first exhaust air duct 41 and the second exhaust air duct 44 join each other.

The hot air flowing into the tub 23 through the third supply air duct 48 may dry the laundry placed in the tub 23, and then may flow into the heat exchange channel 42 through the third exhaust air duct 47.

The third exhaust air duct 47 may connect the tub 23 and the heat exchange channel 42. The third exhaust air duct 47 may extend upwardly from the upper portion of the tub 23 to be connected to the heat exchange channel 42.

The third inlet port 424 connected to the third exhaust air duct 47 may be formed at the inlet end 42A of the heat exchange channel 42. The third inlet port 424 may extend downwardly from the heat exchange channel 42. The third inlet port 424 may extend downwardly from the second exhaust air duct 44. The third inlet port 424 may extend downwardly from the first duct section 441.

The third inlet port 424 may protrude downwardly from the lower surface of the second exhaust air duct 44. The third exhaust air duct 47 may connect the tub 23 and the third inlet port 424. The third exhaust air duct 47 may connect the tub 23 and the second exhaust air duct 44. The air in the third exhaust air duct 47 may join the air in the second exhaust air duct 44 to flow into the heat exchange channel 42.

The laundry treating apparatus B may include the third opening and closing valve 47*a* disposed in the third exhaust air duct 47. The third opening and closing valve 47*a* may control a flow rate of air in the third exhaust air duct 47. The third opening and closing valve 47*a* may block an air flow in the third exhaust air duct 47. The third opening and closing valve 47*a* may block the air flow in the third exhaust air duct 47 when the hot air is not supplied into the tub 23 through the third supply air duct 48.

The hot air flowing through the dehumidification duct 46 may be supplied to the outside of the laundry treating apparatus B through the outlet 462 that is opened forward. The hot air flowing through the dehumidification duct 46 may be supplied to an indoor space through the outlet 462.

The dehumidification duct 46 may include the second duct section 461 disposed between the heating device 50 and the second cabinet 20. The second duct section 461 may be disposed between the base plate 575 and the partition wall 208. The second duct section 461 may extend forwardly and rearwardly in the separation space 55.

The outside air inlet port 423 may protrude forwardly from one side of the second exhaust air duct 44. The outside air inlet port 423 may allow the indoor space and the second exhaust air duct 44 to communicate with each other. The air in the outside air inlet port 423 may join the air in the second exhaust air duct 44 to flow into the heat exchange channel 42. The outside air inlet port 423 may have the outside air inlet 49 that is opened forward. The air drawn in through the outside air inlet 49 may join the air in the second exhaust air duct 44 to flow into the heat exchange channel 42.

Referring to FIG. 15, the heating device 50 may supply hot air to the dryer 1, the washing machine 2, and the refresher 3.

The heating device 50 may be disposed over the partition wall 208. The heating device 50 may be disposed in the second cabinet 20 of the washing machine 2.

The switching device 70 may be disposed over the partition wall 208. The switching device 70 may be disposed in the second cabinet 20 of the washing machine 2.

The first supply air duct 43 may extend from the blowing duct 420 to the lateral side. The first supply air duct 43 may be connected to the first drum 13.

The first supply air duct 43 may include the first supply air portion 431 extending from the blowing duct 420 to the lateral side, the second supply air portion 432 extending downwardly from the first supply air portion 431, and the third supply air portion 433 extending from the second supply air portion 432 to the lateral side.

The first supply air portion 431 may be connected to the blowing duct 420 and may extend from the blowing duct 420 to the lateral side. The first supply air portion 431 may extend into the rear case 310 by passing through the second inner wall 206. The first supply air portion 431 may be disposed at the rear side of the third rear panel 302.

The second supply air portion 482 may extend downwardly from the end of the first supply air portion 431. The second supply air portion 432 may extend downwardly in the rear case 310. The second supply air portion 432 may face the first inner wall 106 and the second inner wall 206.

The third supply air portion 433 may extend from a lower end of the second supply air portion 432 to the lateral side. The third supply air portion 433 may extend to the lateral side in the rear case 310, to pass through the first inner wall 106. The third supply air portion 433 may pass through the first inner wall 106 to be connected to the first drum 13 in the first cabinet 10.

The second supply air duct 45 may extend from the blowing duct to the lateral side. The second supply air duct 45 may be connected to the supply air hole 308.

The second supply air duct 45 may extend from the blowing duct 420 to the lateral side, to pass through the second inner wall 206. The second supply air duct 45 may be bent upwardly in the rear case 310. The second supply air duct 45 may be connected to the upper portion of the refresher 3.

The third supply air duct 48 may extend downwardly from the blowing duct 420. The third supply air duct 48 may pass through the separation space 55. By passing through the partition wall 208, the third supply air duct 48 may extend downwardly to be connected to the tub 23.

The first exhaust air duct 41 may join the second exhaust air duct 44. The first exhaust air duct 41 may extend upwardly to join the second exhaust air duct 44.

The first exhaust air duct 41 may include the first exhaust air portion 411 connected to the first drum 13, and the second exhaust air portion 412 extending upwardly from the first exhaust air portion 411.

The first exhaust air portion 411 may be connected to the first drum 13 and may pass through the first inner wall 106. The first exhaust air portion 411 may pass through the first inner wall 106 to extend to the lateral side in the rear case 310.

The second exhaust air portion 412 may extend upwardly from the end of the first exhaust air portion 411. The second exhaust air portion 412 may face the first inner wall 106 and the second inner wall 206.

The second exhaust air portion 412 may be connected to the second exhaust air duct 44. An upper end of the second exhaust air portion 412 may be connected to a lower portion of the second exhaust air duct 44. The second exhaust air duct 44 may include the first inlet port 421 protruding downwardly, and the second exhaust air portion 412 may be coupled to the first inlet port 421.

The second exhaust air duct 44 may be connected to the upper portion of the refresher 3. The second exhaust air duct 44 may extend to the lateral side in the rear case 310. The second exhaust air duct 44 may extend forwardly in the separation space 55, to be connected to the heat exchange channel 42.

The separation space 55 may be formed between the base plate 575 and the partition wall 208. The first duct section 441, the second duct section 461, and the third supply air duct 48 may be disposed in the separation space 55.

The steam generator 502 may be disposed in the heating device 50. The steam generated by the steam generator 502 may be sprayed into the inner space 33 of the refresher 3 through the second steam supply pipe 502*b*. The steam generated by the steam generator 502 may be sprayed into the second drum 24 through the third steam supply pipe 502*c*.

The second steam supply pipe 502*b* may extend from the steam generator 502 to the lateral side, to be connected to the refresher 3.

The third steam supply pipe 502*c* may extend downwardly from the steam generator 502 to be connected to the tub 23.

The steam generated by the steam generator 502 may flow to each of the second drum 24 and the inner space 33 of the refresher 3 by the blowing force of the fan 60. That is, by pressurizing the steam generated by the steam generator 502, the fan 60 may cause the steam to flow to the second drum 24 and the inner space 33 of the refresher 3.

A valve for controlling an amount of steam flow may be provided for each of the second steam supply pipe 502*b* and the third steam supply pipe 502*c*. By adjusting an opening degree of the valve, the controller 81 may adjust the amount of steam supplied to each of the second drum 24 and the inner space 33 of the refresher 3.

The laundry treating apparatus B may include the second steam generator 506 disposed in the dryer 1. The laundry treating apparatus B may include a plurality of steam generators 502 and 506. The steam generator 502 disposed in the heating device 50 may be referred to as a "first steam generator," and the steam generator 506 disposed in the dryer 1 may be referred to as a "second steam generator."

The laundry treating apparatus B may include the first steam supply pipe 506*a* connecting the second steam generator 506 and the first drum 13, and the fourth steam supply pipe 506*b* connecting the second steam generator 506 and the refresher 3.

The second steam generator 506 may be disposed in the first cabinet 10. The steam generated by the second steam generator 506 may be sprayed into the first drum 13 through the first steam supply pipe 506*a*. The steam generated by the second steam generator 506 may be sprayed into the inner space 33 of the refresher 3 through the fourth steam supply pipe 506*b*.

The fourth steam supply pipe 506*b* may extend from the second steam generator 506 to the lateral side, to be connected to the refresher 3.

A valve for controlling an amount of steam flow may be provided for each of the first steam supply pipe 506*a* and the fourth steam supply pipe 506*b*. By adjusting an opening degree of the valve, the controller 81 may adjust the amount of steam supplied to each of the first drum 13 and the inner space 33 of the refresher 3.

The water supply ports 273 and 274 may be disposed closer to the partition wall 208 than to the second lower panel 204. The first steam generator 502 may be disposed between the second upper panel 203 and the partition wall 208. Accordingly, as a distance between the first steam generator 502 and the water supply pipes 278 and 279 becomes shorter, the water supply pipes 278 and 279 connected to the first steam generator 502 may be reduced in length.

Referring to FIG. 16, the laundry unloaded through the second laundry loading opening 22 of the washing machine 2 may drop to the first door 11 of the dryer 1 to be loaded through the first laundry loading opening 12.

The first door 11 may be moved vertically. The first door 11 may be vertically rotated about a predetermined rotational axis which extends horizontally.

The first door 11 may be moved in a first direction Q to open the first laundry loading opening 12. The first direction Q may be a direction in which the first door 11 is rotated about a rotational axis which extends horizontally.

The first door 11 may have a first handle 11*b*. The first handle 11*b* may be recessed radially inwardly from an outer circumferential surface of the first door 11. By holding the first handle 11*b*, the user may rotate the first door 11.

The second door 21 may be moved horizontally. The second door 21 may be horizontally rotated about a predetermined rotational axis which extends vertically.

The second door 21 may be moved in a second direction P to open the second laundry loading opening 22. The second direction P may be a direction in which the second door 21 is rotated about a rotational axis which extends vertically.

The second door 21 may have a second handle 21*b*. The second handle 21*b* may be recessed radially inwardly from an outer circumferential surface of the second door 21. By holding the second handle 21*b*, the user may rotate the second door 21.

After a washing operation of the washing machine 2 is finished, the user may open the second door 21 to unload the laundry in the second drum 24 from the second cabinet 20 through the second laundry loading opening 22. The user may open the first door 11 after the washing operation of the washing machine 2 is finished. The user may move the wet laundry, which is unloaded from the washing machine 2, to a lower position and load the laundry into the first drum 13. According to the laundry treating apparatus B of the present disclosure, the user moves the wet, heavy laundry unloaded from the washing machine 2 to a lower position, such that the user's workload may be reduced compared to a case where the user lifts the wet, heavy laundry to a higher position. Further, the heating device 50 is disposed over the washing machine 2, such that the height of the laundry loading openings 12 and 22 is lowered, thereby allowing the user to easily unload the laundry from the second drum 24 through the second laundry loading opening 22 and move the laundry to the first laundry loading opening 12. In addition, by dropping the laundry, unloaded through the second laundry loading opening 22, toward the first door 11, the user may load the laundry placed on the top of the first door 11 into the first drum 13.

The opening member 463 may shield the front side of the separation space 55. The opening member 463 may be disposed at the front side of the dehumidification duct 46 and the outside air inlet port 423. The opening member 463 may shield the front side of the hot air outlet 462 and the outside air inlet 49.

The laundry treating apparatus B may include the hinge 463*a* connected to the opening member 463, and the motor 463*b* rotating the hinge 463*a*.

The hinge 463*a* may be rotatably coupled to the second front panel 201. The hinge 463*a* may extend in the left-right direction. The opening member 46 may be rotated in the front-rear direction with the hinge 463*a* serving as a rotational axis. The opening member 463 may be integrally formed with the hinge 463*a*. When the motor 463*b* rotates the hinge 463*a*, the opening member 463 may be rotated together with the hinge 463*a*. The opening member 463 may be rotated forward to open the front side of the separation space 55. Once the opening member 463 opens the front side of the separation space 55, outside air of the laundry treating apparatus B may flow into the heat exchange channel 42 through the outside air inlet port 423, and the air passing through the dehumidification duct 46 may be discharged to the outside of the laundry treating apparatus B.

The controller 81 may be electrically connected to the motor 463*b*. The controller 81 may control the operation of the motor 463*b*. The user may open the separation space 55 by manipulating the control panel 8.

The dehumidification duct 46 and the outside air inlet port 423 may be disposed above the first door 11 and the second door 21. As the dehumidification duct 46 and the outside air inlet port 423 are disposed at a higher position, it is possible to prevent high temperature and dry air, flowing through the dehumidification duct 46, from being directly exposed to the user. The dehumidification duct 46 and the outside air inlet port 423 may be disposed at a height corresponding to the upper portion of the refresher 3.

Referring to FIG. 17, the first supply air duct 430 may branch off from the second supply air duct 450.

Without being directly connected to the heating device 50, the first supply air duct 430 may branch off from the second supply air duct 450. When the first supply air duct 430 branches off from the second supply air duct 450, the first discharge port 425 may not be formed. The first supply air duct 430 may extend downwardly from the first hot air duct 451.

The second supply air duct 450 may extend from the flowing duct 420 to the lateral side. The second supply air duct 450 may extend horizontally at the rear side of the third rear panel 302.

The first supply air duct 430 may branch off from the second supply air duct 450 at the rear side of the third rear panel 302. The first supply air duct 430 may extend downwardly from the second supply air duct 450. The first supply air duct 430 may extend into the first cabinet 10 to be connected to the first drum 13.

The laundry treating apparatus B' may include the control valve 453 disposed at a position where the first supply air duct 430 branches off from the second supply air duct 450.

The control valve 453 may control a flow direction of air flowing in the second supply air duct 450. The control valve 453 may control a flow direction of air flowing in the first hot air duct 451. The control valve 453 may open and close the second hot air duct 452 and the first supply air duct 430. The control valve 453 may open only either the second hot air duct 452 or the first supply air duct 430. The control valve 453 may open both the second hot air duct 452 and the first supply air duct 430. The control valve 453 may control an amount of air supplied to the second hot air duct 452 or the first supply air duct 430. The control valve 453 may distribute the air, blown by the fan 60 to the second supply air duct 450, to the second hot air duct 452 and the first supply air duct 430.

The controller 81 may control the control valve 453. By controlling the control valve 453, the controller 81 may supply the hot air, supplied from the fan 60 to the second supply air duct 450, into the inner space 33 of the refresher 3. By controlling the control valve 453, the controller 81 may supply the hot air, supplied from the fan 60 to the second supply air duct 450, into the first drum 13.

However, a structure of the supply air duct connected to the dryer 1 and the refresher 3 may selectively employ the structure of the supply air duct described above with reference to FIG. 15 or 17. That is, the supply air duct connected to the dryer 1 and the refresher 3 may be installed as illustrated in FIG. 15 or in FIG. 17.

While the present disclosure has been particularly shown and described with reference to preferred embodiments thereof, it will be understood by those skilled in the art that the present disclosure is not limited to those exemplary embodiments and various changes in form and details may be made therein without departing from the scope and spirit of the invention as defined by the appended claims and should not be individually understood from the technical spirit or prospect of the present disclosure.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

A laundry treating apparatus may include a dryer including a first cabinet and a first drum rotatably mounted in the first cabinet; a washing machine including a second cabinet vertically disposed with respect to the first cabinet, a tub disposed in the second cabinet, and a second drum rotatably mounted in the tub; a refresher including a third cabinet disposed on one side of the first cabinet and the second cabinet, and having an inner space for receiving laundry; a heating device disposed above the first drum and the second drum, and heating air supplied into the inner space of the refresher; and a supply air duct connecting the heating device and an upper portion of the refresher.

The laundry treating apparatus may be configured as above, wherein the supply air duct extends from the heating device to a lateral side and is connected to a supply air hole formed at the upper portion of the refresher.

The laundry treating apparatus may be configured as above, wherein the third cabinet comprises an inner surface directed toward the inner space of the third cabinet; an outer surface directed toward an outside of the third cabinet; and an inclined surface extending obliquely downwardly from the inner surface, wherein the supply air hole is open obliquely downwardly toward the inner space of the third cabinet in the inclined surface.

The laundry treating apparatus may be configured as above, wherein the refresher further comprises a hanger, on which clothing placed in the inner space of the third cabinet is hung, wherein the supply air hole is disposed above the hanger.

The laundry treating apparatus may be configured as above, further comprising an exhaust air duct connecting the upper portion of the refresher and the heating device.

The laundry treating apparatus may be configured as above, wherein the exhaust air duct is connected to an exhaust air hole formed at the upper portion of the refresher and extends from the exhaust air hole to a lateral side to be connected to the heating device, wherein the exhaust air hole is disposed below the supply air hole connected to the supply air duct.

The laundry treating apparatus may be configured as above, wherein the supply air hole and the exhaust air hole are open toward the inner space of the third cabinet at positions horizontally spaced apart from each other.

The laundry treating apparatus may be configured as above, further comprising a dehumidification duct disposed above the first drum and the second drum and discharging the air, heated by the heating device, to an outside of the laundry treating apparatus.

The laundry treating apparatus may be configured as above, further comprising a partition wall disposed above the first drum and the second drum and disposed below the heating device, wherein the heating device comprises a heat exchange unit heating the air supplied into the inner space of the third cabinet; and a heat exchange channel in which the heat exchange unit is disposed, and which is spaced from an upper side of the partition wall, wherein the dehumidification duct is disposed in a space formed between the partition wall and the heat exchange channel.

The laundry treating apparatus may be configured as above, wherein the dryer further comprises a first door rotatably coupled to the first cabinet, and the washing machine further comprises a second door rotatably coupled to the second cabinet, wherein the dehumidification duct is disposed above the first door and the second door.

The laundry treating apparatus may be configured as above, wherein the dryer further comprises a first laundry loading opening formed in the first cabinet, and a first door for opening and closing the first laundry loading opening, and the washing machine further comprises a second laundry loading opening formed in the second cabinet, and a second door for opening and closing the second laundry loading opening, wherein the heating device is disposed above the first laundry loading opening and the second laundry loading opening.

The laundry treating apparatus may be configured as above, wherein the second laundry loading opening is disposed above the first laundry loading opening, and the first door is rotated downwardly from a front surface of the first cabinet to open the first laundry loading opening.

The laundry treating apparatus may be configured as above, wherein the supply air duct comprises a first supply air duct extending downwardly from the heating device to be connected to the first drum; and a second supply air duct extending to a lateral side from the heating device to be connected to the refresher.

The laundry treating apparatus may be configured as above, further comprising a first exhaust air duct connecting the first drum and the heating device; and a second exhaust hair duct connecting the refresher and the heating device, wherein the first exhaust air duct joins the second exhaust air duct.

The laundry treating apparatus may be configured as above, further comprising a plate for coupling the second cabinet and the third cabinet, wherein the second cabinet has a second inner wall facing the third cabinet, and the third cabinet has a third inner wall facing the second cabinet, wherein the plate is disposed between the second inner wall and the third inner wall to couple the second cabinet and the third cabinet.

The laundry treating apparatus may be configured as above, wherein the plate comprises a first plate disposed between the second inner wall and the third inner wall; a second plate connected to the first plate and extending horizontally under the second cabinet and the third cabinet; and a grip recessed upwardly from a lower surface of the second plate.

The laundry treating apparatus may be configured as above, further comprising a partition wall disposed under the heating device and separating a space, in which the first drum and the second drum are disposed, from a space in which the heating device is disposed.

The laundry treating apparatus may be configured as above, further comprising a steam generator disposed in the heating device; and a steam supply pipe connecting the steam generator and the upper portion of the refresher.

A laundry treating apparatus may include a dryer including a first cabinet having a first laundry loading opening, and a first drum rotatably mounted in the first cabinet; a washing machine including a second cabinet having a second laundry loading opening and disposed vertically with respect to the first cabinet, a tub disposed in the second cabinet, and a second drum rotatably mounted in the tub; and a heating device disposed above the first laundry loading opening and the second laundry loading opening, and heating air supplied into the first drum.

A laundry treating apparatus may include a dryer including a first cabinet and a first drum rotatably mounted in the first cabinet; a washing machine including a second cabinet disposed vertically with respect to the first cabinet, a tub disposed in the second cabinet, and a second drum rotatably mounted in the tub; a heating device disposed above the first drum and the second drum, and heating air supplied into the first drum; and a dehumidification duct connected to the heating device, and discharging the air, heated by the heating device, to an outside of the first cabinet and the second cabinet.

A laundry treating apparatus may include a dryer including a first cabinet and a first drum rotatably mounted in the first cabinet; a washing machine including a second cabinet disposed under the first cabinet and having an upper panel coupled to a lower portion of the first cabinet, a tub disposed in the second cabinet, a second drum rotatably mounted in the tub, and a suspension for attenuating vibrations generated in the tub; and a refresher including a third cabinet disposed on one side of the washing machine, and having an inner space for receiving laundry, wherein the second cabinet has a side panel which is disposed between the tub and the third cabinet to face the third cabinet, and which is coupled to the third cabinet.

The laundry treating apparatus may be configured as above, further comprising a plate disposed between the side panel and the third cabinet, and connecting the side panel and the third cabinet.

The laundry treating apparatus may be configured as above, wherein the plate comprises a first plate extending vertically between the side panel and the third cabinet, wherein the first plate includes a damping material.

The laundry treating apparatus may be configured as above, further comprising a fastening member for coupling the plate, the second cabinet, and the third cabinet, wherein the plate further comprises a second plate extending horizontally under the second cabinet and the third cabinet, wherein the fastening member passes through the second plate and the second cabinet, and passes through the second plate and the third cabinet.

The laundry treating apparatus may be configured as above, further comprising rollers protruding downwardly from a lower panel disposed under the tub, in which at least some of the rollers are rotated.

The laundry treating apparatus may be configured as above, further comprising a plurality of legs protruding downwardly from the side panel of the washing machine and spaced apart from each other in a front-rear direction.

The laundry treating apparatus may be configured as above, further comprising a heating device disposed above the first drum and the tub and heating air supplied into the first drum and the inner space of the refresher.

The laundry treating apparatus may be configured as above, wherein the heating device is disposed on one side of the third cabinet, is arranged vertically with respect to the tub and the first drum, and is disposed at a height corresponding to the upper portion of the refresher.

The laundry treating apparatus may be configured as above, further comprising a first supply air duct extending downwardly from the heating device and connected to the first drum; and a second supply air duct extending from the heating device to a lateral side and connected to the upper portion of the refresher.

The laundry treating apparatus may be configured as above, further comprising a first exhaust air duct extending upwardly from the first drum and connected to the heating device; and a second exhaust air duct connected to the heating device and extending from the upper portion of the refresher to the lateral side.

A laundry treating apparatus may include a dryer including a first cabinet and a first drum rotatably mounted in the first cabinet; a washing machine including a second cabinet disposed under the first cabinet, a tub disposed in the second cabinet, and a second drum rotatably mounted in the tub; a refresher including a third cabinet disposed on one side of the dryer and the washing machine, and having an inner space for receiving laundry; a heating device disposed over the first drum and heating air supplied into the first drum; a first supply air duct supplying air, heated by the heating device, into the first drum and connected to the first drum; and a second supply air duct supplying the air, heated by the heating device, into the inner space of the refresher and connected to an upper portion of the refresher.

The laundry treating apparatus may be configured as above, wherein the first supply air duct extends downwardly from the heating device to be connected to the first drum, and the second supply air duct extends from the heating device to the lateral side to be connected to the upper portion of the refresher.

The laundry treating apparatus may be configured as above, wherein the refresher comprises a first upper plate extending horizontally along an upper side of the inner space; a second upper plate extending obliquely downwardly from the first upper plate; and a supply air hole which is connected to the second supply air duct, is formed on the second upper plate, and is open toward the inner space.

The laundry treating apparatus may be configured as above, further comprising a first exhaust air duct extending upwardly from the first drum to be connected to the heating device; and a second exhaust air duct extending from the upper portion of the refresher to the lateral side to be connected to the heating device.

The laundry treating apparatus may be configured as above, wherein the second supply air duct is disposed at a higher position than the second exhaust air duct.

The laundry treating apparatus may be configured as above, further comprising a third exhaust air duct for discharging air in the tub, wherein the third exhaust air duct extends from the tub to join the second exhaust air duct.

The laundry treating apparatus may be configured as above, further comprising a third supply air duct which supplies the air heated by the heating device into the tub, and extends vertically in a space formed at a rear side of the refresher.

A laundry treating apparatus may include a dryer including a first cabinet and a first drum rotatably mounted in the first cabinet; a washing machine including a second cabinet disposed vertically with respect to the first cabinet, a tub disposed in the second cabinet, and a second drum rotatably mounted in the tub; a refresher including a third cabinet spaced from one side of the dryer and the washing machine, and having an inner space for receiving laundry; a heating device heating air supplied into the drum and disposed vertically with respect to the first drum and the tub; a storage cabinet disposed between the heating device and the third cabinet; a first supply air duct connecting the heating device and the first drum; and as second supply air duct connecting the heating device and the refresher and extending across a rear space of the storage cabinet.

The laundry treating apparatus may be configured as above, further comprising a first exhaust air duct connecting the first drum and the heating device; and a second exhaust air duct connecting the refresher and the heating device, and extending across the rear space of the storage cabinet.

The laundry treating apparatus may be configured as above, wherein an extended length of the second supply air duct is shorter than an extended length of the second exhaust air duct.

A laundry treating apparatus may include a dryer including a first cabinet with a first laundry loading opening, and a first drum disposed in the first cabinet and providing a laundry receiving space; a washing machine including a second cabinet disposed over the first cabinet and having a second laundry loading opening, a tub disposed in the second cabinet, and a second drum mounted in the tub and providing a laundry receiving space; and a heating device disposed above the first drum and the second drum and heating air supplied into the first drum, wherein the second drum opens toward the second laundry loading opening so that the laundry placed therein is unloaded through the second laundry loading opening, and the first drum is disposed under the second drum and opens toward the first laundry loading opening so that the laundry unloaded from the second drum is loaded through the first laundry loading opening.

The laundry treating apparatus may be configured as above, further comprising a first door having a first handle, rotatably coupled to the first cabinet, and opening and closing the first laundry loading opening; and a second door having a second handle, rotatably coupled to the second cabinet, and opening and closing the second laundry loading opening disposed above the first laundry loading opening, wherein the second door is disposed under the heating device.

The laundry treating apparatus may be configured as above, wherein the first door is rotated downwardly from the first cabinet, to open the first laundry loading opening.

The laundry treating apparatus may be configured as above, wherein the heating device is disposed in the second cabinet and is disposed at an upper portion of the second cabinet.

The laundry treating apparatus may be configured as above, further comprising a partition wall disposed between the heating device and the second drum, wherein the heating device is disposed over the partition wall.

The laundry treating apparatus may be configured as above, further comprising a dehumidification duct, through which the air heated by the heating device is introduced, and which communicates with the outside of the second cabinet, wherein the dehumidification duct is disposed over the second laundry loading opening.

The laundry treating apparatus may be configured as above, further comprising a refresher disposed on one side of the dryer and the washing machine, and having an inner space for receiving laundry, wherein the refresher is disposed on one side of the heating device and is supplied with the air heated by the heating device.

The laundry treating apparatus may be configured as above, wherein the second drum is rotatably mounted in the second cabinet, and the refresher includes a third cabinet facing one side of the second cabinet and coupled to the second cabinet.

The laundry treating apparatus may be configured as above, wherein a height of the refresher is greater than a height of the washing machine, and the second drum is disposed at a height corresponding to an upper portion of the refresher.

The laundry treating apparatus may be configured as above, further comprising a first supply air duct connecting the heating device and the first drum, wherein the first supply air duct extends vertically from a rear side of the refresher.

The laundry treating apparatus may be configured as above, further comprising a first exhaust air duct connecting the first drum and the heating device; and a second exhaust air duct connecting the refresher and the heating device, wherein the first exhaust air duct, disposed between the first drum and the heating device, is connected to the second exhaust air duct.

The laundry treating apparatus may be configured as above, further comprising a second supply air duct connecting the heating device and the refresher, wherein the heating device is positioned at a height corresponding to the upper portion of the refresher, and the second supply air duct extends from the heating device to the lateral side, to be connected to the upper portion of the refresher.

The laundry treating apparatus may be configured as above, further comprising a second exhaust air duct connecting the heating device and the refresher, wherein the heating device is positioned at a height corresponding to the upper portion of the refresher, and the second supply air duct extends from the upper portion of the refresher to the lateral side, to be connected to the heating device.

A laundry treating apparatus may include a dryer including a first cabinet and a first drum rotatably mounted in the first cabinet; a washing machine including a second cabinet disposed over the first cabinet, a tub disposed in the second cabinet, and a second drum rotatably mounted in the tub; a heating device heating air supplied into the first drum, and disposed above the first drum and the second drum; and a refresher having an inner space for receiving laundry, wherein the refresher includes a third cabinet disposed on one side of the washing machine and the heating device, facing one side of the second cabinet, and coupled to the second cabinet.

The laundry treating apparatus may be configured as above, further comprising plate disposed between the second cabinet and the third cabinet, and coupled to the second cabinet and the third cabinet, wherein the plate includes a damping material.

The laundry treating apparatus may be configured as above, wherein the second cabinet comprises a second lower panel disposed over the first cabinet; and a second side panel disposed on one side of the third cabinet, wherein the second lower panel is coupled to the upper panel of the first cabinet, and the second side panel is coupled to the side panel of the third cabinet.

A laundry treating apparatus may include a dryer including a first cabinet, a first door rotatably coupled to the first cabinet, and a first drum rotatably mounted in the first cabinet; a washing machine including a second cabinet disposed over the first cabinet, a second door rotatably coupled to the second cabinet, a tub disposed in the second cabinet, and a second drum rotatably mounted in the tub; a heating device disposed over the tub and including a heat exchange unit for heating air; and a dehumidification duct disposed above the second door and discharging the air, heated by the heating device, to an outside of the first cabinet and the second cabinet.

The laundry treating apparatus may be configured as above, further comprising an outside air inlet port communicating with the second cabinet; a heat exchange channel which is connected to the outside air inlet port, in which the heat exchange unit is disposed, and which is disposed over the tub; and a fan disposed in the heat exchange channel and connected to the dehumidification duct, wherein the dehumidification duct and the outside air inlet port are disposed between the heat exchange channel and the tub.

The laundry treating apparatus may be configured as above, further comprising a partition wall disposed between the dehumidification duct and the tub.

The laundry treating apparatus may be configured as above, wherein the heating device includes a base plate on which the heat exchange unit is mounted, wherein a separation space, in which the dehumidification duct is disposed, is formed between the base plate and the partition wall.

A laundry treating apparatus may include a cabinet having an opening, formed on a front side thereof, and an inner space for receiving laundry; a hanger, on which clothing placed in the inner space of the cabinet is hung, and which is disposed at an upper portion of the inner space of the cabinet; a door coupled to the front side of the cabinet, and opening and closing the opening; a heating device heating air supplied into the inner space of the cabinet; and a supply air duct connecting the heating device and the cabinet, wherein the supply air duct is connected to a supply air hole that is open toward the inner space of the cabinet, and is disposed above the hanger.

The laundry treating apparatus may be configured as above, wherein the cabinet has an upper wall having a first surface spaced from an upper side of the hanger, wherein the supply air hole is disposed at a height between the first surface and the hanger.

The laundry treating apparatus may be configured as above, wherein the upper wall has a second surface extending obliquely downwardly from the first surface toward a rear side, wherein the supply air hole is open in the second surface.

The laundry treating apparatus may be configured as above, wherein the supply air duct extends upwardly and convexly from the supply air hole.

The laundry treating apparatus may be configured as above, further comprising an exhaust air duct, wherein the exhaust air duct is connected to an exhaust air hole that is open toward the inner space of the cabinet and is disposed at a lower portion of the cabinet.

The laundry treating apparatus may be configured as above, further comprising a filter disposed in the exhaust air hole.

The laundry treating apparatus may be configured as above, further comprising a first plate disposed under the inner space of the cabinet, and having a dust hole that is vertically open; and a second plate disposed under the first plate.

The laundry treating apparatus may be configured as above, wherein the first plate is disposed below the exhaust air hole.

The laundry treating apparatus may be configured as above, further comprising an exhaust air duct connecting the heating device and the cabinet, wherein the exhaust air duct is connected to an exhaust air hole that is open toward the inner space of the cabinet and is disposed at an upper portion of the cabinet.

The laundry treating apparatus may be configured as above, wherein the exhaust air hole is disposed below the hanger.

The laundry treating apparatus may be configured as above, wherein the exhaust air hole is disposed below the supply air hole.

The laundry treating apparatus may be configured as above, wherein the exhaust air hole is disposed further away from the heating device than the supply air hole.

A laundry treating apparatus may include a cabinet having an opening, formed on a front side thereof, and an inner space for receiving laundry; a door coupled to the front side of the cabinet, and opening and closing the opening; a heating device heating air supplied into the inner space of the cabinet; and a supply air duct connecting the heating device and the cabinet, wherein the heating device is disposed on one side of the cabinet, and the supply air duct extends from the heating device to be connected to an upper portion of the cabinet.

The laundry treating apparatus may be configured as above, wherein the heating device is disposed at a position corresponding to a middle height of the cabinet, wherein the supply air duct comprises a first supply air portion extending from the heating device to a lateral side and bent upwardly; and a second supply air portion extending upwardly and convexly from the first supply air portion and connected to the upper portion of the cabinet.

The laundry treating apparatus may be configured as above, further comprising an exhaust air duct extending from the heating device to be connected to a lower portion of the cabinet, wherein the heating device is disposed at a position corresponding to a middle height of the cabinet, and the exhaust air duct comprises a first exhaust air portion extending rearwardly from the lower portion of the cabinet; and a second exhaust air portion extending upwardly from the first exhaust air portion and bent to the lateral side to be connected to the heating device.

The laundry treating apparatus may be configured as above, wherein the heating device is disposed at a position corresponding to the upper portion of the cabinet, wherein the supply air duct extends from the heating device to the lateral side to be connected to the upper portion of the cabinet.

The laundry treating apparatus may be configured as above, further comprising an exhaust air duct extending from the heating device to be connected to the upper portion of the cabinet, wherein the heating device is disposed at a position corresponding to the upper portion of the cabinet, and the exhaust air duct extends from the heating device to the lateral side to be connected to the upper portion of the cabinet.

The laundry treating apparatus may be configured as above, further comprising a dryer disposed on one side of the cabinet, and having a first drum rotatably mounted therein; and a washing machine disposed on one side of the cabinet, and having a second drum rotatably mounted therein, wherein the dryer, the washing machine, and the heating device are arranged vertically on one side of the cabinet.

The laundry treating apparatus may be configured as above, wherein the supply air duct extends from the heating device to the lateral side and is connected to the cabinet at a rear side of the cabinet.

A laundry treating apparatus may include a cabinet having an opening, formed on a front side thereof, and an inner space for receiving laundry; a door coupled to the front side of the cabinet, and opening and closing the opening; a heating device heating air supplied into the inner space of the cabinet; and a supply air duct connecting the heating device and the cabinet, wherein the supply air duct is connected to an upper portion of the cabinet.

Various embodiments described herein may be implemented in a computer-readable medium using, for example, software, hardware, or some combination thereof. For example, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions may be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A laundry treating apparatus comprising
- a dryer including:
  - a first cabinet; and
  - a first drum rotatably disposed in the first cabinet;
- a washing machine including:
  - a second cabinet arranged vertically with respect to the first cabinet;
  - a tub disposed in the second cabinet; and
  - a second drum rotatably disposed in the tub;
- a refresher including a third cabinet disposed at a lateral side of the first cabinet and the second cabinet, the third cabinet having an inner space for receiving laundry;
- a plate assembly for coupling the second cabinet and the third cabinet;
- a heating device disposed above the first cabinet and the second cabinet, the heating device for heating air supplied into the inner space of the third cabinet; and
- a supply air duct connecting the heating device and an upper portion of the refresher,
- wherein the supply air duct includes:
  - a first supply air duct extending downwardly from the heating device and connected to the first drum; and
  - a second supply air duct extending to a lateral side from the heating device and connected to the refresher,
- wherein the first cabinet includes a first inner wall facing the refresher,
- wherein the second cabinet includes a second inner wall facing the third cabinet,
- wherein the third cabinet includes a third inner wall facing the second cabinet,
- wherein the plate assembly is disposed between the second inner wall and the third inner wall,
- wherein the plate assembly includes:
  - a first plate disposed between the second inner wall and the third inner wall;
  - a second plate connected to the first plate and extending horizontally at a position under the second cabinet and the third cabinet; and
  - a grip recessed upwardly from a lower surface of the second plate.

2. The laundry treating apparatus of claim 1, wherein the refresher further includes:
- a supply air hole connected to the supply air duct at the upper portion of the refresher;
- an exhaust air duct connecting the refresher and the heating device; and
- an exhaust air hole connected to the exhaust air duct.

3. The laundry treating apparatus of claim 2, wherein the third cabinet includes:
- a top surface; and
- an inclined surface extending obliquely downwardly from the top surface, and
- wherein the supply air hole is open obliquely downwardly toward the inner space of the third cabinet at the inclined surface.

4. The laundry treating apparatus of claim 2, wherein the refresher further includes a hanger for hanging clothing in the inner space of the third cabinet, and
- wherein the supply air hole is positioned above the hanger.

5. The laundry treating apparatus of claim 4, wherein the exhaust air hole is formed at the upper portion of the refresher, and
- wherein the exhaust air hole is positioned below the supply air hole.

6. The laundry treating apparatus of claim 5, wherein the supply air hole and the exhaust air hole are open toward the inner space of the third cabinet at positions horizontally spaced apart from each other.

7. The laundry treating apparatus of claim 1, further comprising a dehumidification duct disposed above the first drum and the second drum, the dehumidification duct for discharging the air heated by the heating device to an outside of the laundry treating apparatus.

8. The laundry treating apparatus of claim 7, further comprising a partition wall disposed above the first drum and the second drum and disposed below the heating device,
- wherein the heating device comprises
  - a heat exchange unit for heating the air supplied into the inner space of the third cabinet; and
  - a heat exchange channel in which the heat exchange unit is disposed, the heat exchange channel being spaced from an upper side of the partition wall, and
- wherein the dehumidification duct is disposed in a space formed between the partition wall and the heat exchange channel.

9. The laundry treating apparatus of claim 8, further comprising an outside air inlet disposed above the first drum and the second drum and adjacent to the dehumidification duct, wherein the outside air inlet is connected to the heat exchange channel.

10. The laundry treating apparatus of claim 1, further comprising:

a first exhaust air duct connecting the first drum and the heating device; and a second exhaust air duct connecting the refresher and the heating device, wherein the first exhaust air duct is joined to the second exhaust air duct.

11. The laundry treating apparatus of claim 1, further comprising:

a steam generator disposed in the heating device; and a steam supply pipe connecting the steam generator and the upper portion of the refresher.

12. The laundry treating apparatus of claim 1, wherein the dryer includes a first laundry loading opening and a first door for opening and closing the first laundry loading opening, the first door being rotatable downward, wherein the washer includes a second laundry loading opening and a second door for opening and closing the laundry loading opening, and wherein the washer is disposed above the dryer.

* * * * *